US005200304A

United States Patent [19]

Yoneyama et al.

[11] Patent Number: 5,200,304

[45] Date of Patent: Apr. 6, 1993

[54] SILVER HALIDE COLOR PHOTOGRAPHIC MATERIAL

[75] Inventors: Hiroyuki Yoneyama; Nobutaka Ohki, both of Kanagawa, Japan

[73] Assignee: Fuji Photo Film Co., Ltd., Ashigara, Japan

[21] Appl. No.: 627,759

[22] Filed: Dec. 14, 1990

[30] Foreign Application Priority Data

Dec. 22, 1989 [JP] Japan ..... 1-331222

[51] Int. Cl.[5] ..... G03C 7/34; G03C 1/34

[52] U.S. Cl. ..... 430/505; 430/546; 430/551; 430/552; 430/553

[58] Field of Search ..... 430/551, 552, 553, 546, 430/505

[56] References Cited

U.S. PATENT DOCUMENTS

| | | | |
|---|---|---|---|
| 4,732,845 | 3/1988 | Keiji et al. | 430/551 |
| 4,945,031 | 7/1990 | Sakai et al. | 430/553 |
| 5,037,730 | 8/1991 | Aoki et al. | 430/546 |

FOREIGN PATENT DOCUMENTS

| | | | |
|---|---|---|---|
| 0392481 | 10/1990 | European Pat. Off. | 430/551 |
| 022237 | 2/1982 | Japan | 430/551 |
| 3115166 | 5/1988 | Japan | 430/553 |

*Primary Examiner*—Lee C. Wright

*Attorney, Agent, or Firm*—Burns, Doane, Swecker & Mathis

[57] ABSTRACT

A multilayer silver halide color photographic material comprising a support having thereon a yellow color forming silver halide emulsion layer, a magenta color forming silver halide emulsion layer and a cyan color forming silver halide emulsion layer, wherein the cyan color forming silver halide emulsion layer contains at least one oil-soluble cyan coupler capable of coupling with an oxidation product of an aromatic primary amine developing agent to form a substantially diffusion-resistant dye, represented by formula (I), at least one member selected from the compounds represented by formulae (II) and (III), and at least one compound represented by formula (IV).

The silver halide color photographic material can be rapidly processed. Fluctuations of cyan dye density obtained therefrom owing to change in compositions of processing solutions can be prevented, and deterioration of the image formed therefrom during storage, due to cyan dye density caused after color development processing, can also be prevented.

37 Claims, No Drawings

SILVER HALIDE COLOR PHOTOGRAPHIC MATERIAL

FIELD OF THE INVENTION

The present invention relates to a silver halide color photographic material which is capable of being rapidly processed and which restrains fluctuations of the cyan dye density caused by changes in the composition of processing solutions. The photographic material can provide images whose deterioration during storage as prints due to change in cyan dye density subsequent to color development processing is suppressed.

BACKGROUND OF THE INVENTION

In forming color photographic images, light-sensitive layers containing three of yellow, magenta, and cyan color photographic couplers, respectively, are imagewise exposed, and then processed with a color developing solution containing a color developing agent. In this process, the couplers undergo a coupling reaction with an oxidation product of an aromatic primary amine to provide colored dyes.

Standard processing steps for silver halide color photographic materials generally comprise a color developing step where a color image is formed, a silver-removing step where developed silver and undeveloped silver are removed, and a water washing and/or image-stabilizing step.

The art has attempted to shorten the processing time and, recently, there has been an increased need to shorten this processing time because of the requests for delivery of the finished prints in a shorter time period and the attempts to both reduce work in laboratories and reduce the size and facilitating procedures for processing systems for small-scale laboratories, also called "mini-laboratories".

Shortening the time associated with the color developing step can be attained by properly combining the following techniques: using a coupler which has as rapid a coupling speed as possible, using a silver halide emulsion which has a rapid processing speed, using a color developing solution which has a rapid developing speed, and raising the temperature of the color developing solution.

Shortening the time for the desilverization or silver-removing step can be attained by decreasing the pH of either a bleaching solution or a bleach-fixing solution. Such acceleration of bleaching and fixing by decreasing pH of the bleach-fixing solution is described in *The Theory of the Photographic Process*, ed. T. H. James, Chap. 15, E. Bleach-Fix System.

However, acceleration of the bleaching step by decreasing the pH of the bleach-fixing solution can cause the deterioration of the image quality, because dyes which are formed from cyan couplers are converted to their leuco form to be decolorized, and do not return to the colored form before completion of the processing (hereinafter this phenomenon is referred to as "color restoration failure"). This causes an undesirable decrease in density. After the processing, color restoration gradually destroys the color balance of the image.

In order to solve this problem, the color-developed light-sensitive materials are washed with water to remove the color developing agent before the bleach-fixing step. However, this technique requires the number of processing steps to be increased and thus, the total processing time is prolonged.

Alternatively, a water-soluble ionic compound containing a polyvalent element can be added to the bleach-fixing bath as proposed in, for example, U.S. Pat. No. 3,773,510. However, this technique increases environmental pollution while failing to fully attain the objectives discussed above.

On the other hand, the conventional use of hydroquinones or quinones to control gradation, prevent fog, and prevent the fading of magenta dyes, as well as other purposes, is described, for example, in JP-A-55-161238, JP-A-60-60647, JP-A-53-32034 (the term "JP-A" as used herein means an "unexamined published Japanese patent application"), West German Patent Application (OLS) Nos. 2,149,789 and 3,320,483A1, JP-A-58-24141, JP-A-46-2128, JP-B-43-4934, JP-B-50-21249, JP-B-60-3171 (the term "JP-B" as used herein means an "examined Japanese patent publication"), JP-A-49-106329, JP-A-49-129535, British Patent 1,465,081, JP-A-49-129536, JP-A-49-134327, JP-A-50-110337, JP-A-50-156438, JP-A-51-6024, JP-A-51-9828, JP-A-51-14023, JP-A-52-65432, JP-A-52-128130, JP-A-52-146234, JP-A-52-146235, JP-A-53-9528, JP-A-53-55121, JP-A-53-139533, JP-A-54-24019, JP-A-54-25823, JP-A-54-29637, JP-A-54-70036, JP-A-54-97021, JP-A-54-133181, JP-A-55-95948, JP-A-56-5543, JP-A-56-83742, JP-A-56-85748, JP-A-56-87040, JP-A-56-153342, JP-A-57-112749, JP-A-57-176038, JP-A-58-136030, JP-A-59-72443, JP-A-59-75249, JP-A-59-83162, JP-A-59-101650, JP-A-59-180557, JP-A-60-60647, JP-A-59-189342, JP-A-59-191031, JP-A-60-55339, and JP-A-60-263149, *Research Disclosure*, Vol. 228, No. 2287 (1983), and U.S. Pat. Nos. 2,384,658, 2,403,721, 2,728,659, 2,735,765, 3,700,453, 2,675,314, 2,732,300 and 2,360,290. In particular, the prevention of fog through the use of hydroquinones which are substituted with an electron withdrawing group in an intermediate layer has been described, for example, in JP-B-59-35012, JP-A-56-109344 and JP-A-57-22237. However, there is no discussion relating to the color restoration failure in the above-mentioned publications.

Because hydroquinones can cause color restoration failure when employed in combination with a bleach-fixing solution having a comparatively high pH and which is adulterated with a color developing solution, the use of decreased amounts of hydroquinones has been proposed, for example, in JP-A-60-60647.

Further, JP-A-63-316857 relates to a method for preventing color restoration failure where a bleach-fixing solution having a low pH is employed with hydroquinones or quinones each substituted with an alkyl group. Although this method has had an effect on preventing color restoration failure, further improvement in this area is still needed. In addition, cyan color images provided by this method can degrade when the developed photographic materials are preserved under light of very high illuminance.

SUMMARY OF THE INVENTION

It is an object of the present invention to provide a silver halide color photographic material which can be rapidly processed such that a sufficiently high color density can be obtained in a short period of time.

Another object of the present invention is to provide a silver halide color photographic material in which color restoration failure of cyan dye image is improved while the deterioration of image quality due to destruction of the image color balance after processing is prevented.

A further object of the present invention is to provide a silver halide color photographic material which provides cyan color images having good preservability.

Other objects of the present invention will become apparent from the specification and claims which follow.

In accordance with the foregoing objectives, present invention relates to a multilayer silver halide color photographic material comprising a support having thereon a yellow color forming silver halide emulsion layer, a magenta color forming silver halide emulsion layer and a cyan color forming silver halide emulsion layer, wherein the cyan color forming silver halide emulsion layer contains at least one oil-soluble cyan coupler which is capable of coupling with an oxidation product of an aromatic primary amine developing agent to form a substantially diffusion-resistant dye, and which is represented by formula (I) described below, at least one member selected from the compounds represented by formulae (II) and (III) described below, and at least one compound represented by formula (IV) described below.

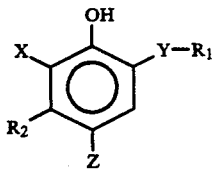

(I)

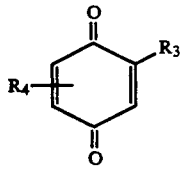

(II)

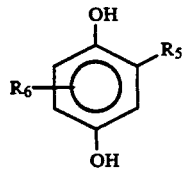

(III)

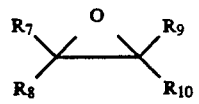

(IV)

wherein:

Y represents —NHCO— or —CONH—;

$R_1$ represents an alkyl group, an aryl group, a heterocyclic group or an amino group;

X represents a hydrogen atom, a halogen atom, an alkoxy group or an acylamino group;

$R_2$ represents an alkyl group or an acylamino group or, when bonded to X, a non-metallic atom which forms a 5-membered to 7-membered ring;

Z represents a hydrogen atom or a group capable of being released upon coupling with an oxidation product of a developing agent;

$R_3$ and $R_5$ each represents a halogen atom;

$R_4$ and $R_6$ each represents an alkyl group, an aryl group, an alkoxy group, an aryloxy group, an alkylthio group, an arylthio group, an amido group, an acyl group, a sulfonyl group, an alkoxycarbonyl group, an aryloxycarbonyl group, a carbamoyl group, a sulfamoyl group or a sulfoxide group, provided that each of these groups has 6 or more carbon atoms; and $R_7$, $R_8$, $R_9$ and $R_{10}$ each represents a hydrogen atom, an aliphatic group, an aromatic group, an aliphatic oxycarbonyl group, an aromatic oxycarbonyl group or a carbamoyl group, or $R_7$ and $R_8$ or $R_9$ and $R_{10}$ may combine with each other to form a 5-membered to 7-membered ring, with the provisos that $R_7$, $R_8$, $R_9$ and $R_{10}$ do not simultaneously represent hydrogen atoms and the total number of carbon atoms included therein is from 8 to 60.

DETAILED DESCRIPTION OF THE INVENTION

In the photographic material of the present invention, color restoration failure and light fading are further improved by incorporating at least one high boiling organic solvent having a viscosity of not less than 200 cp (at 25° C.) into the cyan color forming layer of the color photographic material.

Moreover, color restoration failure and light fading are still further improved by incorporating a water-insoluble organic polymer compound into the cyan color forming layer of the color photographic material.

The oil-soluble cyan coupler represented by formula (I) and the compound represented by formula (II) or (III) used in the present invention will be described in detail below.

In formula (I), $R_1$ represents an alkyl group, preferably a straight chain, branched chain or cyclic alkyl group containing from 1 to 32 carbon atoms (e.g., methyl, butyl, pentadecyl, or cyclohexyl), an aryl group (e.g., phenyl, or naphthyl), a heterocyclic group (e.g., 2-pyridyl, 3-pyridyl, 2-furanyl, or 2-oxazolyl) or an amino group, which are preferably substituted with one or more substituents selected from an alkyl group, an aryl group, an alkyl- or aryloxy group (e.g., methoxy, dodecyloxy, methoxyethoxy, phenyloxy, 2,4-di-tert-amylphenoxy, 3-tert-butyl-4-hydroxyphenyloxy group, or naphthyloxy), a carboxy group, an alkyl- or arylcarbonyl group (e.g., acetyl, tetradecanoyl, or benzoyl), an alkyl- or aryl-oxycarbonyl group (e.g., methoxycarbonyl, benzyloxycarbonyl, or phenoxycarbonyl), an acyloxy group (e.g., aceytyloxy, benzoyloxy, or phenylcarbonyloxy), a sulfamoyl group (e.g., N-ethylsulfamoyl, or N-octadecylsulfamoyl), a carbamoyl group (e.g., N-ethylcarbamoyl, or N-methyl-dodecylcarbamoyl), a sulfonamido group (e.g., methanesulfonamido, or benzenesulfonamido), an acylamino group (e.g., acetylamino, benzamido, ethoxycarbonylamino, or phenylaminocarbonylamino), an imido group (e.g., succinimido, or hydantoinyl), a sulfonyl group (e.g., methanesulfonyl), a hydroxy group, a cyano group, a nitro group, and a halogen atom.

In formula (I), $R_2$ preferably represents an alkyl group containing from 1 to 20 carbon atoms (e.g., methyl, ethyl, butyl, or pentadecyl) or an acylamino group (e.g., tetradecanoylamino, benzoylamino, or 2-(2,4-di-tert-amylphenoxy)butanamido). The alkyl group represented by $R_2$ may be substituted with one or more substituents selected from those described with respect to $R_1$.

In formula (I), X represents a hydrogen atom, a halogen atom (e.g., fluorine, chlorine, or bromine), an alkoxy group (e.g., methoxy, or butoxy) or an acylamino group (e.g., acetamido).

Condensed ring type cyan couplers wherein $R_2$ and X are bound to each other to form a 5-membered, 6-membered or 7-membered ring are also preferred as the compound represented by formula (I), as well as the above-described phenolic cyan couplers. Particularly preferable examples of such condensed ring type couplers are oxyindole type and imidazol-2-one type cyan couplers.

In formula (I), Z represents a hydrogen atom or a coupling-off group which is exemplified by a halogen atom (e.g., fluorine, chlorine, or bromine), an alkoxy group (e.g., ethoxy, dodecyloxy, methoxycarbamoylmethoxy, carboxypropyloxy, or methylsulfonylethoxy), an aryloxy group (e.g., 4-chlorophenoxy, 4-methoxyphenoxy, or 4-carboxyphenoxy), an acyloxy group (e.g., acetoxy, tetradecanoyloxy, or benzoyloxy), a sulfonyloxy group (e.g., methanesulfonyloxy, or toluenesulfonyloxy), an amido group (e.g., dichloroacetylamino, heptabutyrylamino, methanesulfonylamino, or toluenesulfonylamino), an alkoxycarbonyloxy group (e.g., ethoxycarbonyloxy, or benzyloxycarbonyloxy), an aryloxycarbonyloxy group (e.g., phenoxycarbonyloxy), an aliphatic or aromatic thio group (e.g., ethylthio, phenylthio, or tetrazolylthio), an imido group (e.g., succinimido, or hydantoinyl), an N-containing heterocyclic group (e.g., 1-pyrazolyl, or 1-benzotriazolyl), an aromatic azo group (e.g., phenylazo). These coupling-off groups may contain a photographically useful group.

In formulae (II) and (III), $R_3$ and $R_5$ each represents a halogen atom, preferably chlorine or bromine.

In formulae (II) and (III), $R_4$ and $R_6$ each represents an alkyl group, preferably a straight chain or branched chain alkyl group containing from 6 to 40 carbon atoms (e.g., sec-dodecyl, n-hexadecyl, or sec-icosyl), an aryl group preferably containing from 6 to 40 carbon atoms (e.g., phenyl, or p-tolyl), an alkoxy group preferably containing from 6 to 40 carbon atoms (e.g., tetradecyloxy, or hexadecyloxy), an aryloxy group preferably containing from 6 to 40 carbon atoms (e.g., phenoxy, or p-acetamidophenoxy), an alkylthio group preferably containing 6 to 40 carbon atoms (e.g., dodecylthio, or octadecylthio), an arylthio group preferably containing from 6 to 40 carbon atoms (e.g., phenylthio), an amido group preferably containing from 6 to 40 carbon atoms (e.g., benzoylamino, or hexadecanamido), an acyl group preferably containing from 6 to 40 carbon atoms (e.g., benzoyl, or hexadecanoyl), a sulfonyl group, an aliphatic or aromatic sulfonyl group preferably containing from 6 to 40 carbon atoms (e.g., benzenesulfonyl, or 4-dodecyloxybenzenesulfonyl), an alkoxycarbonyl group preferably containing 6 to 40 carbon atoms (e.g., hexadecyloxycarbonyl), an aryloxycarbonyl group preferably containing from 7 to 40 carbon atoms (e.g., phenoxycarbonyl), a carbamoyl group preferably containing 6 to 40 carbon atoms (e.g., N-dodecylcarbamoyl, or N,N-diphenylcarbamoyl), a sulfamoyl group preferably containing 6 to 40 carbon atoms (e.g., N,N-dihexylsulfamoyl, or N-phenylsulfamoyl), or a sulfoxide group preferably containing from 1 to 40 carbon atoms (e.g., hexadecanesulfoxide). The carbon atoms included in the substituent represented by $R_4$ or $R_6$ is 6 or more.

The compound represented by formula (II) or (III) may be a dimer, a trimer, an oligomer or a polymer.

In formula (I), Y preferably represents —NHCO—.

In formula (I), $R_1$ preferably represents an alkyl group or an aryl group with an alkyl group being particularly preferred.

In formula (I), $R_2$ preferably represents an alkyl group containing from 1 to 15 carbon atoms, with 1 to 4 carbon atoms being particularly preferred.

In formula (I), Z preferably represents a hydrogen atom or a halogen atom, with a halogen atom being particularly preferred.

In formula (I), X preferably represents a halogen atom. Those compounds where X and $R_2$ are bonded together to form a hetero ring are also preferred.

In formulae (II) and (III), $R_4$ and $R_6$ each preferably represents an alkyl group, an alkylthio group or an amido group, with an alkyl group being particularly preferred.

$R_3$ and $R_4$ in formula (II) and $R_5$ and $R_6$ in the formula (III) are preferably in the 2,5-substitution relation, respectively.

Specific examples of compounds represented by formulae (I), (II), and (III) according to the present invention are illustrated below, but the present invention should not be limited thereto.

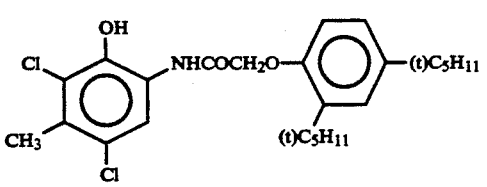

(I-1)

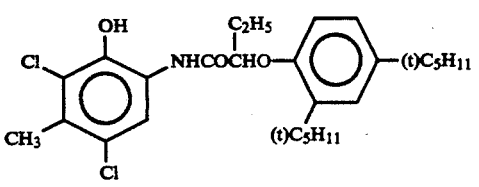

(I-2)

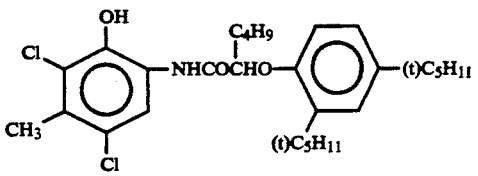

(I-3)

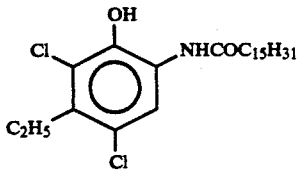

(I-4)

-continued
(I-5)
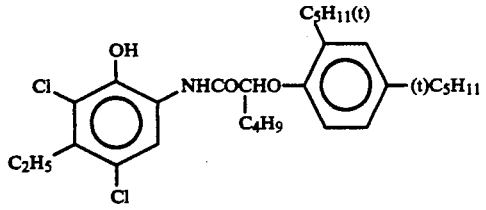
(I-6)
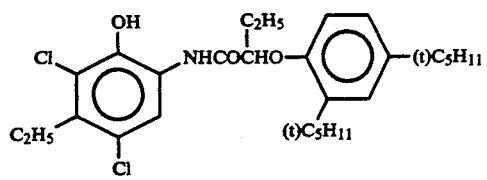
(I-7)
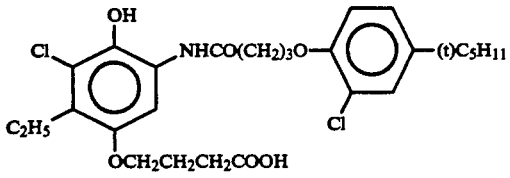
(I-8)
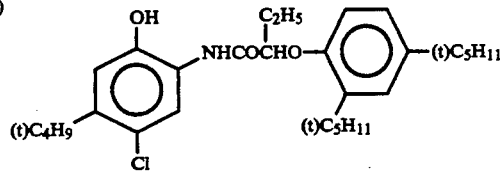
(I-9)
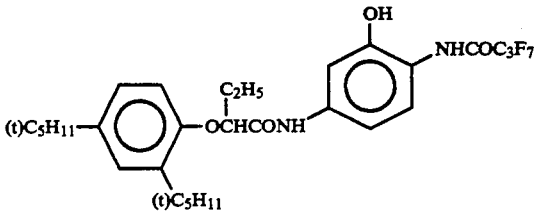
(I-10)
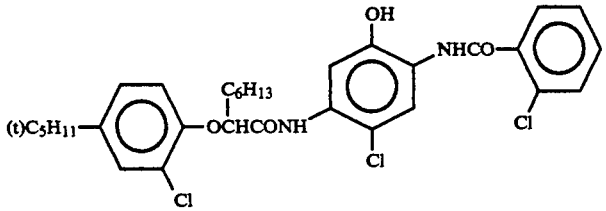
(I-11)
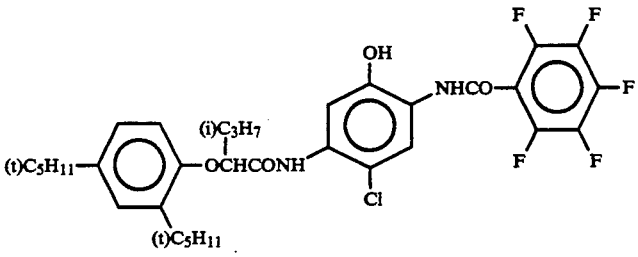
(I-12)
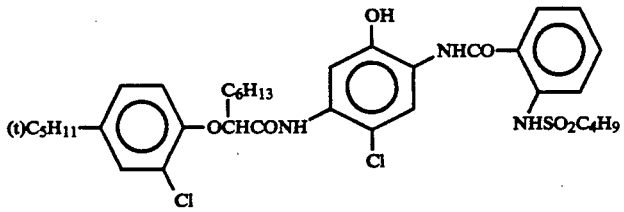
(I-13)
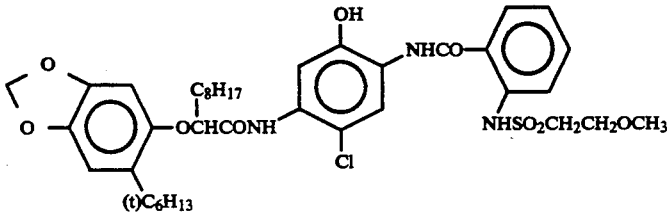

-continued
(I-14)
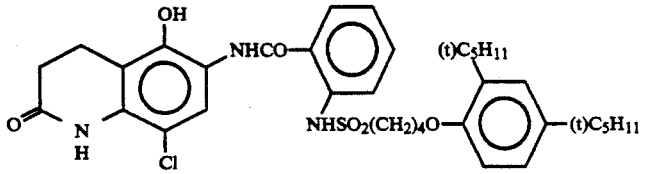
(I-15)
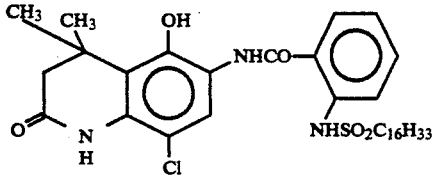
(I-16)
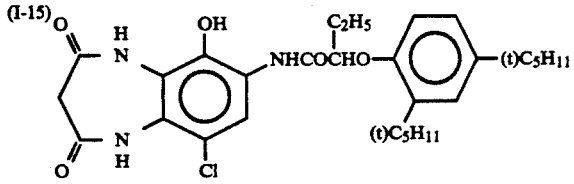
(I-17)
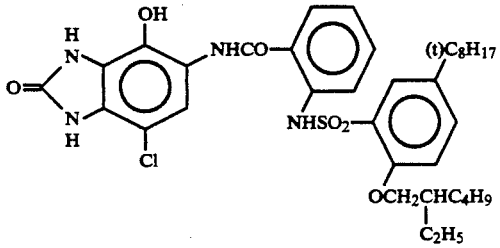
(I-18)
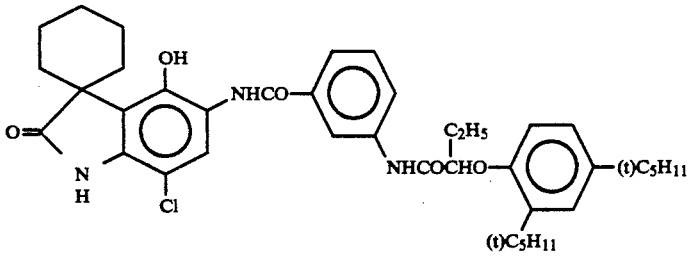
(I-19)
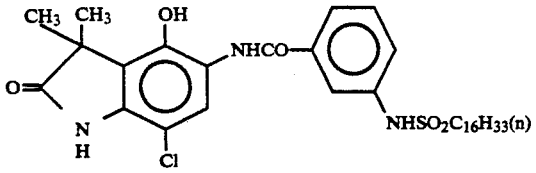
(I-20)
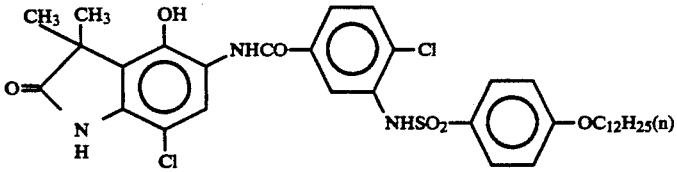
(I-21)
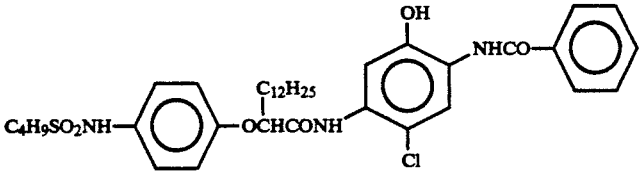

-continued
(I-22)
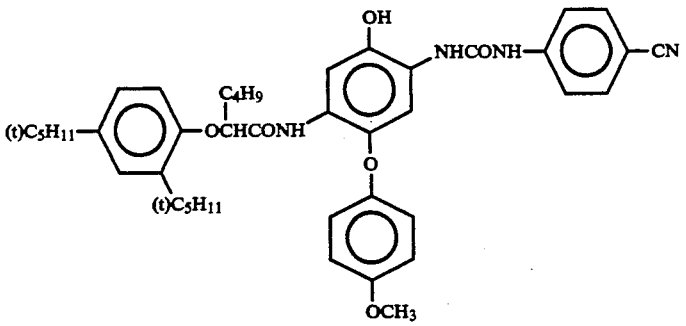
(I-26)
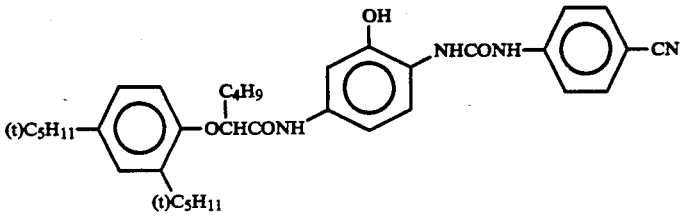
(II-1)
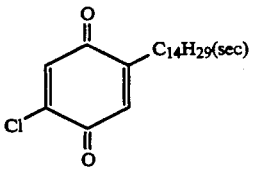
(II-2)
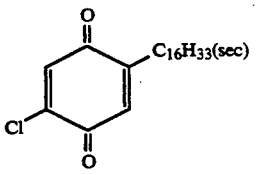
(II-3)
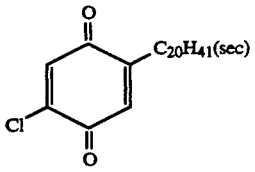
(II-4)
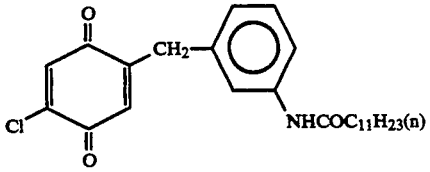
(II-5)
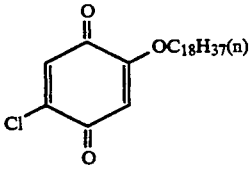
(II-6)
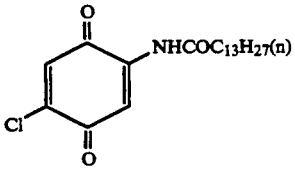
(II-7)
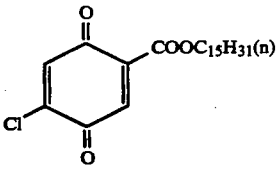
(II-8)
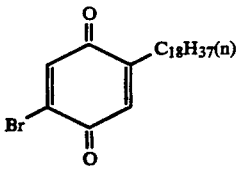
(II-9)
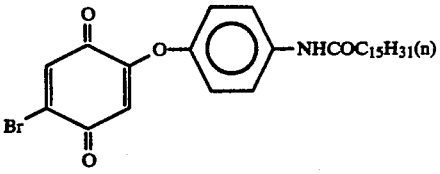
(II-10)
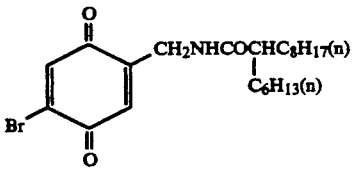
(III-1)
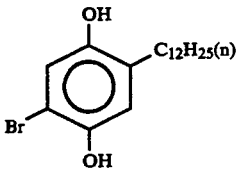
(III-2)
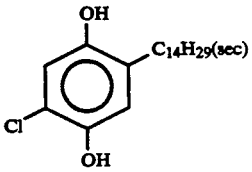

-continued
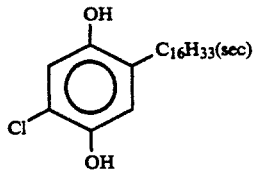
(III-3)
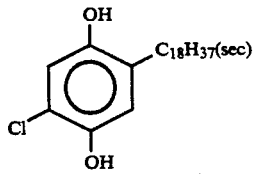
(III-4)
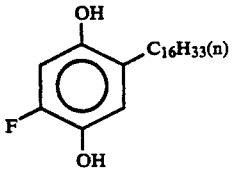
(III-5)
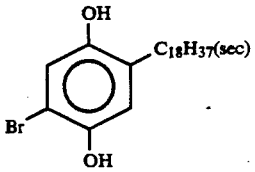
(III-6)
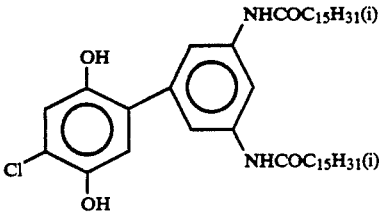
(III-7)
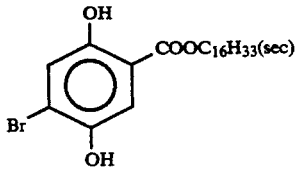
(III-8)
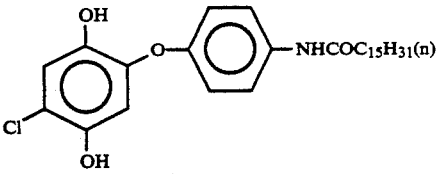
(III-9)
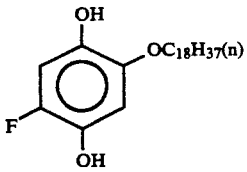
(III-10)
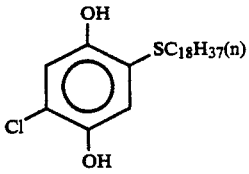
(III-11)
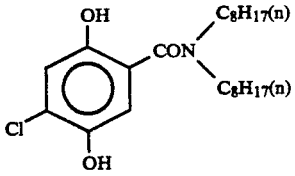
(III-12)
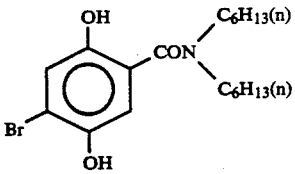
(III-13)
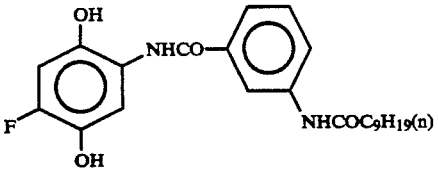
(III-14)
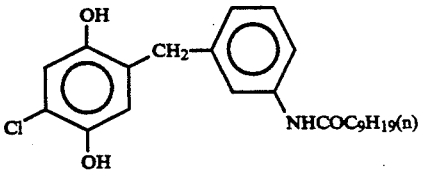
(III-15)
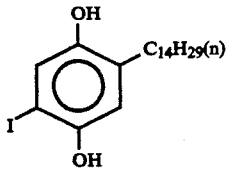
(III-16)
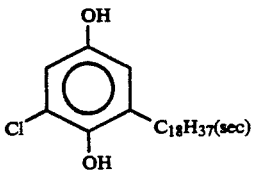
(III-17)
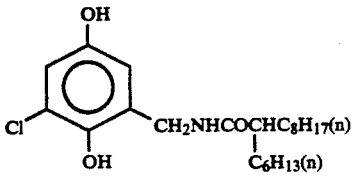
(III-18)

-continued
(III-19)

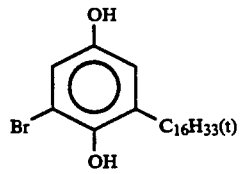

Synthesis methods for making the cyan couplers represented by formula (I) are known, for example, from U.S. Pat. Nos. 2,369,929, 4,518,687, 4,511,647 and 3,772,020 with respect to phenolic cyan couplers having an alkyl group at the 5-position thereof; from U.S. Pat. Nos. 2,772,162, 2,895,826, 4,334,011 and 4,500,653 and JP-A-59-164555 with respect to 2,5-diacylaminophenolic couplers; and U.S. Pat. Nos. 4,327,173, 4,564,586 and 4,430,423, JP-A-61-390441 and JP-A-62-257158 with respect to those phenolic cyan couplers where a nitrogen-containing hetero ring is condensed to the phenol nucleus.

A coating amount of the cyan coupler according to the present invention is preferably from $1.0\times10^{-5}$ to $2.0\times10^{-3}$ mol, more preferably from $1.0\times10^{-4}$ to $1.0\times10^{-3}$, per square meter of the photographic material.

The cyan coupler according to the present invention can be employed in an appropriate mixture with one or more cyan couplers other than those of the present invention. In such a case, the cyan coupler according to the present invention is preferably employed at least 5 mol %, more preferably at least 30 mol %, of the total cyan couplers used.

The compounds represented by formulae (II) and (III) can be synthesized according to the methods described, for example, in JP-A-56-109344 and JP-A-57-22237, as well as the following synthesis examples.

SYNTHESIS EXAMPLE 1

Synthesis of Compound (III-3)

33.5 g (0.1 mol)of 2-sec-hexadecylhydroquinone was dissolved in 300 ml of methylene chloride and to a resulting solution was added dropwise 8.1 ml (0.1 mol) of sulfuryl chloride with stirring at room temperature over a period of 30 minutes. After stirring for 6 hours at room temperature, the reaction mixture was allowed to stand overnight and extracted with ethyl acetate. The extract was washed three times with a 5% aqueous solution of sodium chloride, dried over magnesium sulfate, and concentrated. The residue was purified by column chromatography (solvent: chloroform) to obtain 27 g of the desired 2-chloro-5-sec-hexadecylhydroquinone as the light from oily product. The structure thereof was confirmed by NMR and mass spectra.

| Elemental Analysis for $C_{22}H_{37}ClO_2$: | C | H |
|---|---|---|
| Calculated (%) | 71.61 | 10.11 |
| Found (%) | 71.38 | 10.35 |

SYNTHESIS EXAMPLE 2

Synthesis of Compound (II-2)

18.5 g (0.05 mol) of 2-chloro-5-sec-hexadecylhydroquinone obtained in Synthesis Example 1 above was dissolved in 200 ml of ethyl acetate, to the resulting solution was added 22 g of powder of manganese dioxide, and the mixture was stirred at 50° C. for 8 hours. After allowing to cool, the manganese dioxide was removed by filtration, and the filtrate was concentrated. The residue was purified by column chromatography (solvent: chloroform) to obtain 15 g of the desired 2-chloro-5-sec-hyxadecyl-1,4-benzoquinone as the yellow oily product. The structure thereof was confirmed by NMR and mass spectra.

| Elemental Analysis for $C_{22}H_{35}ClO_2$: | C | H |
|---|---|---|
| Calculated (%) | 72.01 | 9.11 |
| Found (%) | 71.87 | 9.35 |

The quinones represented by formula (II) and the hydroquinones represented by formula (III) according to the present invention can be employed individually or in combination. Further, they may be employed together with quinones and/or hydroquinones other than those of the present invention, particularly those described in JP-A-63-316857.

The quinone represented by formula (II) and/or the hydroquinone represented by formula (III) according to the present invention are used in an amount of from 0.1 to 100 mol %, preferably from 0.5 to 30 mol %, and more preferably from 1 to 20 mol %, per mol of the cyan coupler represented by formula (I) according to the present invention. In the case where the compound of formula (II) is used together with the compound of formula (III), the ratio of these two compounds to be employed may freely be selected, with the preferred molar ratio of the compound of formula (II) to the compound of formula (III) being 1:100 to 10:1.

The compound of formula (II) or (III) can be added to a coating solution for a photographic constituting layer containing the cyan coupler according to the present invention directly or by first dissolving it in a solvent which does not adversely affect the photographic light-sensitive material, for example, water or an alcohol. The compound can also be added by dissolving it in a high boiling organic solvent and/or a low boiling organic solvent and then emulsifying or dispersing the solution in an aqueous medium. Further, the compound can be employed by emulsifying or dispersing it together with the cyan coupler.

The hydroquinone and/or quinone according to the present invention are preferably present in oil droplets containing the cyan coupler.

The use of the specific hydroquinone and/or quinone according to the present invention is particularly effective when a bleaching solution or a bleach-fixing solution is adulterated with a developing agent (i.e., a developing agent which has been brought from a pre-bath).

As to compound represented by formula (IV), $R_7$, $R_8$, $R_9$ and $R_{10}$ each represents a hydrogen atom, an aliphatic group, an aromatic group, an aliphatic oxycarbonyl group (e.g., dodecyloxycarbonyl, or allyloxycarbonyl), an aromatic oxycarbonyl group (e.g., phenoxycarbonyl) or a carbamoyl group (e.g., tetradecylcarbamoyl, a phenylmethylcarbamoyl), with the provisos that $R_3$, $R_4$, $R_5$ and $R_6$ do not simultaneously represent hydrogen atoms, and the total number of carbon atoms thereof is from 8 to 60.

The term "aliphatic group" used herein means an aliphatic hydrocarbon group which may be of straight chain, branched or cyclic, and includes both saturated and unsaturated groups such as an alkyl group, an alkenyl group and an alkynyl group. Typical examples thereof include a methyl group, an ethyl group, a butyl group, a dodecyl group, an octadecyl group, an icosenyl group, an isopropyl group, a tert-butyl group, a tert-octyl group, a tert-dodecyl group, a cyclohexyl group, a cyclopentyl group, an allyl group, a vinyl group, a 2-hexadecenyl group and a propargyl group.

The aromatic group preferably represents a substituted or unsubstituted phenyl or naphthyl group containing from 6 to 42 carbon atoms.

The aliphatic group and aromatic group may be further substituted with a group or groups selected from an alkyl group, an aryl group, a heterocyclic group, an alkoxy group (e.g., methoxy, or 2-methoxyethoxy), an aryloxy group (e.g., 2,4-di-tert-amylphenoxy, 2-chlorophenoxy, or 4-cyanopyhenoxy), an alkenyloxy group (e.g., 2-propenyloxy), an acyl group (e.g., acetyl, or benzoyl), an ester group (e.g., butoxycarbonyl, phenoxycarbonyl, acetoxy, benzoyloxy, butoxysulfonyl, or toluenesulfonyloxy), an amido group (e.g., acetylamino, ethylcarbamoyl, dimethylcarbamoyl, methanesulfonamido, or butylsulfamoyl), a sulfamido group (e.g., dipropylsulfamoylamino), an imido group (e.g., succinimido, or hydantoinyl), a ureido group (e.g., phenylureido, or dimethylureido), an aliphatic or aromatic sulfonyl group (e.g., methanesulfonyl, or phenylsulfonyl), an aliphatic or aromatic thio group (e.g., ethylthio, or phenylthio), a hydroxyl group, a cyano group, a carboxyl group, a nitro group, a sulfo group and a halogen atom.

Specific examples of the compounds represented by formula (IV), which can be used in the present invention, are set forth below, but the present invention is not to be limited thereto.

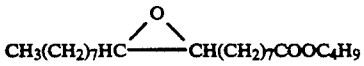
(IV-1)

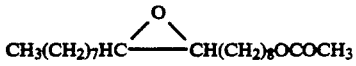
(IV-2)

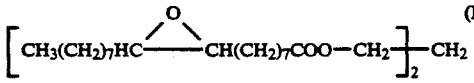
(IV-3)

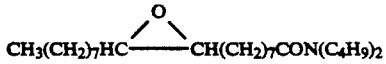
(IV-4)

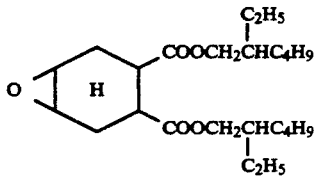
(IV-5)

-continued

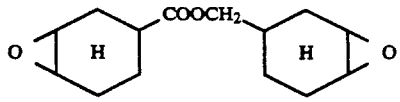
(IV-6)

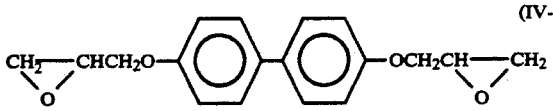
(IV-7)

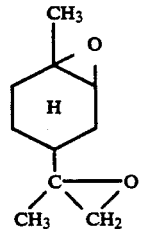
(IV-8)

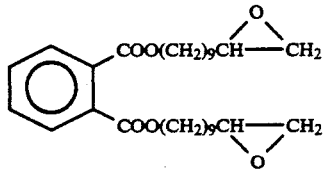
(IV-9)

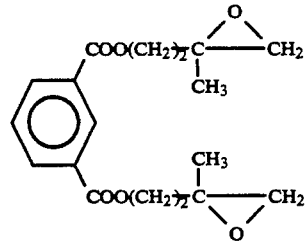
(IV-10)

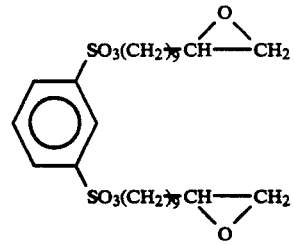
(IV-11)

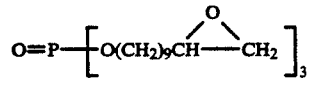
(IV-12)

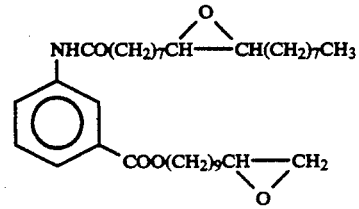
(IV-13)

-continued (IV-14)

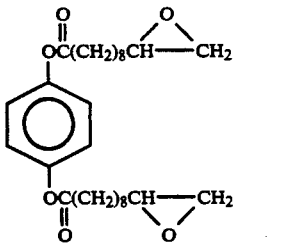

(IV-15)

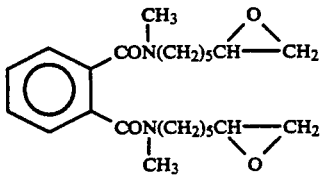

(IV-16)

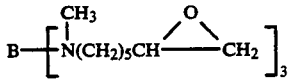

(IV-17)

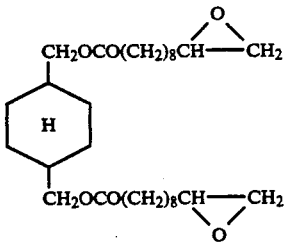

(IV-18)

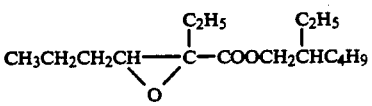

(IV-19)

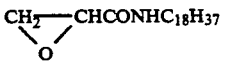

(IV-20)

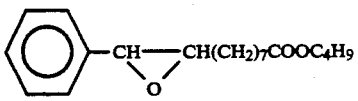

With respect to the synthesis of the compound represented by formula (IV), Compound (IV-9), for example, can be synthesized according to the method described in Example 1 in column 11 of U.S. Pat. No. 4,540,657, and other compounds can be synthesized with reference to this method.

The compound represented by formula (IV) according to the present invention is preferably present in oil droplets containing the cyan coupler represented by formula (I). The compound can be dissolved in an auxiliary solvent such as ethyl acetate together with the cyan coupler, and if desired, a water-insoluble organic polymer compound described hereinafter, and then emulsifying or dispersing in an aqueous medium to prepare an emulsified dispersion of the compound, or these components can be separately added to an aqueous medium and mixed therein.

An amount of the compound represented by formula (IV) is from 0.1 to 100% by weight, preferably from 1 to 50% by weight, and more preferably from 2 to 20% by weight, of the cyan coupler represented by formula (I).

Further, the compounds represented by formula (IV) can be employed individually or in combinations thereof.

The high boiling organic solvent having a viscosity of not less than 200 cp (at 25° C.) is preferably selected from compounds represented by the following formulae (IIs), (IIIs), (IVs), (Vs), (VIs) or (VIIs):

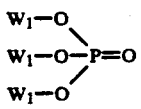

(IIs)

$W_1—COOW_2$ (IIIs)

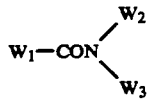

(IVs)

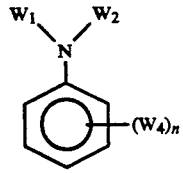

(Vs)

$W_1—O—W_2$ (VIs)

$W_5—X$ (VIIs)

wherein $W_1$, $W_2$ and $W_3$ each represents a substituted or unsubstituted alkyl, cycloalkyl, alkenyl, aryl or heterocyclic group; $W_4$ represents $—W_1$, $—O—W_1$ or $—S—W_1$; n represents an integer of from 1 to 5, when n represents 2 or more, two or more $W_4$'s may be the same or different; $W_1$ and $W_2$ in formula (VIs) may be connected to form a condensed ring; $W_5$ represents a substituted or unsubstituted alkyl, cycloalkyl or aryl group and the total carbon atoms included in $W_5$ is not less than 12; and X represents a halogen atom.

When the group represented by $W_1$, $W_2$, $W_3$ or $W_5$ has a substituent, the substituent may be a group having one or more bonding groups selected from

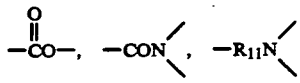

wherein $R_{11}$ represents a 2- to 6-valent group obtained by eliminating hydrogen atom(s) from a phenyl group, and —O—.

The alkyl group represented by $W_1$, $W_2$, $W_3$, $W_4$ or $W_5$ may be a straight chain or branched chain alkyl group (e.g., methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, or icosyl).

Suitable examples of substituents for the alkyl group include a halogen atom, a cycloalkyl group, an aryl group and an ester group. More specifically, suitable examples of the substituted alkyl group include an alkyl group substituted with a halogen atom (e.g., F, Cl, Or Br) (e.g., $—C_2HF_4$, $—C_5H_3F_8$, $—C_9H_3F_{16}$, $—C_2H_4Cl$, $—C_3H_6Cl$, $—C_3H_5CL_2$, $—C_3H_5ClBr$, or $—C_3H_5Br_2$); an alkyl group substituted with a cycloalkyl group (e.g.,

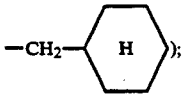

an alkyl group substituted with an aryl group (e.g.,

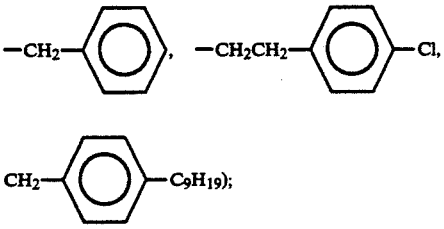

an alkyl group substituted with a substituent for forming a dibasic acid ester (e.g.,

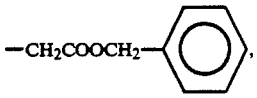

$—CH_2CH_2COOC_{12}H_{25}$, $—(CH_2)_4COOC_{10}H_{21}$, $—(CH_2)_4COOCH_2(CF_2CF_2)_2H$, $—(CH_2)_7COOC_4H_9$, or $—(CH_2)_8COO—C_{12}H_{25}$); an alkyl group substituted with a substituent for forming a lactic acid ester, etc. (e.g.,;

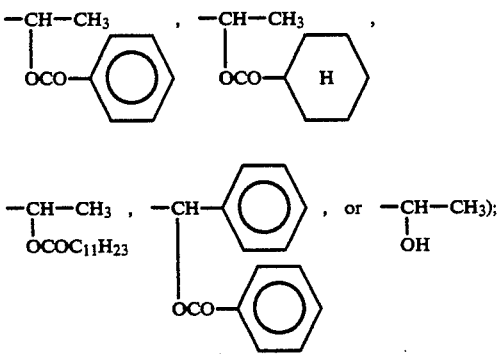

an alkyl group substituted with a substituent for forming a citric acid ester, etc. (e.g.,

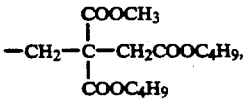

or

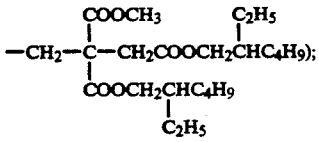

an alkyl group substituted with a malic acid ester, etc. (e.g., $—CH_2CH(OH)COOC_6H_{13}$, or $—CH_2CH(OH)-COOC_{12}H_{25}$); an alkyl group substituted with a tartaric acid ester, etc. (e.g., $—CH(OH)CH(OH)COOC_8H_{17}$, $—CH(OH)CH(OH)COOC_{18}H_{37}$,

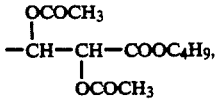

or

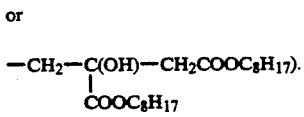

In formula (VIs), $W_1$ and $W_2$ may form an oxirane, oxolane or oxane ring which may form a condensed ring.

Specific examples of the cycloalkyl group represented by $W_1$, $W_2$, $W_3$, $W_4$ or $W_5$ include

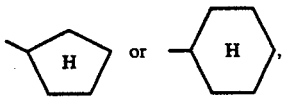

and those of the substituted cycloaklyl group include

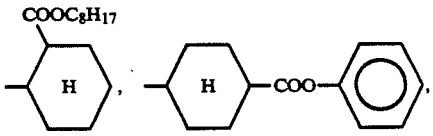

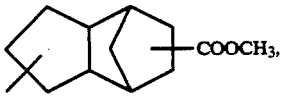

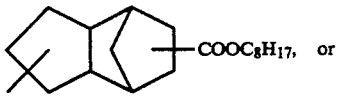

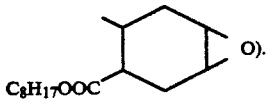

Specific examples of the aryl group represented by $W_1$, $W_2$, $W_3$, $W_4$ or $W_5$ include

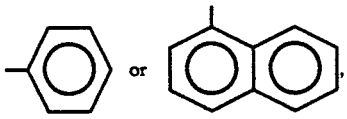

and those of the substituted aryl group include

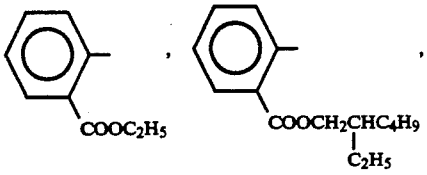

-continued

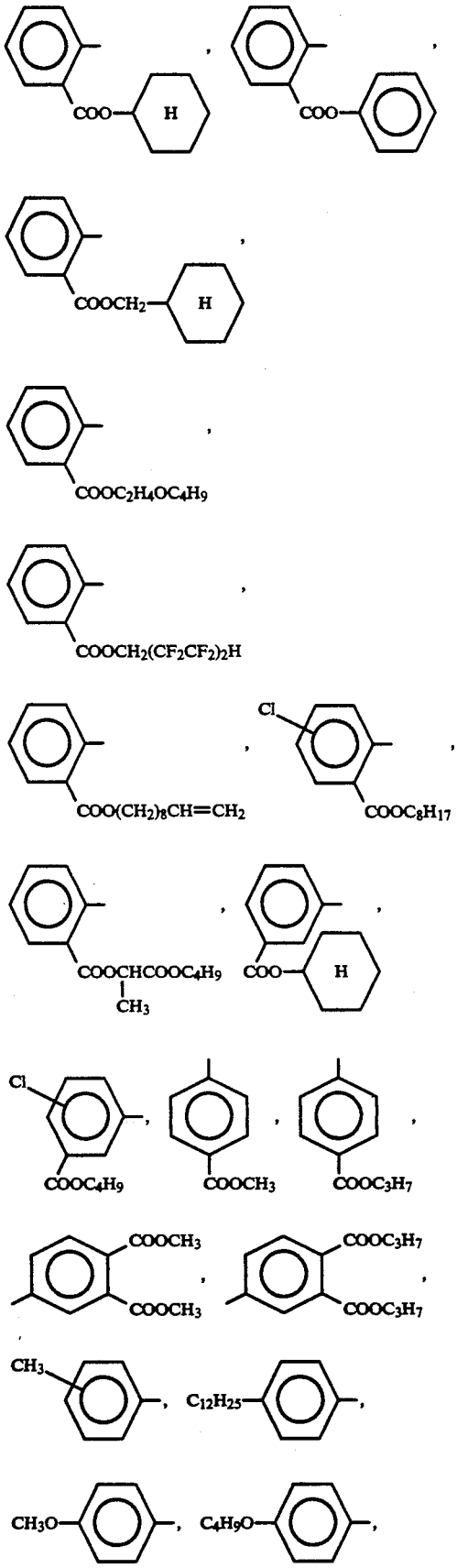

-continued

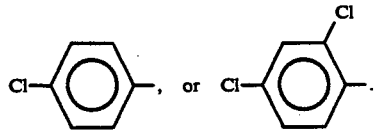

Specific examples of the alkenyl group represented by $W_1$, $W_2$, $W_3$, or $W_4$ include $—C_4H_7$, $—C_5H_9$, $—C_6H_{11}$, $—C_7H_{13}$, $—C_8H_{15}$, $—C_{10}H_{19}$, $—C_{12}H_{23}$, or $—C_{18}H_{35}$. Suitable examples of substituents for the substituted alkenyl group include a halogen atom (e.g., F, Cl, or Br), $—OC_8H_{17}$, $—OC_{12}H_{25}$,

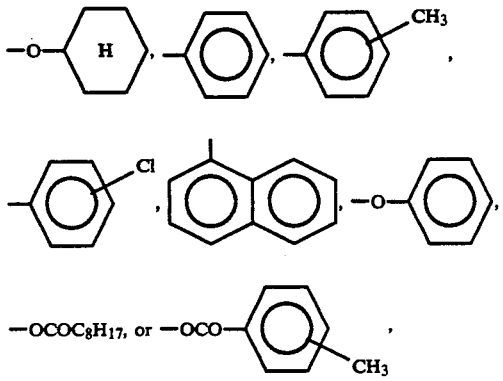

and specific examples of the substituted alkenyl group include

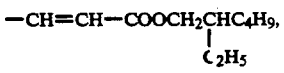

$—CH=CH—COOC_{12}H_{25}$, or

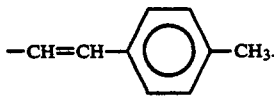

Specific examples of the heterocyclic group represented by $W_1$, $W_2$, $W_3$, or $W_4$ include

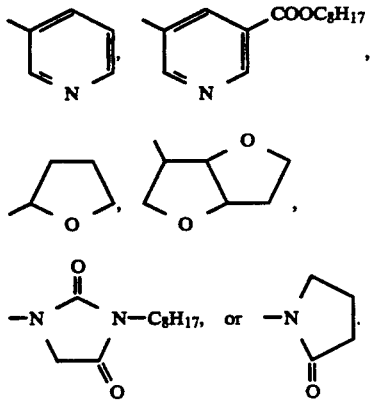

A boiling point of the high boiling organic solvent used in the present invention is preferably not less than 140° C., more preferably not less than 160° C.

In the compounds represented by formulae (IIs) to (VIIs), the total number of the carbon atoms includes in $W_1$ to $W_5$ is preferably not less than 8.

The term "organic solvent" ordinarily indicates a liquid compound. However, in the present invention, the organic solvent having a viscosity of not less than 200 cp measured at 25° C. can include a solid compound.

The high boiling solvent according to the present invention is preferably one having a viscosity of not less than 500 cp (at 25° C.), more preferably one having a viscosity of not less than 700 cp (at 25° C.). Furthermore it is preferably a solid one having a melting point of not less than 25° C. and is selected from the compounds represented by formulae (IIs) to (VIIs) described above. Among them, those represented by formulae (IIs) and (IIIs) are preferred, particularly dialkyl (secondary or tertiary alkyl) or dicycloalkyl esters of phosphoric acid or phthalic acid are preferred. Dicycloalkyl esters of phthalic acid are most preferred.

The viscosity of the solvent can be determined using a corn plate type rotary viscometer (VISCONISEMD manufactured by Tokyo Keiki).

An amount of the high boiling organic solvent to be used can vary greatly depending on the kind and amount of the cyan coupler used, but it is preferably employed in a range of from 0.05 to 20 by weight per weight of the cyan coupler represented by formula (1) according to the present invention.

The high boiling organic solvents according to the present invention can be employed individually or in combinations thereof, or together with other hitherto known high boiling organic solvents, as long as the objects of the present invention are achieved. Suitable examples of such known high boiling organic solvents include phosphoric acid ester type solvents, for example, tricresyl phosphate, tri-2-ethylhexyl phosphate, 7-methyloctyl phosphate, or tricyclohexyl phosphate, and phenolic type solvents, for example, 2,5-di-tert-amylphenol, or 2,5-di-sec-amylphenol.

Specific examples of the high boiling organic solvents having a high viscosity according to the present invention are illustrated below, but the present invention should not be limited thereto.

| Compound | Structure | Remark |
|---|---|---|
| S-1 | 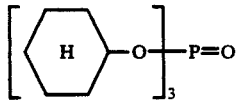 | solid (m.p. 60° C.) |
| S-2 | $(ClCH_2\underset{\underset{Cl}{\vert}}{C}HCH_2O)_3P{=}O$ | solid (m.p. 28.8° C.) |
| S-3 | 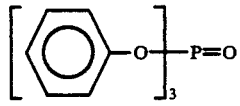 | solid (m.p. 48.5° C.) |
| S-4 | $(CH_3OCO{-}C_6H_4{-}O)_3P{=}O$ | solid (m.p. 101~103° C.) |
| S-5 | 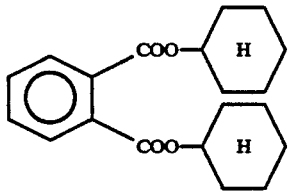 | solid (m.p. 58~65° C.) |
| S-6 | 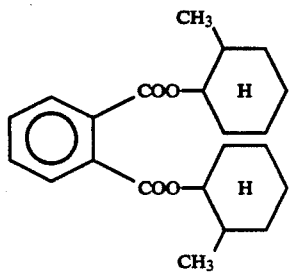 | solid |

-continued
| Compound | Structure | Remark |
|---|---|---|
| S-7 | 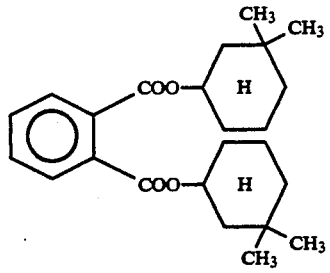 | solid |
| S-8 | 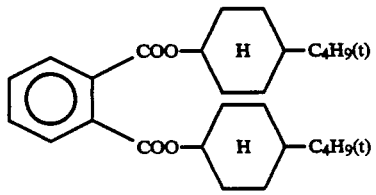 | solid |
| S-9 | 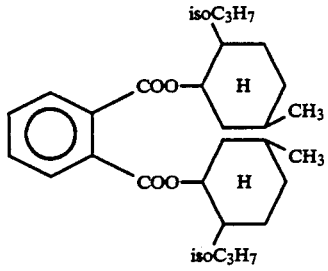 | solid (m.p. 129~130° C.) |
| S-10 | 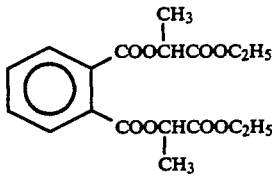 | solid (m.p. 50~53° C.) |
| S-11 | 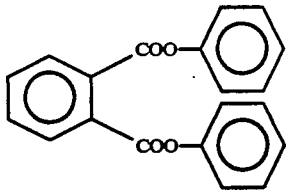 | solid (m.p. 69° C.) |
| S-12 | 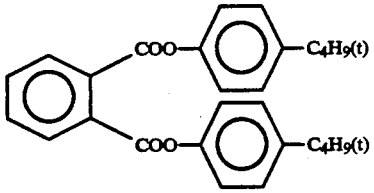 | solid (m.p. 142° C.) |
| S-13 | 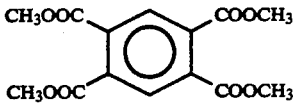 | solid (m.p. 144° C.) |

-continued
| Compound | Structure | Remark |
|---|---|---|
| S-14 | 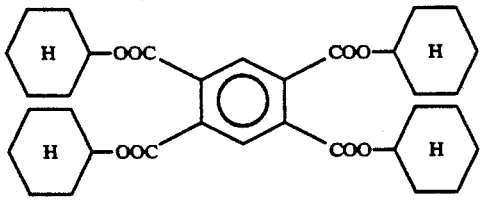 | solid (m.p. 148° C.) |
| S-15 | 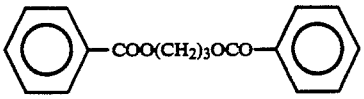 | solid (m.p. 47° C.) |
| S-16 | 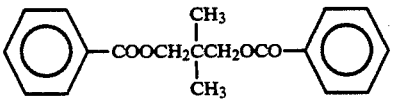 | solid (m.p. 49° C.) |
| S-17 | 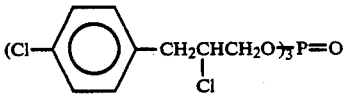 | solid |
| S-18 | 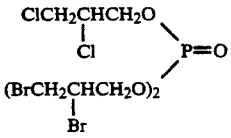 | 4260 cp |
| S-19 | 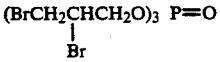 | 6810 cp |
| S-20 | 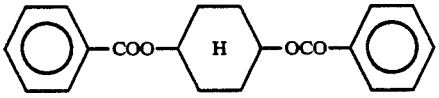 | solid (m.p. 113° C.) |
| S-21 | 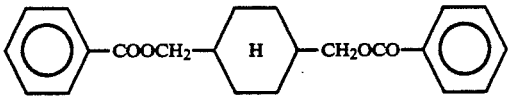 | solid (m.p. 124° C.) |
| S-22 | 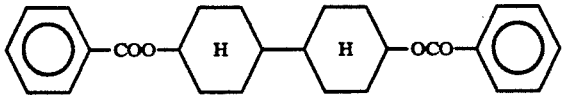 | solid (m.p. 194° C.) |
| S-23 | 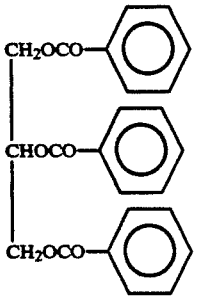 | solid (m.p. 71° C.) |

-continued
| Compound | Structure | Remark |
|---|---|---|
| S-24 | 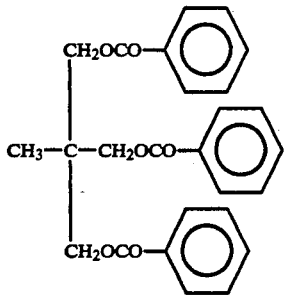 | solid (m.p. 81° C.) |
| S-25 | 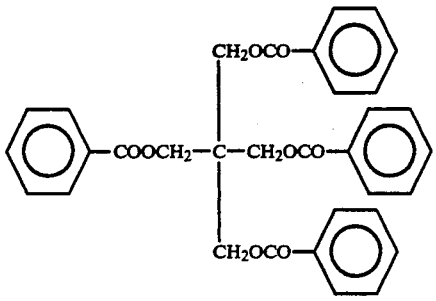 | solid (m.p. 99° C.) |
| S-26 | 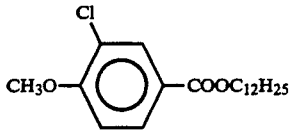 | solid (m.p. 43° C.) |
| S-27 | $C_{15}H_{31}COOC_{18}H_{37}$ | solid (m.p. 58° C.) |
| S-28 | n-$C_{17}H_{35}COOCH_3$ | solid (m.p. 38° C.) |
| S-29 | $C_{17}H_{35}COOC_{16}H_{33}$ | solid (m.p. 58° C.) |
| S-30 | $CH_2OCOC_{11}H_{23-n}$<br>\|<br>$CHOCOC_{11}H_{23-n}$<br>\|<br>$CH_2OCOC_{11}H_{23-n}$ | solid (m.p. 47° C.) |
| S-31 | 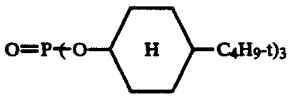 | solid |
| S-32 | $O{=}P(OC_{14}H_{29})_3$ | solid |
| S-33 | $O{=}P(OC_{16}H_{33})_3$ | solid |
| S-34 | 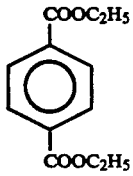 | solid |

-continued
| Compound | Structure | Remark |
|---|---|---|
| S-35 | 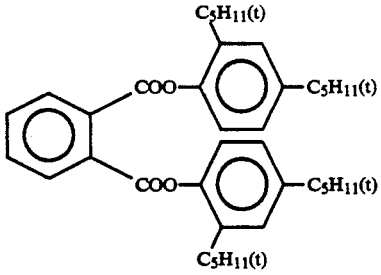 | solid |
| S-36 | 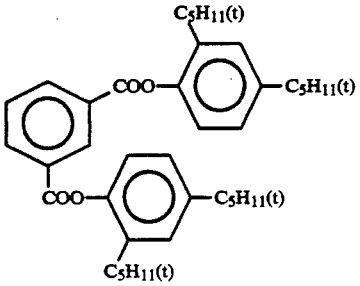 | solid |
| S-37 | 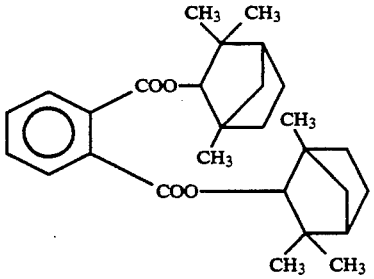 | solid |
| S-38 | 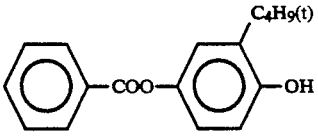 | solid |
| S-39 | 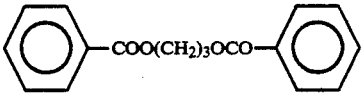 | solid |
| S-40 | 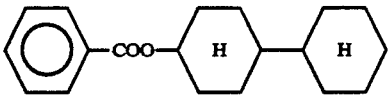 | solid |
| S-41 | 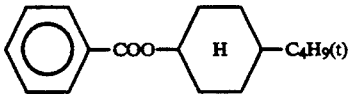 | solid |
| S-42 | 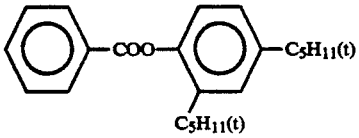 | solid |
| S-43 | 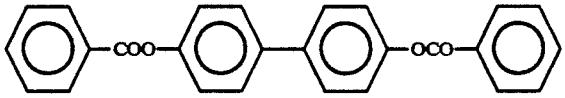 | solid |

-continued
| Compound | Structure | Remark |
|---|---|---|
| S-44 | 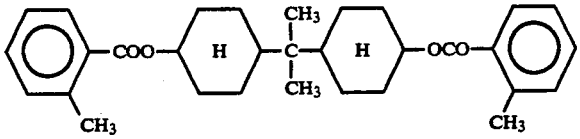 | solid |
| S-45 | 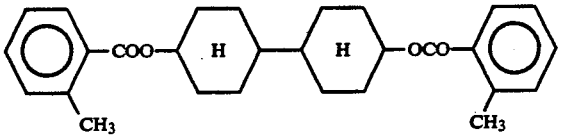 | solid |
| S-46 | 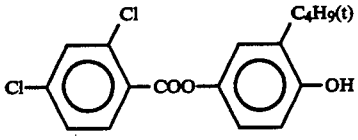 | solid |
| S-47 | 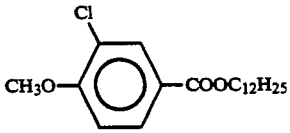 | solid |
| S-48 | $C_{15}H_{31}COOC_{16}H_{33}$ | solid |
| S-49 | $CH_2OCOC_{17}H_{35}$<br>\|<br>$CHOCOC_{17}H_{35}$<br>\|<br>$CH_2OCOC_{17}H_{35}$ | solid |
| S-50 | $C_8H_{17}CH{=}CH(CH_2)_7CONH_2$ | solid |
| S-51 | 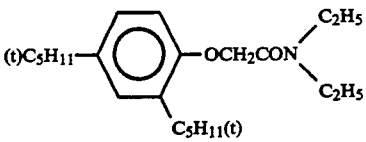 | solid |
| S-52 | 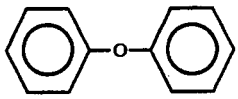 | solid |
| S-53 | 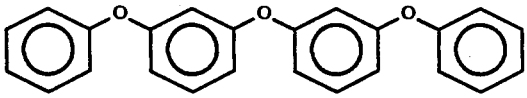 | solid |
| S-54 | 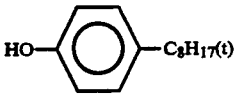 | solid |
| S-55 | 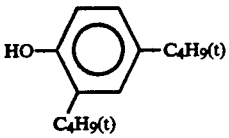 | solid |
| S-56 | $C_{24}H_{29}Cl_{21}$ (chlorinated paraffin) | solid |

-continued

| Compound | Structure | Remark |
|---|---|---|
| S-57 | 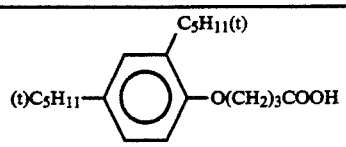 | solid |
| S-58 | 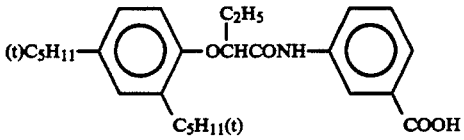 | solid |
| S-59 | 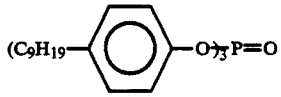 | 15,600 cp |
| S-60 | 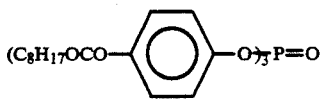 | 20,800 cp |
| S-61 | 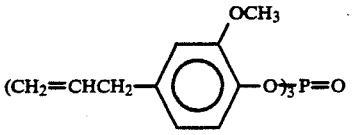 | 21,600 cp |
| S-62 | 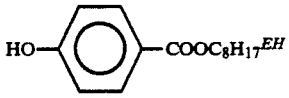 | 14,300 cp |
| S-63 | 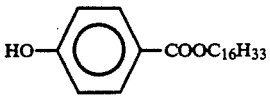 | solid |

Note: $C_8H_{17}^{EH}$ indicates 2-ethylhexyl group.

Of the compounds represents by formula (IIIs), preferred are those high boiling organic solvents represented by formula (IIIs-1) or (IIIs-2) described below.

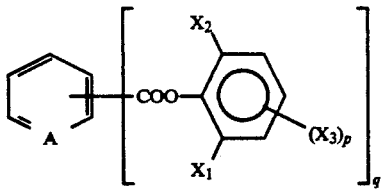

(IIIs-1)

wherein A represents =CH— or =N—; $X_1$, $X_2$ and $X_3$ each represents —H, halogen, —$R_{12}$, —CH=NO$R_{12}$, —CO$R_{12}$, —$SO_2R_{12}$, —$Y_1$=$R_{12}$, —$Y_1$—CO$R_{12}$, —CO—$Y_1$—$R_{12}$, —$Y_1$—$SO_2R_{12}$or —$SO_2$—$Y_1$—$R_{12}$, or two of $X_1$, $X_2$ and $X_3$ combine with each other and represents an atomic group necessary to form a carbon ring or hetero ring; $Y_1$ represents —O—, —S— or $$-\underset{\underset{R_{13}}{|}}{N}-;$$

$R_{13}$ represents —H or —$R_{12}$; $R_{12}$ represents a substituted or unsubstituted alkyl group containing from 1 to 12 carbon atoms (e.g., methyl, ethyl, isopropyl, sec-butyl, tert-butyl, tert-pentyl, 2-ethylhexyl, or octadecyl), a substituted or unsubstituted aryl group containing from 6 to 20 carbon atoms (e.g., phenyl, m-tolyl, p-tolyl, p-hydroxyphenyl, or α-naphthyl), or a substituted or unsubstituted heterocyclic group containing from 2 to 20 carbon atoms (e.g., pyrazolyl, benzoxazolyl, benzothiazolyl, benzotriazole, or phenyltetrazolyl); q represents 2, 3 or 4; and p represents 1, 2 or 3, provided that at least one of $X_1$ and $X_2$ substituted on the same benzene ring must contain at least two non-hydrogen atoms.

Of the compounds represented by formula (IIIs-1), those wherein q is 2 or 4, p is 1, A is =CH—, $X_1$ is an alkyl group containing from 1 to 6 carbon atoms, a heterocyclic group or —CO$R_{14}$ (wherein $R_{14}$ represents a phenyl group or —O$R_{15}$; $R_{15}$ represents an alkyl group containing from 1 to 6 carbon atoms; $X_2$ is —H, or an alkyl group containing from 1 to 6 carbon atoms; and $X_3$ is —H, a methoxy group or an alkyl group containing from 2 to 6 carbon atoms are more preferred in the present invention.

Further, those wherein $X_1$ and $X_2$ are sterically bulkyl groups are particularly preferred.

Specific examples of the compounds represented by formula (IIIs-1) used in the present invention are set forth below, but the present invention should not be limited thereto.
| Compound | R |
|---|---|
| | 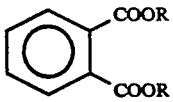 (IIIs-1-a) |
| S-64 | 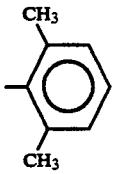 |
| S-65 | 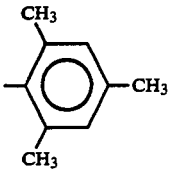 |
| S-66 | 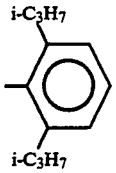 |
| S-67 | 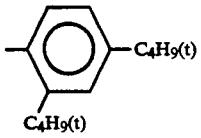 |
| S-68 | 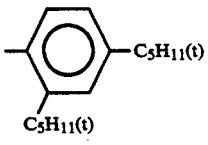 |
| S-69 | 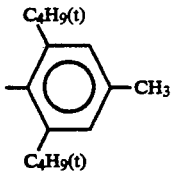 |
| S-70 | 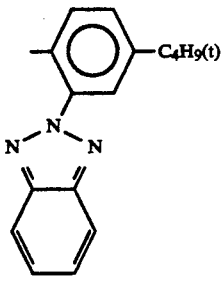 |
-continued
| Compound | R |
|---|---|
| S-71 | 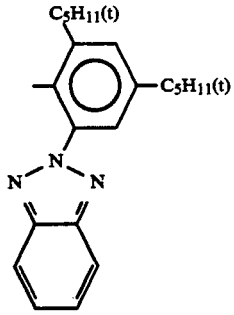 |
| S-72 | 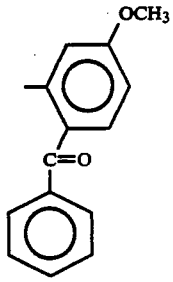 |
| S-73 | 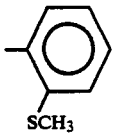 |
| S-74 | 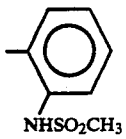 |
| | 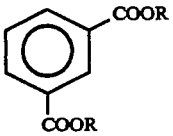 (IIIs-1-b) |
| S-75 | 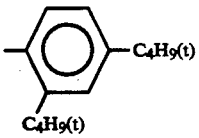 |
| S-76 | 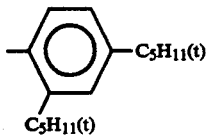 |
| S-77 | 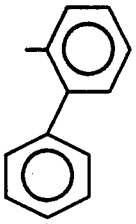 |

-continued
| Compound | R |
|---|---|
| S-78 | 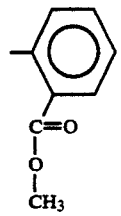 |
| S-79 | 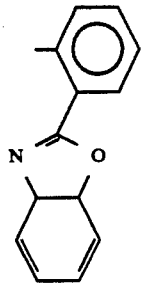 |
| S-80 | 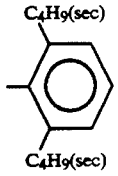 |
| | 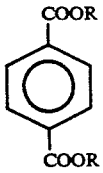 (IIIs-1-c) |
| S-81 | 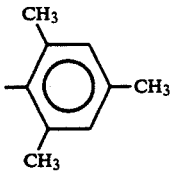 |
| S-82 | 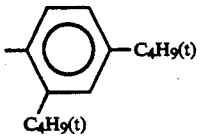 |
| | 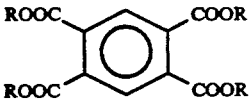 (IIIs-1-d) |
| S-83 | 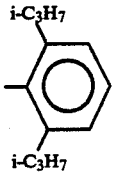 |
-continued
| Compound | R |
|---|---|
| | 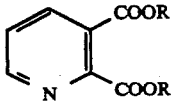 (IIIs-1-e) |
| S-84 | 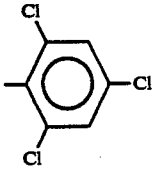 |
| S-85 | 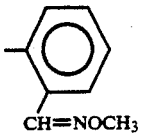 |
| | 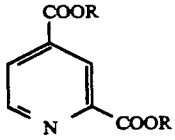 (IIIs-1-f) |
| S-86 | 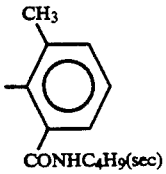 |
| S-87 | 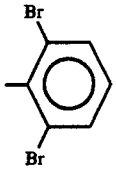 |
| | 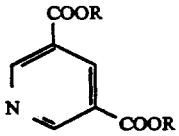 (IIIs-1-g) |
| S-88 | 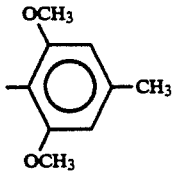 |
| | 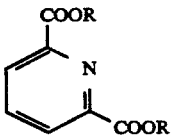 (IIIs-1-h) |

-continued

| Compound | R |
|---|---|
| S-89 | 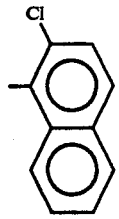 |
| S-90 | 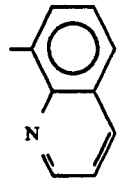 |
| S-91 | 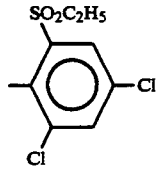 |
| | 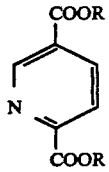 (IIIs-1-i) |
| S-92 | 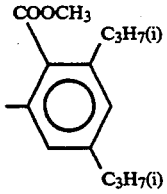 |
| S-93 | 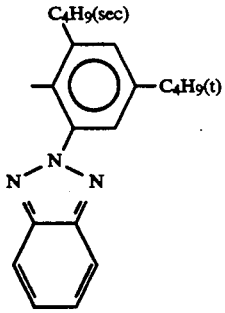 |
| S-94 | 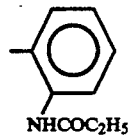 |

The compounds represented by formula (IIIs-1) are commercially available or can be synthesized by known methods such as those described in JP-A-62-134642.

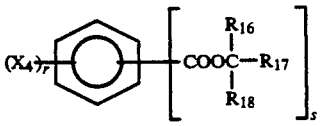

(IIIs-2)

wherein $X_4$ represents a halogen atom (e.g., fluorine, chlorine, bromine, or iodine), an alkyl group containing from 1 to 20 carbon atoms, an alkoxy group containing from 1 to 20 carbon atoms or an alkoxycarbonyl group containing from 2 to 21 carbon atoms; r represents an integer of from 0 to 5; $R_{16}$, $R_{17}$ and $R_{18}$ each represents a straight chain or branched chain alkyl group containing from 1 to 12 carbon atoms, a cycloalkyl group containing from 3 to 12 carbon atoms, an aralkyl group containing from 7 to 20 carbon atoms, an aryl group containing from 6 to 20 carbon atoms or a heterocyclic group containing from 3 to 12 carbon atoms, $R_{16}$ further represents a hydrogen atom, or $R_{17}$ and $R_{18}$ may combine to form a ring; and s represents an integer of from 1 to 4, when r represents 2 or more, two or more $X_4$'s may be the same or different, when s represents 2 or more, two or more

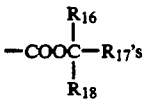

may be the same or different, provides that the sum of r and s is not more than 6.

As to formula (IIIs-2), specific examples for $X_4$ include, in addition to the above-described halogen atom, an alkyl group (e.g., methyl, ethyl, isopropyl, tert-butyl, cyclopentyl, cyclohexyl, 2-ethylhexyl, dodecyl, benzyl, or trifluoromethyl), an alkoxy group (e.g., methoxy, ethoxy, 2-ethylhexyloxy, benzyloxy, dodecyloxy, or methoxyethoxy), and an alkoxycarbonyl group (e.g., methoxycarbonyl, ethoxycarbonyl, butoxycarbonyl, or hexadecyloxycarbonyl).

In formula (IIIs-2), specific examples for $R_{16}$, $R_{17}$ and $R_{18}$ include a straight chain or branched chain alkyl group (e.g., methyl, ethyl, trifluoromethyl, isopropyl, n-propyl, n-butyl, sec-butyl, isobutyl, isopentyl, sec-pentyl, isohexyl, or sec-decyl), a cycloalkyl group (e.g., cyclopropyl, cyclobutyl, cyclopentyl, cyclohexyl, 4-methylcyclohexyl, 4-methylcyclohexenyl, 4-tert-butylcyclohexyl, cycloheptyl, menthyl, bornyl, or bicyclo[2,2,1]heptan-2-yl), an aralkyl group (e.g., benzyl, 4-methoxybenzyl, 1-naphthylmethyl, or phenethyl), an aryl group (e.g., phenyl, 4-methoxyphenyl, 2,4-dichlorophenyl, p-tolyl, or 1-naphthyl) or a heterocyclic group (e.g., furyl, thienyl, pyridyl, N-methylimidazolyl, N-methylpyrrolyl, tetrahydrofurfuryl, N-ethylindolyl, or quinolyl).

In formula (IIIs-2), specific examples of

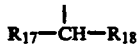

wherein $R_{17}$ and $R_{18}$ combine with each other to form a ring include cyclopentyl, cyclohexyl, menthyl, phenkyl, bornyl, or bicyclo[2,2,1]-heptan-2-yl).

Of the compounds represented by formula (IIIs-2), compounds preferably employed in the present invention are those which meet the following conditions (1) or (2):

(1) the sum of α-hydrogen atoms in $R_{16}$, $R_{17}$ and $R_{18}$ does not exceed 7, or (2) where $R_{16}$ is a hydrogen atom, either (a) when $R_{17}$ and $R_{18}$ combine with each other to form a ring, the sum of α-hydrogen atoms in $R_{17}$ and $R_{18}$ does not exceed 1, or (b) when $R_{17}$ and $R_{18}$ do not form together a ring, the α-position of either $R_{17}$ and $R_{18}$ is substituted with two different substituents.

Of the compounds represented by formula (IIIs-2), those where r is 0 and s is 2 are more preferred.

Particularly preferred compounds are represented by formula (IIIs-3) or (IIIs-4):

(IIIs-3)

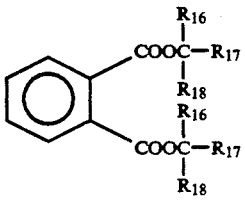

(IIIs-4)

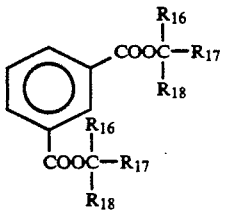

wherein $R_{16}$, $R_{17}$ and $R_{18}$ each has the same meaning as defined in formula (IIIs-2) above.

Of the groups of

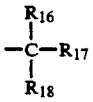

in formula (IIIs-2), particularly preferred are those which meet the following conditions (3) or (4):

(3) $R_{16}$, $R_{17}$ and $R_{18}$ each represents an alkyl group (including a cycloalkyl group and an aralkyl group), and all of $R_{16}$, $R_{17}$ and $R_{18}$ are not methyl groups simultaneously, or (4) $R_{16}$ is a hydrogen atom or an alkyl group, and $R_{17}$ and $R_{18}$ combine with each other to form a substituted or unsubstituted cyclohexane or cyclohexene ring.

Specific examples of

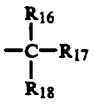

in formula (IIIs-2) are set forth below.

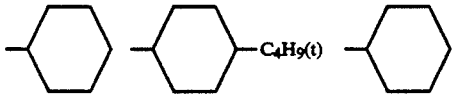

-continued

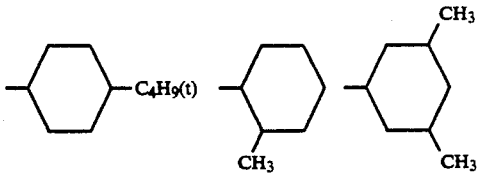

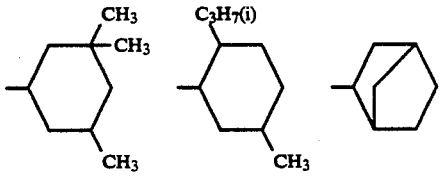

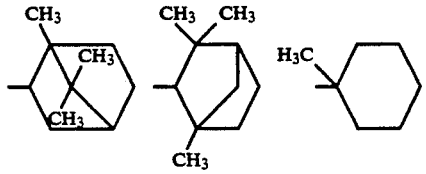

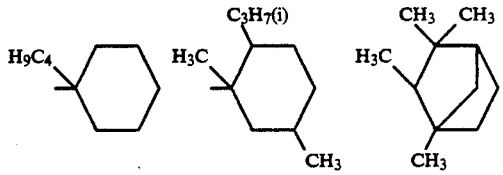

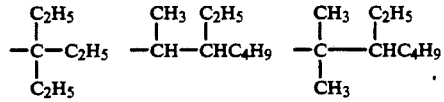

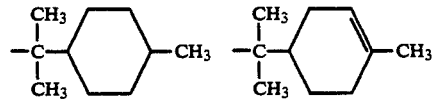

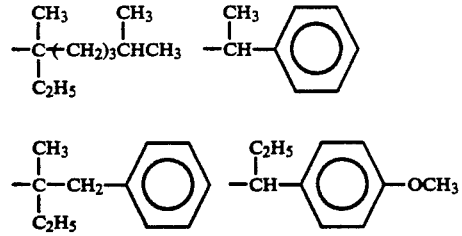

Specific examples of compounds represented by formula (IIIs-2) are illustrated below, but the present invention should not be limited thereto.

| Compound | R |
|---|---|
| (IIIs-2-a) 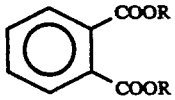 | |
| S-95 | 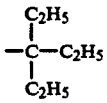 |

-continued
| Compound | R |
|---|---|
| S-96 | 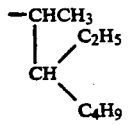 |
| S-97 | 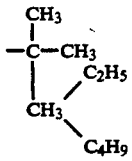 |
| S-98 | 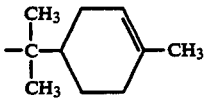 |
| S-99 | 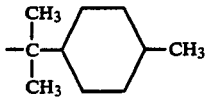 |
| S-100 | 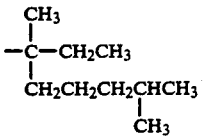 |
| S-101 | 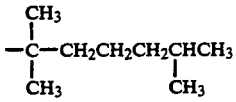 |
| S-102 | 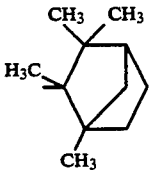 |
| S-103 | 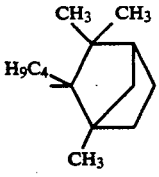 |
| S-104 | 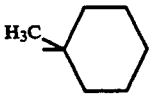 |
| S-105 | 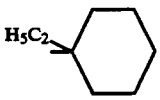 |
| S-106 | 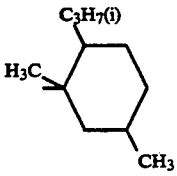 |
-continued
| Compound | R |
|---|---|
| S-107 | 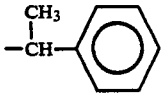 |
| S-108 | 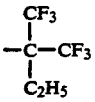 |
| S-109 | 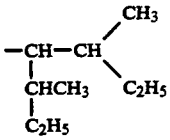 |
| S-110 | 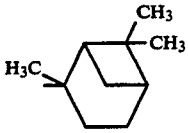 |
| S-111 | 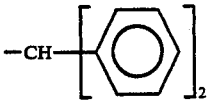 |
| S-112 | 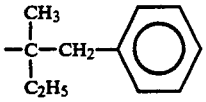 |
| S-113 | 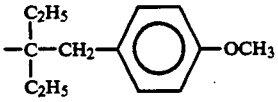 |
| S-114 | 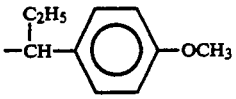 |
| S-115 | 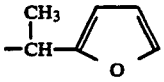 |
| S-116 | 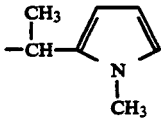 |
| | 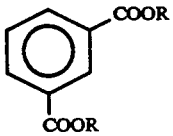 (IIIs-2-b) |
| S-117 | 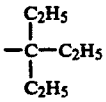 |

-continued
| Compound | R |
|---|---|
| S-118 | 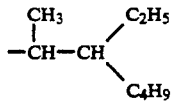 |
| S-119 | 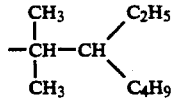 |
| S-120 | 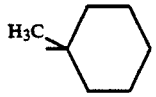 |
| S-121 | 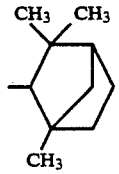 |
Specific examples of other compounds within the scope of formula (IIIs-2) are illustrated below.
(S-122)
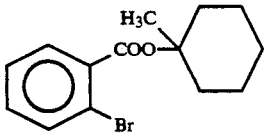
(S-123)
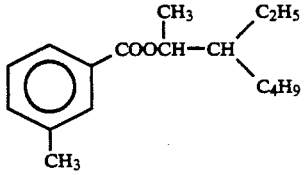
(S-124)
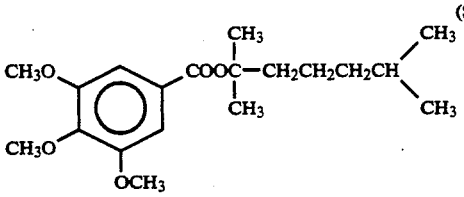
(S-125)
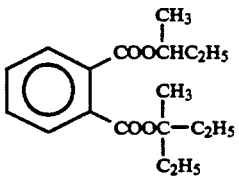
(S-126)
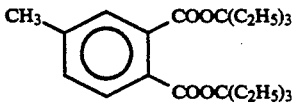
(S-127)
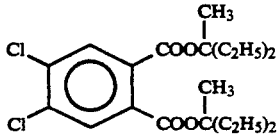
-continued
(S-128)
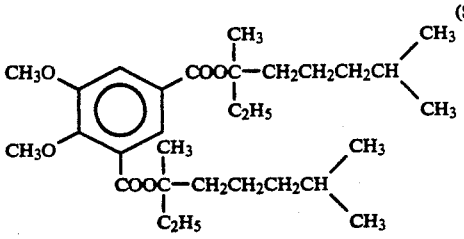
(S-129)
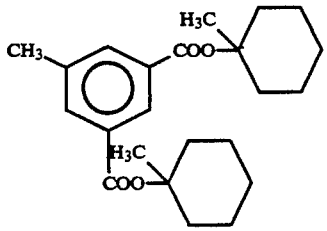
(S-130)
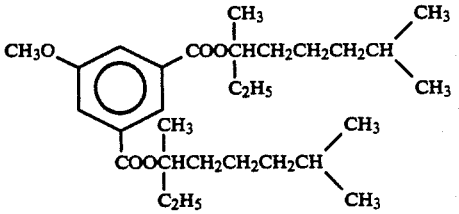
(S-131)
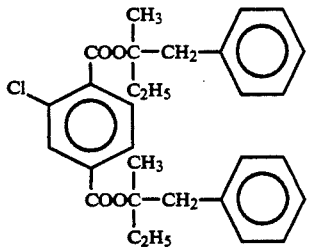
(S-132)
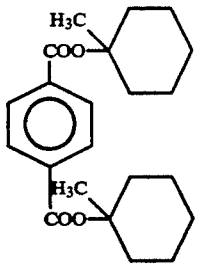
(S-133)
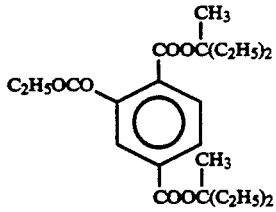
(S-134)
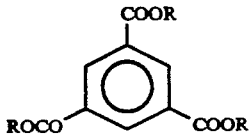

-continued wherein R is 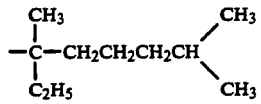

(S-135)

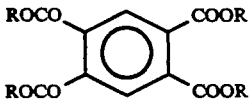

wherein R is 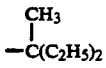

(S-136)

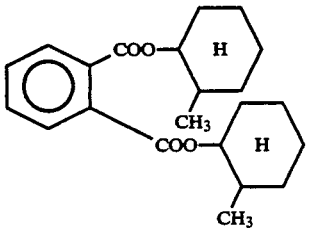

(S-137)

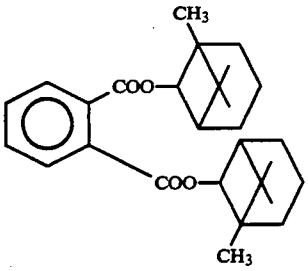

(S-138)

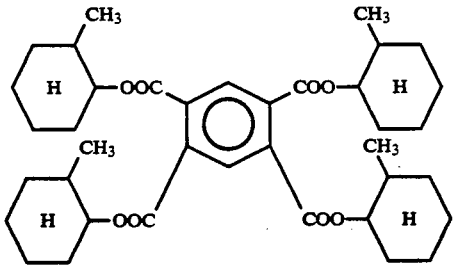

(S-139)

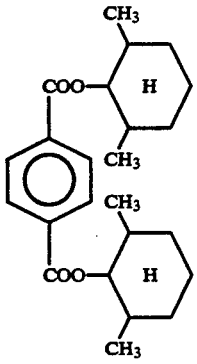

-continued (S-140)

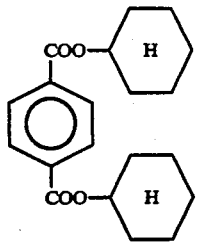

(S-141)

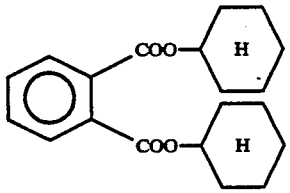

(S-142)

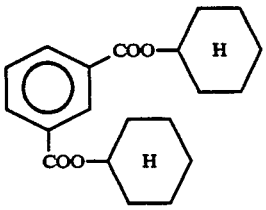

(S-143)

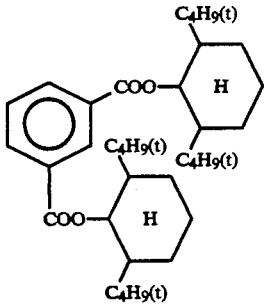

Those compounds represented by formula (IIIs-2) can be synthesized according to the following method.

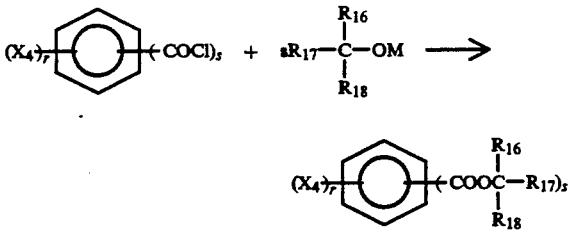

wherein M represents a hydrogen atom, Li, Na or K.

In the method described above, when M is a hydrogen atom, pyridine, triethylamine, tetramethylguanidine, DBN, DBU, sodium carbonate, or potassium carbonate may be used as a base. As a reaction solvent, acetonitrile, dimethylformamide, dimethylacetamide, N,N-dimethylimidazolidinone, sulforane, dimethylsulfoxide, benzene, toluene, xylene, dioxane, or tetrahydrofuran is preferably employed.

Specific examples of the synthesis method are described, for example, in European Patent Application Laid Open (EP) No. 228,064.

The water-insoluble organic polymer compound used in the silver halide color photographic material according to the present invention preferably has a relative fluorescence efficiency (K value) of not less than 0.10, more preferably not less than 0.20. The larger the value, the better the effect.

The above-described K value represents a relative fluorescence quantum efficiency of Compound A having the structure described below and which is a dye conventionally used as a fluorescence probe in a polymer. The K valve is defined by the following equation:

$$K=\phi a/\phi b$$

wherein $\phi$a and $\phi$b represent the fluorescence quantum efficiency of Compound A in polymer a and polymer b, respectively.

COMPOUND A

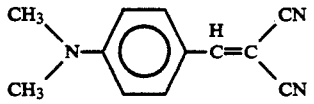

The fluorescence quantum efficiency can be determined according to the method described in *Macromolecules,* Vol. 14, page 587 (1981). More specifically, the K value was determined by $\phi$a and $\phi$b which were measured at room temperature using a polymer thin layer containing 0.5 mM of Compound A described above (which layer was prepared by spin coating a polymer solution on a slide glass at a larger thickness providing from 0.05 to 0.1 of an absorbance at absorption $\lambda$max of Compound A). In the present invention, the K value was determined using polymethyl methacrylate (number average molecular weight: 20,000) as the above described polymer b.

The polymers which can be used in the present invention are illustrated by the following examples, but the present invention should not be limited to these polymers.

(A) Vinyl polymers:

Monomers which can be employed in forming vinyl polymers useful in the present invention include acrylic acid esters, methacrylic acid esters, vinyl esters, acrylamides, methacrylamides, olefins, styrenes, vinyl ethers as well as other vinyl monomers.

Specific examples of acrylic acid esters include methyl acrylate, ethyl acrylate, n-propyl acrylate, isopropyl acrylate, n-butyl acrylate, isobutyl acrylate, sec-butyl acrylate, tert-butyl acrylate, amyl acrylate, hexyl acrylate, 2-ethylhexyl acrylate, octyle acrylate, tert-octyl acrylate, 2-chloroethyl acrylate, 2-bromoethyl acrylate, 4-chlorobutyl acrylate, cyanoethyl acrylate, 2-acetoxyethyl acrylate, dimethylaminoethyl acrylate, benzyl acrylate, methoxybenzyl acrylate, 2-chlorocyclohexyl acrylate, cyclohexyl acrylate, furfuryl acrylate, tetrahydrofurfuryl acrylate, phenyl acrylate, 5-hydroxypentyl acrylate, 2, 2-dimethyl-3-hydroxypropyl acrylate, 2-methoxyethyl acrylate, 3-methyoxybutyl acrylate, 2-ethoxyethyl acrylate, 2-isopropoxyethyl acrylate, 2-butoxyethyl acrylate, 2-(2-methoxyethoxy)ethyl acrylate, 2-(2-butoxyethoxy)ethyl acrylate, $\omega$-methoxypolyethylene glycol acrylate (addition molar number: n=9), 1-bromo-2-methoxyethyl acrylate, 1, 1-dichloro-2-ethoxyethyl acrylate, etc.

Specific examples of methacrylic acid esters include methyl methacrylate, ethyl methacrylate, n-propyl methacrylate, isopropyl methacrylate, n-butyl methacrylate, isobutyl methacrylate, sec-butyl methacrylate, tert-butyl methacrylate, amyl methacrylate, hexyl methacrylate, cyclohexyl methacrylate, benzyl methacrylate, chlorobenzyl methacrylate, octyl methacrylate, stearyl methacrylate, sulfopropyl methacrylate, N-ethyl-N-phenylaminoethyl methacrylate, 2-(3-phenylpropyloxy)ethyl methacrylate, dimethylaminophenoxyethyl methacrylate, furfuryl methacrylate, tetrahydrofurfuryl methacrylate, phenyl methacrylate, cresyl methacrylate, naphthyl methacrylate, 2-hydroxyethyl methacrylate, 4-hydroxybutyl methacrylate, triethylene glycol monomethacrylate, dipropylene glycol monomethacrylate, 2-methoxyethyl methacrylate, 3-methoxybutyl methacrylate, 2-acetoxyethyl methacrylate, 2-acetoacetoxyethyl methacrylate, 2-ethoxyethyl methacrylate, 2-isopropoxyethyl methacrylate, 2-butoxyethyl methacrylate, 2-(2-methoxyethoxy) ethyl methacrylate, 2-(2-ethoxyethoxy)ethyl methacrylate, 2-(2-butoxyethoxy)ethyl methacrylate, $\omega$-methoxypolyethylene glycol methacrylate (addition molar number: n=6), allyl methacrylate, dimethylaminoethyl methacrylate methyl chloride salt, etc.

Specific examples of vinyl esters include vinyl acetate, vinyl propionate, vinyl butyrate, vinyl isobutyrate, vinyl caproate, vinyl chloroacetate, vinyl methoxyacetate, vinyl phenylacetate, vinyl benzoate, vinyl salicylate, etc.

Specific examples of acrylamides include acrylamaide, methylacrylamide, ethylacrylamide, propylacrylamide, butylacrylamide, tert-butylacrylamide, cyclohexylacrylamide, benzylacrylamide, hydroxymethylacrylamide, methoxyethylacrylamide, dimethylaminoethylacrylamide, phenylacrylamide, dimethylacrylamide, diethylacrylamide, $\beta$-cyanoethylacrylamide, N-(2-acetoacetoxyethyl)acrylamide, diacetonacrylamide, tert-octylacrylamide, etc.

Specific examples of methacrylamide include methacrylamide, methylmethacrylamide, ethylmethacrylamide, propylmethacrylamide, butylmethacrylamide, tert-butyl-methacrylamide, cyclohexylmethacrylamide, benzylmethacrylamide, hydroxymethylmethacrylamide, methoxyethylmethacrylamide, dimethylaminoethylmethacrylamide, phenylmethacrylamide, dimethylmethacrylamide, diethylmethacrylamide, $\beta$-cyanoethylmethacrylamide, N-(2-acetoacetoxyethyl)-methacrylamide, etc.

Specific examples of olefins include dicyclopentadiene, ethylene, propylene, 1-butene, 1-pentene, vinyl chloride, vinylidene chloride, isoprene, chloroprene, butadiene, 2,3-dimethylbutadiene, etc.

Specific examples of styrenes include styrene, methylstyrene, dimethylstyrene, trimethylstyrene, ethyl styrene, isopropylstyrene, chloromethylstyrene, methoxystyrene, acetoxystyrene, chlorostyrene, dichlorostyrene, bromostyrene, vinyl benzoic acid methyl ester, etc.

Specific examples of vinyl ethers include methyl vinyl ether, butyl vinyl ether, hexyl vinyl ether, methoxyethyl vinyl ether, dimethylaminoethyl vinyl ether, etc.

Specific examples of other vinyl monomers include butyl crotonate, hexyl crotonate, dimethyl itaconate, dibutyl itaconate, diethyl maleate, dimethyl maleate, dibutyl maleate, diethyl fumarate, dimethyl fumarate, dibutyl fumarate, methyl vinyl ketone, phenyl vinyl ketone, methoxyethyl vinyl ketone, glycidyl acrylate, glycidyl methacrylate, N-vinyl oxazolidone, N-vinyl pyrrolidone, acrylonitrile, methacrylonitrile, methylene malononitrile, vinylidene, etc.

Two or more kinds of monomers (for example, those monomers described above) can be employed together to prepare the polymers according to the present invention depending on various purposes (for example, improvement in the solubility thereof). Further, for the purpose of adjusting color forming ability and solubility of the polymers, a monomer having an acid group as illustrated below can be employed as a comonomer as long as in the copolymer is not water-soluble.

Specific examples of such monomers having an acid group include acrylic acid; methacrylic acid; itaconic acid; maleic acid; a monoalkyl itaconate (for example, monomethyl itaconate, monoethyl itaconate, or monobutyl itaconate); a monoalkyl maleate (for example, monomethyl maleate, monoethyl maleate, or monobutyl maleate); citraconic acid; styrene sulfonic acid; vinylbenzylsulfonic acid; vinylsulfonic acid; an acryloyloxyalkylsulfonic acid (for example, acryloyloxymethylsulfonic acid, acryloyloxyethylsulfonic acid, or acryloyloxypropylsulfonic acid); a methacryloyloxyalkylsulfonic acid (for example, methacryloyloxymethylsulfonic acid, methacryloyloxyethylsulfonic acid, or methacryloyloxypropylsulfonic acid); an acrylamidoalkylsulfonic acid (for example, 2-acrylamido-2-methylethanesulfonic acid, 2-acrylamido-2-methylpropanesulfonic acid, or 2-acrylamido-2-methylbutanesulfonic acid); a methacrylamidoalkylsulfonic acid (for example, 2-methacrylamido-2-methylethanesulfonic acid, 2-methacrylamido-2-methylpropanesulfonic acid, or 2-methacrylamido-2-methylbutanesulfonic acid); etc.

The acid may be in the form of a salt of an alkali metal (for example, sodium, potassium), or an ammonium ion.

In the case where the vinyl monomer described above and a hydrophilic vinyl monomer which forms a hydrophilic homopolymer are employed as comonomers, the amount of hydrophilic monomer contained in the copolymer is not strictly limited as long as the copolymer is not water-soluble. The amount of hydrophilic monomer is preferably not more than 40 mol %, more preferably not more than 20 mol %, and further more preferably not more than 10 mol %. Further, when a hydrophilic comonomer copolymerizable with the monomer of the present invention has an acid group, the amount of comonomer having an acid group contained in the copolymer is usually not more than 20 mol %, and preferably not more than 10 mol % from the standpoint of image preservability as described above. In the most preferred case the copolymer does not contain such a monomer.

Preferred monomers include methacrylate type monomers, acrylamide type monomers and methacrylamide type monomers. Particularly preferred monomers are acrylamide type monomers and methacrylamide type monomers.

(B) Polymers obtained by condensation polymerization or polyaddition reaction:

As polymers obtained by condensation polymerization, polyesters obtained from polyhydric alcohols and polybasic acids, and polyamides obtained from diamines and dibasic acids, or ω-amino-ω-caboxylic acids are known. As polymers obtained by polyaddition, polyurethanes obtained from diisocyanates and divalent alcohols are known.

Useful polyhydric alcohols include a glycol having a structure of HO—$R_{21}$—OH (wherein $R_{21}$ represents a hydrocarbon chain having from 2 to about 12 carbon atoms, particularly an aliphatic hydrocarbon chain) and a polyalkylene glycol, while useful polybasic acids include those represented by the formula HOOC—$R_{22}$—COOH (wherein $R_{22}$ represents a single bond or a hydrocarbon chain having from 1 to about 12 carbon atoms).

Specific examples of the polyhydric alcohols include ethylene glycol, diethylene glycol, triethylene glycol, 1,2-propylene glycol, 1,3-propylene glycol, trimethylol propane, 1,4-butanediol, isobutylenediol, 1,5-pentanediol, neopentyl glycol, 1,6-hexanidiol, 1,7-heptanediol, 1,8-octanediol, 1,9-nonanediol, 1,10-decanediol, 1,11-undecanediol, 1,12-dodecanediol, 1,13-tridecanediol, glycerol, diglycerol, triglycerol, 1-methylglycerol, erythritol, mannitol, and sorbitol.

Specific examples of polybasic acids include oxalic acid, succinic acid, glutaric acid, adipic acid, pimelic acid, cork acid, azelaic acid, sebacic acid, nonanedicarboxylic acid, decanedicarboxylic acid, undecanedicarboxylic acid, dodecanecarboxylic acid, fumaric acid, maleic acid, itaconic acid, citraconic acid, phthalic acid, isophthalic acid, terephthalic acid, tetrachlorophthalic acid, mesaconic acid, isopimelic acid, cyclopentadiene-maleic anhydride adduct, and rosin-maleic anhydride adduct.

Specific examples of diamines include hydrazine, methylenediamine, ethylenediamine, trimethylenediamine, tetramethylenediamine, hexamethylenediamine, dodecylmethylenediamine, 1,4-diaminocyclohexane, 1,4-diaminomethylcyclohexane, o-aminoaniline, p-aminoaniline, 1,4-diaminomethylbenzene, and di-(4-aminophenyl)ether.

Specific examples of ω-amino-ω-carboxylic acids include glycine, β-alanine, 3-aminopropionic acid, 4-aminobutyric acid, 5-aminopentanoic acid, 11-aminododecanoic acid, 4-aminobenzoic acid, 4-(2-aminoethyl)benzoic acid, and 4-(4-aminophenyl)butyric acid.

Specific examples of diisocyanates include ethylenediisocyanate, hexamethylenediisocyanate, m-phenylenediisocyanate, p-phenylenediisocyanate, p-xylenediisocyanate, and 1, 5-naphthyldiisocyanate.

(C) Other polymers:

Polyesters or polyamides obtained by ring-opening condensation are illustrated below.

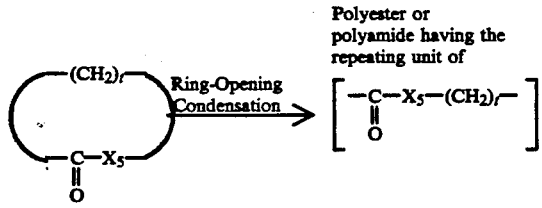

wherein $X_5$ represents —O— or —NH—; t represents an integer of from 4 to 7; and the $\text{-}(CH_2)_t\text{-}$ chain may be a branched chain.

Suitable monomers for preparation of these polymers include β-propiolactone, ε-caprolactone, dimethylpropiolactone, α-pyrrolidone, α-piperidone, ε-caprolactam, and α-methyl-ε-caprolactam, etc.

Polymers represented by formula (P) can also be employed.

$$\text{-}\!\!\{(A_1)(B_1)\}\!\!\text{-}_u \qquad (P)$$

wherein $A_1$ represents a repeating unit having at least one bond selected from an ether bond and a $-SO_2-$ bond in the main chain thereof; $B_1$ represents a repeating unit having at least one bond selected from a

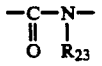

bond, a

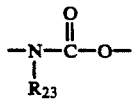

bond, a $-SO_2-$ bond and an ester bond in the main chain thereof or a single bond, which may be the same as or different from $A_1$; $R_{23}$ represents a hydrogen atom, an alkyl group, an aryl group or an aralkyl group each of these groups may be substituted; and u represents an integer of 5 or more.

In addition, two or more of the polymers described above may be used in combination.

Among the polymers according to the present invention, vinyl polymers are preferred, acrylic polymers are more preferred, and acrylamide type polymers are particularly preferred.

Molecular weight and degree of polymerization of the polymer according to the present invention do not have a substantial influence on the effect of the present invention. However, certain problems may develop as the molecular weight is increased. For examples, it requires an increased time to dissolve it in an auxiliary solvent and moreover, the emulsification or dispersion thereof becomes difficult due to high viscosity thereof. In addition, coarse grains are formed, resulting in decrease in color forming property and coating property.

When a large amount of the auxiliary solvent is used to reduce its viscosity in order to overcome such difficulties, new problems may be introduced.

From such a point of view, the viscosity of the polymer is preferably not more than 5,000 cps, more preferably not more than 2,000 cps, when 30 g of the polymer is dissolved in 100ml of an auxiliary solvent. Also, the molecular weight of the polymer useful in the present invention is preferably not more than 150,000 more preferably not more than 100,000.

The term "water-insoluble" as used herein with respect to the polymer means that a weight of the polymer soluble in 100g of distilled water is not more than 3 g, preferably not more than 1 g.

A ratio of the polymer to an auxiliary solvent depends upon the kind of polymer used, and can be varied over a wide range depending on its solubility to the auxiliary solvent, its degree of polymerization, and the solubility of coupler. Usually the auxiliary the solvent is employed in an amount necessary to provide a sufficiently low viscosity so as to easily disperse a solution containing at least a coupler, a coupler solvent having a high boiling point and the polymer dissolved in the auxiliary solvent in water or an aqueous solution of a hydrophilic colloid. Since the viscosity of the solution increases when the degree of polymerization of the polymer is increased, it is difficult to set forth a ratio of the polymer to an auxiliary solvent which is independent of the polymer. Usually, however, the ratio of about 1:1 to about 1:50 (by weight) is preferred. A ratio of the polymer according to the present invention to a coupler (the cyan coupler represented by formula (I)) is preferably from 1:20 to 20:1 more preferably from 1:10 to 10:1 (by weight).

Specific examples of the polymers which can be used in the present invention are set forth below, but the present invention should not be limited to these polymers.

| Examples | Polymers |
|---|---|
| P-1 | Polymethylmethacrylate |
| P-2 | Polyethylmethacrylate |
| P-3 | Polyisopropylmethacrylate |
| P-4 | Polymethylchloroacrylate |
| P-5 | Poly(2-tert-butylphenyl acrylate) |
| P-6 | Poly(4-tert-butylphenyl acrylate) |
| P-7 | Copolymer of ethylmethacrylate-n-butylacrylate (70:30) |
| P-8 | Copolymer of methylmethacrylate-acrylonitrile (65:35) |
| P-9 | Copolymer of methylmethacrylate-styrene (90:10) |
| P-10 | Copolymer of N-tert-butylmethacrylamide-methylmethacrylate-acrylic acid (60:30:10) |
| P-11 | Copolymer of methylmethacrylate-styrene-vinylsulfonamide (70:20:10) |
| P-12 | Copolymer of methylmethacrylate cyclohexylmethacrylate (50:50) |
| P-13 | Copolymer of methylmethacrylate-acrylic acid (95:5) |
| P-14 | Copolymer of methylmethacrylate-n-butylmethacrylate (65:35) |
| P-15 | Copolymer of methylmethacrylate-N-vinyl-2-pyrrolidone (90:10) |
| P-16 | Poly(N-sec-butylacrylamide) |
| P-17 | Poly(N-tert-butylacrylamide) |
| P-18 | Copolymer of (cyclohexylmethacrylate-methylmethacrylate (60:40) |
| P-19 | Copolymer of n-butylmethacrylate-methylmethacrylate-acrylamide (20:70:10) |
| P 20 | Copolymer of diacetoneacrylamide-methylmethacrylate (20:80) |
| P-21 | Copolymer of N-tert-butylacrylamide-methylmethacrylate (40:60) |
| P-22 | Poly(N-n-butylacrylamide) |
| P-23 | Copolymer of tert-butylmethacrylate-N-tert-butylacrylamide (50:50) |
| P-24 | Copolymer of tert-butylmethacrylate-methylmethacrylate (70:30) |
| P-25 | Poly(N-tert-butylmethacrylamide) |
| P-26 | Copolymer of N-tert-butylacrylamide-methylmethacrylate (60:40) |
| P-27 | Copolymer of methylmethacrylate-acrylonitrile (70:30) |
| P-28 | Copolymer of methylmethacrylate-styrene (75:25) |
| P-29 | Copolymer of methylmethacrylate-hexylmethacrylate (70:30) |
| P-30 | Poly(4-biphenylacrylate) |
| P-31 | Ply(2-chlorophenylacrylate) |
| P-32 | Poly(4-chlorophenylacrylate) |
| P-33 | Poly(pentachlorophenylacrylate) |
| P-34 | Poly(4-ethoxycarbonylphenylacrylate) |
| P-35 | Poly(4-methoxycarbonylphenylacrylate) |
| P-36 | Poly(4-cyanophenylacrylate) |
| P-37 | Poly(4-methoxyphenylacrylate) |
| P-38 | Poly(3,5-dimethyladamanthylacrylate) |
| P-39 | Poly(3-dimethylaminophenylacrylate) |
| P-40 | Poly(2-naphtylacrylate) |
| P-41 | Poly(phenylacrylate) |
| P-42 | Poly(N,N-dibutylacrylamide) |
| P-43 | Poly(iso-hexylacrylamide) |
| P-44 | Poly(iso-octylacrylamide) |
| P-45 | Poly(N-methyl-N-phenylacrylamide) |
| P-46 | Poly(adamanthylmethacrylate) |

-continued

| Examples | Polymers |
|---|---|
| P-47 | Poly(sec-butylmethacrylate) |
| P-48 | Copolymer of N-tert-butylacrylamide-acrylic acid (97:3) |
| P-49 | Poly(2-chloroethylmethacrylate) |
| P-50 | Poly(2-cyanoethylmethacrylate) |
| P-51 | Poly(2-cyanomethlphenylmethacrylate) |
| P-52 | Poly(4-cyanophenylmethacrylate) |
| P-53 | Poly(cyclohexylmethacrylate) |
| P-54 | Poly(2-hydroxypropylmethacrylate) |
| P-55 | Poly(4-methoxycarbonylphenylmethacrylate) |
| P-56 | Poly(3, 5-dimethyladamanthylmethacrylate) |
| P-57 | Poly(phenylmethacrylate) |
| P-58 | Poly(4-butoxycarbonylphenylmethacrylamide) |
| P-59 | Poly(4-carboxyphenylmethacrylamide) |
| P-60 | Poly(4-ethoxycarbonylphenylmethacrylamide) |
| P-61 | Poly(4-methoxycarbonylphenylmethacrylamide) |
| P-62 | Poly(cyclohexylchloroacrylate) |
| P-63 | Poly(ethylchloroacrylate) |
| P-64 | Poly(iso-butylchloroacrylate) |
| P-65 | Poly(iso-propylchloroacrylate) |
| P-66 | Poly(N-phenylacrylamide) |
| P-67 | Poly(N-phenylmethacrylamide) |
| P-68 | Poly(N-cyclohexylacrylamide) |
| P-69 | Poly(N-cyclohexylmethacrylamide) |

The polymer according to the present invention can be synthesized by synthesis examples described below or similar methods thereto.

SYNTHESIS EXAMPLE 1

Synthesis of Polymethylmethacrylate (P-1)

A mixture of 50.0 g of methyl methacrylate, 0.5 g of sodium polyacrylate and 200 ml of distilled water was heated at 80° C. with stirring under a nitrogen atmosphere in a 500 ml three-necked flask. 500 mg of dimethyl azobisisobutyrate was added thereto as a polymerization initiator thereby polymerization was initiated. After polymerization for 2 hours, the polymerization solution was cooled and the bead-like polymer was collected by filtration and washed with water to obtain 48.7 g of P-1.

SYNTHESIS EXAMPLE 2

Synthesis of Poly (N-tert-butylacrylamide) (P-17)

A mixture of 50.0 g of t-butylacrylamide and 250 ml of toluene was heated at 80° C. with stirring under a nitrogen atmosphere in a 500 ml three-necked flask. 10 ml of a toluene solution containing 500 mg of azobisisobutyronitrile was added thereto as a polymerization initiator thereby polymerization was initiated. After polymerization for 3 hours, the polymerization solution was cooled and poured into 1 liter of hexane. The solids thus-deposited were collected by filtration, washed with hexane and dried with heating under a reduced pressure to obtain 47.9 g of P-17.

The dispersion of oleophilic fine particles containing the compounds (i.e., the oil-soluble cyan coupler represented by formula (I), the compound represented by formula (II) or (III) and the compound represented by formula (IV), as well as the high boiling organic solvent having a viscosity of not less than 200 cp (at 25° C.) and/or the water-insoluble organic polymer compound if desired) according to the present invention can be prepared in the following manner.

The compounds according to the present invention are completely dissolved together with photographic additives in an auxiliary organic solvent. The solution is dispersed in water, preferably in an aqueous solution of a hydrophilic colloid, and more preferably in an aqueous solution of gelatin, with the assistance of a dispersant using ultrasonic agitation, or a colloid mill to form fine particles. Then, the dispersion is mixed with a silver halide emulsion.

Alternatively, water or an aqueous solution of a hydrophilic colloid such as an aqueous solution of gelatin is added to an auxiliary organic solvent containing a dispersant such as a surface active agent, the compounds according to the present invention to prepare an oil droplet-in-water type dispersion accompanied by phase inversion.

Further, the dispersion prepared may be mixed with a photographic emulsion after removing the auxiliary organic solvent therefrom by an appropriate method such as distillation, noodle washing or ultrafiltration.

The term "auxiliary organic solvent" as used herein means an organic solvent which is useful in forming an emulsified dispersion, which is finally removed substantially from the photographic light-sensitive material during the drying step after coating or by the above-described method, and which is an organic solvent having a low boiling point or a solvent having a certain extent of solubility in water and removable by washing with water.

Specific examples of auxiliary organic solvents include a lower alkyl acetate such as ethyl acetate and butyl acetate, ethyl propionate, sec-butyl alcohol, methyl ethyl ketone, methyl isobutyl ketone, $\beta$-ethoxyethyl acetate, methyl cellosolve acetate, methyl carbitol acetate, methyl carbitol propionate and cyclohexanone.

Further, an organic solvent which is fully miscible with water, for example, methyl alcohol, ethyl alcohol, acetone, or tetrahydrofuran may also be included, if desired.

The color photographic light-sensitive material according to the present invention may comprise a support having coated thereon at least one blue-sensitive silver halide emulsion layer, at least one green-sensitive silver halide emulsion layer and at least one red-sensitive silver halide emulsion layer. In case of conventional color printing paper, the light-sensitive layers are usually provided on a support in the order as described above, but they can be provided in a different order therefrom. Further, an infrared-sensitive silver halide emulsion layer may be employed in place of at least one of the above described emulsion layers. Each of the light-sensitive emulsion layers contains a silver halide emulsion having sensitivity in a respective wavelength region and a so-called color coupler which forms a dye of complementary color to the light to which the silver halide emulsion is sensitive, that is, yellow, magenta and cyan to blue, green and red, respectively. Thus, color reproduction by a subtractive process can be performed. However, the relationship of the light-sensitive layer and hue of dye formed from the coupler may be varied in a different way from that described above.

Silver halide emulsions used in the present invention are preferably those composed of silver chlorobromide or silver chloride each containing substantially no silver iodide. The terminology "containing substantially no silver iodide" as used herein means that a silver iodide content of the emulsion is not more than 1 mol %, preferably not more than 0.2 mol %.

The halogen composition may be equal or different between individual grains in the emulsion. When an emulsion having an equal halogen composition between individual grains is used, it is easier to obtain uniform properties of grains. Further, with respect to distribution of halogen composition inside the silver halide emulsion grains, grains having a so-called uniform structure wherein the halogen composition is equal at any portion of the grains, grains having a so-called stratified structure wherein the halogen composition of the interior (core) of grain is different from that of the shell (including one or more layers) surrounding the core, and grains having a structure wherein portions having different halogen compositions are present in the non-stratified form in the interior or on the surface of grains (the portion having a different composition being junctioned at an edge, corner or plane) can be appropriately selected. In order to obtain high sensitivity, it is advantageous to employ any of the two latter type grains rather than the uniform structure grains. They are also preferred in view of resistance to pressure. In those cases wherein silver halide grains do not have a uniform structure, the boundary of portions having different halogen compositions from each other may be distinct, or vague because of the formation of mixed crystal due to the composition difference. Further, grains having intentionally continuous change in structure may be employed.

With respect to the halogen composition of a silver chlorobromide emulsion, any silver bromide/silver chloride ratio may be employed. The ratio may be widely varied depending on the purpose, but emulsions having a silver chloride content ratio of 2 mol % or more are preferably employed.

In photographic light-sensitive materials suitable for rapid processing, a so-called high silver chloride content emulsion which has a high silver chloride content ratio is preferably used. The silver chloride content ratio in such a high silver chloride content emulsion is preferably 90 mol % or more, more preferably 95 mol % or more.

Of such high silver chloride content emulsions, those having a structure wherein a localized phase of silver bromide is present in the interior and/or on the surface of silver halide grains in the stratified form or in the non-stratified form as described above are preferred. With respect to the halogen composition of the localized phase described above, it is preferred that the silver bromide content is at least 10 mol %, and more preferably exceeding 20 mol %. The localized phase may exist in the interior of the grain, or at the edge, corner or plane of the surface of the grain. One preferred example is a grain wherein epitaxial growth is made at the corner.

On the other hand, for the purpose of minimizing the reduction in sensitivity occurring when pressure is applied to the photographic light-sensitive material, it is preferred to use uniform structure type grains, wherein the distribution of halogen composition is narrow in a high silver chloride content emulsion having a silver chloride content of 90 mol % or more.

Further, for the purpose of reducing the amount of replenisher needed for a developing solution, a silver chloride emulsion having an increased silver chloride content can be employed. In such a case, an almost pure silver chloride is preferably used wherein the silver chloride content is from 98 mol % to 100 mol %.

The average grain size of silver halide grains in the silver halide emulsion used in the present invention (the grain size being defined as a diameter of a circle having the same area as the projected area of the grain and being averaged by number) is preferably from 0.1 μm to 2 μm.

Moreover, it is preferred to employ a so-called monodispersed emulsion which has a grain size distribution such that the coefficient of variation (obtained by dividing the standard deviation of the grain size distribution with the average grain size) not more than 20%, preferably not more than 15%. Further, it is preferred to employ two or more of the above described monodispersed emulsions in the same layer as a mixture or in the form of superimposed layers for the purpose of obtaining wide latitude.

The silver halide grains contained in the photographic emulsion may have a regular crystal form such as cubic, tetradecahedral, octahedral, etc., or an irregular crystal form such as spherical, tabular, etc., or may have a composite form of these crystal forms. Also, a mixture of grains having various crystal forms may be used. Of these emulsions, those containing the grains having the above described regular crystal form not less than 50%, preferably not less than 70%, and more preferably not less than 90% are advantageously used in the present invention.

Further, a silver halide emulsion wherein tabular silver halide grains having an average aspect ratio (diameter corresponding to circle/thickness) of at least 5, preferably at least 8, accounts for at least 50% of the total projected area of the silver halide grains may be preferably used in the present invention.

The silver chlorobromide emulsion used in the present invention can be prepared in any suitable manner, for example, by the methods as described in P. Glafkides, *Chimie et Physique Photographique,* Paul Montel (1967), G. F. Duffin, *Photographic Emulsion Chemistry,* The Focal Press (1966), and V. L. Zelikman et al., *Making and Coating Photographic Emulsion,* The Focal Press (1964). That is, any of an acid process, a neutral process, and an ammonia process can be employed.

Soluble silver salts and soluble halogen salts can be reacted by techniques such as a single jet, process, a double jet process, and a combination thereof. In addition, there can be employed a method (a so-called reversal mixing process) in which silver halide grains are formed in the presence of an excess of silver ions. As one system of the double jet process, a so-called controlled double jet process in which the pAg in a liquid phase where the silver halide is formed is maintained at a predetermined level, can also be employed. This process provides a silver halide emulsion in which the crystal form is regular and the grain size is nearly uniform.

During the step of formation or physical ripening of silver halide grains of the silver halide emulsion used in the present invention, various kinds of multi-valent metal ion impurities can be introduced. Suitable examples of the compounds include cadmium salts, zinc salts, lead salts, copper salts, thallium salts, salts or complex salts of the element of The Group VIII, for example, iron, ruthenium, rhodium palladium, osmium, iridium, and platinum. Particularly, the above described element of The Group VIII are preferably used. The amount of the compound added can be varied over a wide range depending on the purpose, but it is preferably used in a range from $10^{-9}$ to $10^{-2}$ mol per mol of silver halide.

The silver halide emulsions used in the present invention are usually subjected to chemical sensitization and spectral sensitization.

For the chemical sensitization, a sulfur sensitization method, e.g., the use of unstable sulfur compound; a noble metal sensitization method, e.g., a gold sensitization method, and a reduction sensitization method can be employed individually or in combination. The compounds preferably used in the chemical sensitization include those as described in JP-A-62-215272, page 18, right lower column to page 22, right upper column.

The spectral sensitization is performed for the purpose of imparting spectral sensitivity in the desired wavelength range to the emulsion of each layer of the photographic light sensitive material. The spectral sensitization can be conducted by adding a spectral sensitizing dye which is a dye capable of absorbing light of a wavelength range corresponding to the desired spectral sensitivity. Suitable examples of the spectral sensitizing dyes used include those described, for example, in F. H. Harmer, *Heterocyclic Compounds-Cyanine Dyes and Related Compounds*, John Wiley & Sons (New York, London) (1964). Specific examples of the sensitizing dyes and spectral sensitizing methods preferably employed are described in JP-A-62-215272, page 22, right upper column to page 38.

The silver halide emulsions used in the present invention can contain various kinds of compounds or precursors thereof for preventing the occurrence of fog or for stabilizing photographic performance during the production, storage and/or photographic processing of photographic light-sensitive materials. Specific examples of the compounds preferably used are described in JP-A-62-215272, page 39 to page 72.

The silver halide emulsion used in the present invention may be a so-called surface latent image type emulsion wherein latent images are formed mainly on the surface of grains or a so-called internal latent image type emulsion wherein latent images are formed mainly in the interior of grains.

In the color photographic light-sensitive material according to the present invention, a yellow coupler and a magenta coupler which form a yellow and magenta colors, respectively, upon coupling with the oxidation product of an aromatic primary amine type color developing agent can be employed, in addition to the cyan coupler used in the present invention.

Magenta couplers and yellow couplers which are preferably used in the present invention include those represented by formula (M-I), (M-II) or (Y):

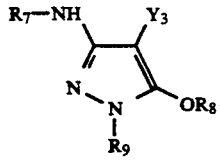

(M-I)

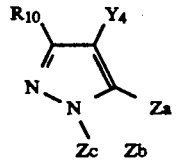

(M-II)

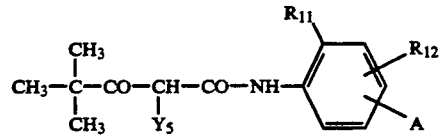

(Y)

In formula (M-I), $R_7$ and $R_9$ each represents an aryl group; $R_8$ represents a hydrogen atom, an aliphatic or aromatic acyl group or an aliphatic or aromatic sulfonyl group; and $Y_3$ represents a hydrogen atom or a releasing group.

The aryl group represented by $R_7$ or $R_9$ is preferably a phenyl group and may be substituted with one or more substituents selected from a halogen atom, an alkyl group, an alkoxy group, an aryloxy group, an acylamino group, an acyl group, a carbamoyl group, a sulfonamido group, a sulfamoyl group, a sulfonyl group, a sulfamide group, an oxycarbonyl group and a cyano group. When two or more substituents are present, they may be the same or different. $R_8$ is preferably a hydrogen atom, an aliphatic acyl group or an aliphatic sulfonyl group, and more preferably a halogen atom. $Y_3$ is preferably a releasing group which is released at any of a sulfur atom, an oxygen atom or a nitrogen atom, and more preferably a releasing group of a sulfur atom releasing type as described, for example, in U.S. Pat. No. 4,351,897 and International Laid Open No. WO 88/04795.

In formula (M-II), $R_{10}$ represents a hydrogen atom or a substituent; $Y_4$ represents a hydrogen atom or a releasing group, preferably a halogen atom or an arylthio group; Za, Zb and Zc each represents a methine group, a substituted methine group, =N— or —NH—, one of the Za-Zb bond and the Zb-Zc bond being a double bond and the other being a single bond; when the Zb-Zc bond is a carbon-carbon double bond, the Zb-Zc bond may be a part of a condensed aromatic ring; $R_{10}$ or $Y_4$ may also form a polymer including a dimer or more; and when Za, Zb or Zc is a substituted methine group, the substituted methine group may form a polymer including a dimer or more.

Of pyrazoloazole type couplers represented by formula (M-II), imidazo[1,2-b]pyrazoles as described in U.S. Pat. No. 4,500,630 are preferred and pyrazolo[1,5-b][1,2,4]triazoles as described in U.S. Pat. No. 4,540,654 are particularly preferred in view of less yellow subsidiary adsorption and the light fastness of dyes formed therefrom.

Further, pyrazolotriazole couplers having a branched alkyl group directly connected to the 2-, 3- or 6-position of the pyrazolotriazole ring as described in JP-A-61-65245, pyrazoloazole couplers having a sulfonamido group in their molecules as described in JP-A-61-65246, pyrazoloazole couplers having an alkoxyphenylsulfonamido ballast group as described in JP-A-61-147254, and pyrazolotriazole couplers having an alkoxy group or an aryloxy group at the 6-position thereof as described in European Patent (OPI) Nos. 226,849 and 294,785 are also preferably employed.

In formula (Y), $R_{11}$ represents a halogen atom, an alkoxy group, a trifluoromethyl group or an aryl group; $R_{12}$ represents a hydrogen atom, a halogen atom or an alkoxy group; A represents $—NHCOR_{13}$, $—NHSO_2R_{13}$, $—SO_2NHR_{13}$, $—COOR_{13}$ or

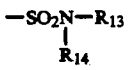

(wherein $R_{13}$ and $R_{14}$ $R_{14}$ each represents an alkyl group, an aryl group or an acyl group); and $Y_5$ represents a releasing group.

The group represented by $R_{12}$, $R_{13}$ or $R_{14}$ may be substituted with one or more substituents Which are selected from the substituents described for $R_1$. The releasing group represented by $Y_5$ is preferably a releasing group which is released at any of an oxygen atom or a nitrogen atom, and more preferably a releasing group of a nitrogen atom releasing type.

Specific examples of the couplers represented by the general formula (M-I), (M-II) or (Y) are illustrated below, but the present invention should not be limited thereto.

(M-1)

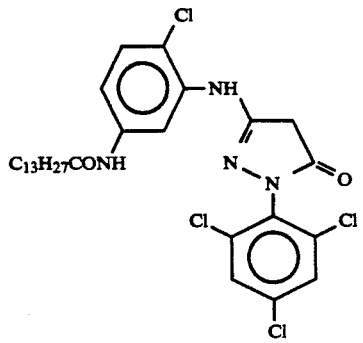

(M-2)

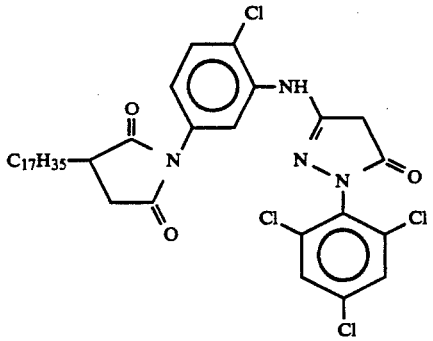

(M-3)

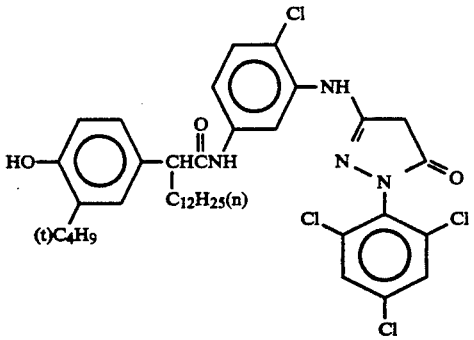

(M-4)

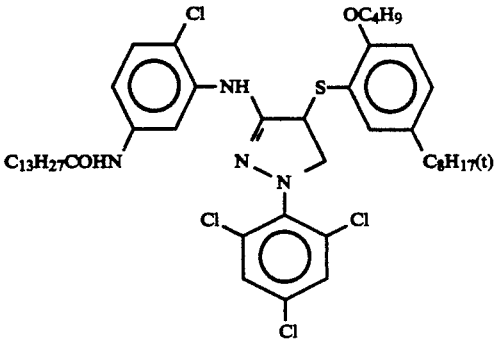

-continued
(M-5)
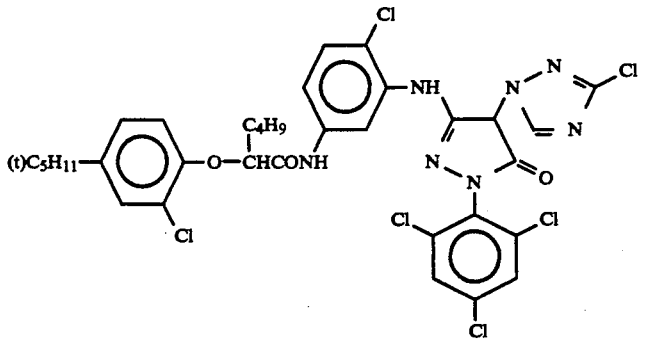
(M-6)
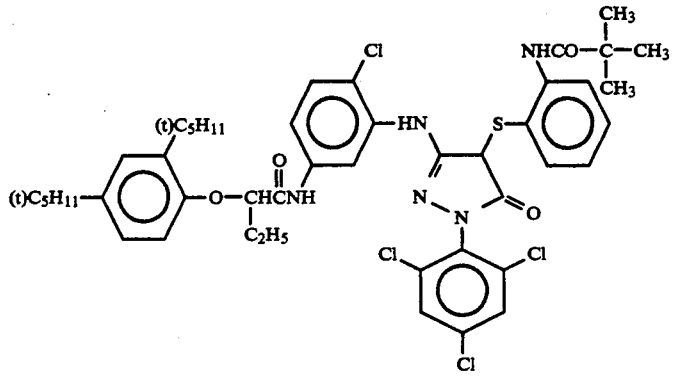
(M-7)
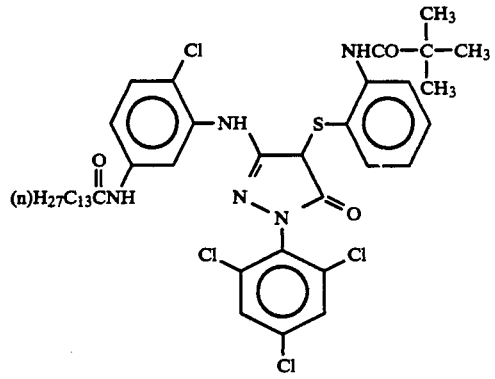
(M-8)
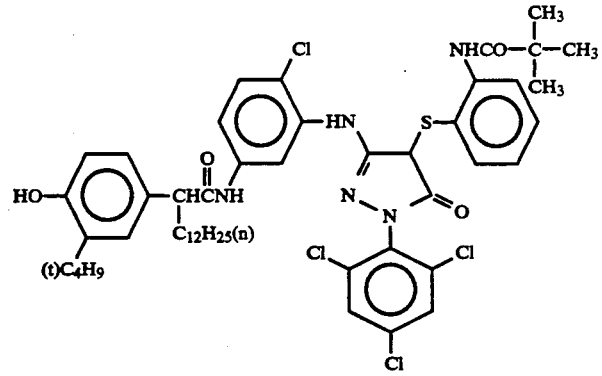

| Compound | $R_{10}$ | $R_{15}$ | $Y_4$ |
|---|---|---|---|
| | | 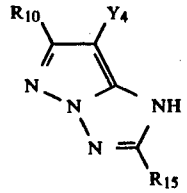 | |
| M-9 | $CH_3$— | 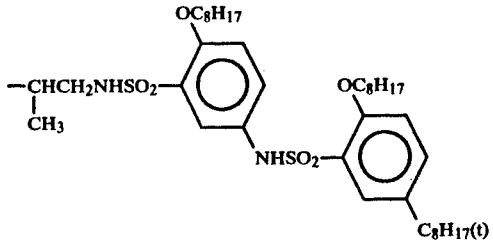 | Cl |
| M-10 | " | 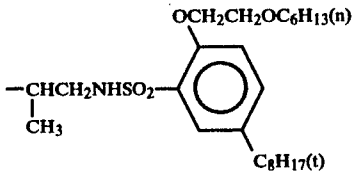 | " |
| M-11 | $(CH_3)_3C$— | 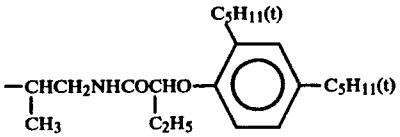 | 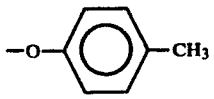 |
| M-12 | 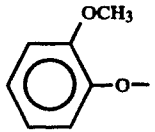 | 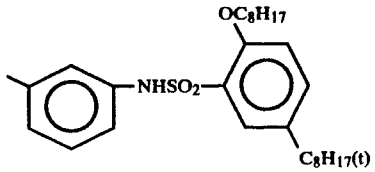 | 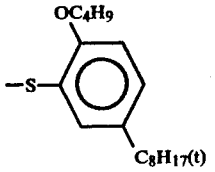 |

-continued
| Compound | $R_{10}$ | $R_{15}$ | $Y_4$ |
|---|---|---|---|
| M-13 | $CH_3$— | 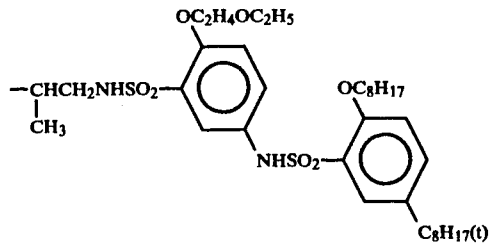 | Cl |
| M-14 | " | 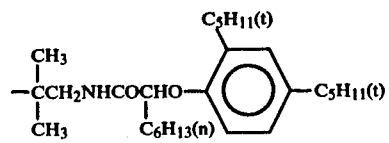 | " |
| M-15 | $CH_3$— | 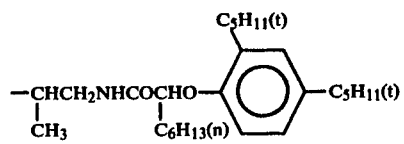 | Cl |
| M-16 | " | 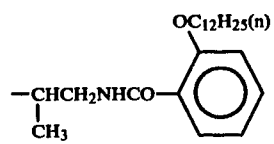 | " |
| M-17 | " | 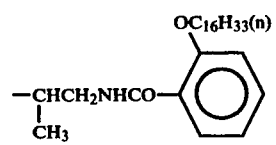 | " |

-continued
| Compound | $R_{10}$ | $R_{15}$ | $Y_4$ |
|---|---|---|---|
| M-18 | 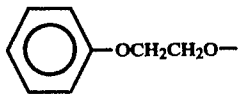 | 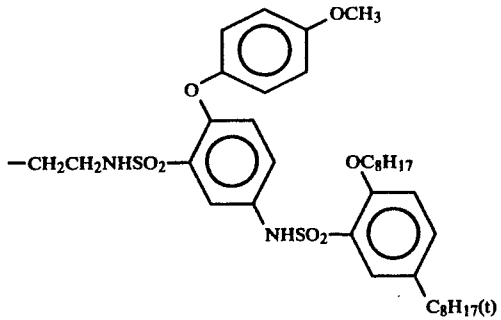 | 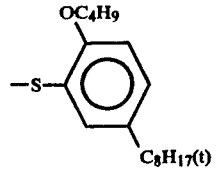 |
| M-19 | $CH_3CH_2O-$ | " | " |
| M-20 | 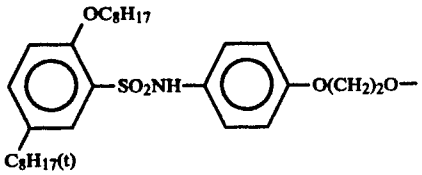 | 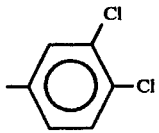 | 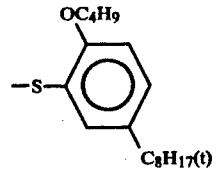 |
| M-21 | 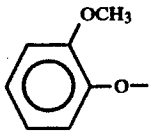 | 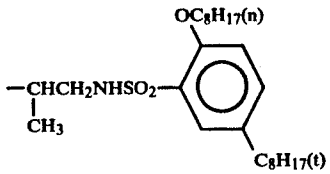 | Cl |
| M-22 | $CH_3-$ | 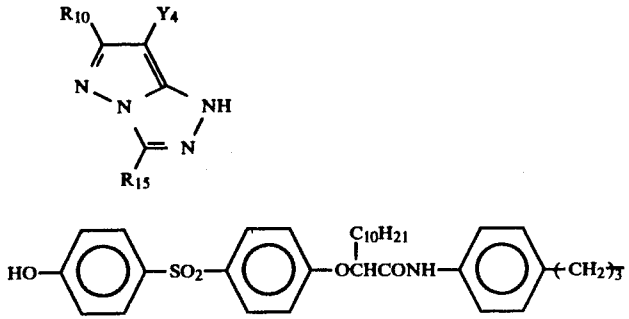 | Cl |

-continued

| Compound | $R_{10}$ | $R_{15}$ | $Y_4$ |
|---|---|---|---|
| M-23 | " | $(n)C_6H_{13}$ / $(n)C_8H_{17}$ $CHCH_2SO_2(CH_2)_2$ | " |
| M-24 | $CH_3$ / $CH_3$ $CH-$ | $OC_4H_9$; $SO_2(CH_2)_3$; $C_8H_{17}(t)$ | " |
| M-25 | $(CH-CH_2)_{50}(CH_2-C)_{50}$ ($CH_3$; $COOCH_2CH_2OCH_3$; $CONH-$) | $CH_3-CH-$ $CH_2NHSO_2CH_3$ | " |
| M-26 | $-O-$ | $OC_8H_{17}$; $(CH_2)_2NHSO_2$; $C_8H_{17}(t)$ | Cl |
| M-27 | $CH_3-$ | $CH_3$; $CH_3$; $CH_3$; $NHCOCHO$ ($(n)C_{10}H_{21}$); $SO_2$; $OCH_2$ | " |
| M-28 | $(CH_3)_3C-$ | $CH_3$; $CH_3$; $CH_3$; $C_5H_{11}(t)$; $NHCOCHO$ ($C_4H_9(n)$); $C_5H_{11}(t)$ | " |

-continued
| Compound | $R_{10}$ | $R_{15}$ | $Y_4$ |
|---|---|---|---|
| M-29 | 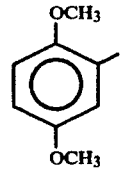 | 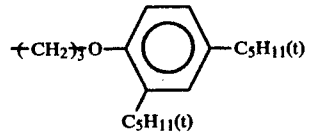 | Cl |
| M-30 | $CH_3-$ | $-CH(C_2H_5)-N(n\text{-}C_{18}H_{37})COCH_2CH_2COOH$ | " |

(Y-1)
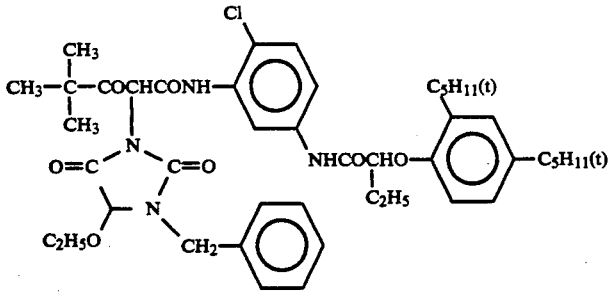
(Y-2)
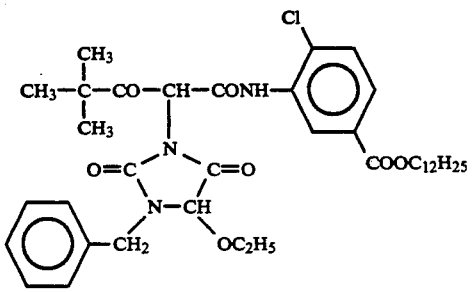
(Y-3)
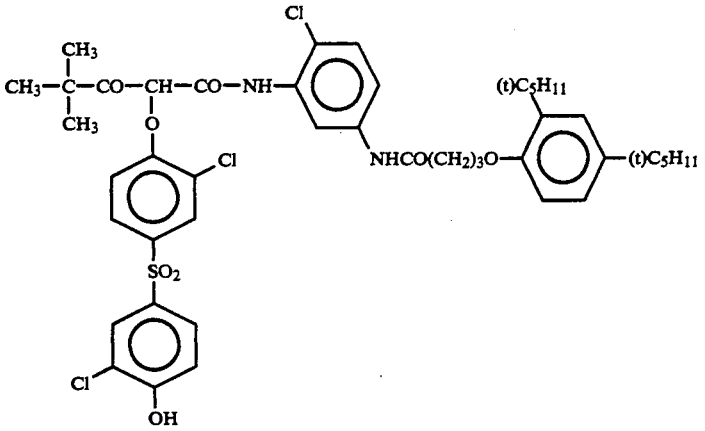
(Y-4)
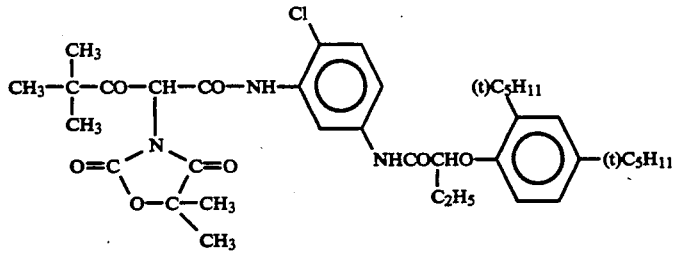
(Y-5)
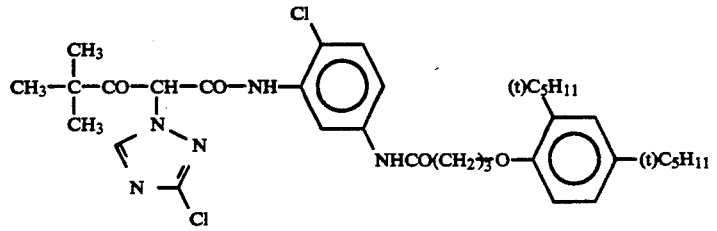

-continued (Y-6)

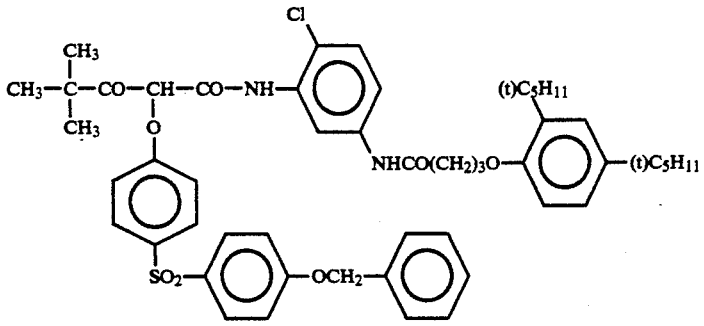

(Y-7)

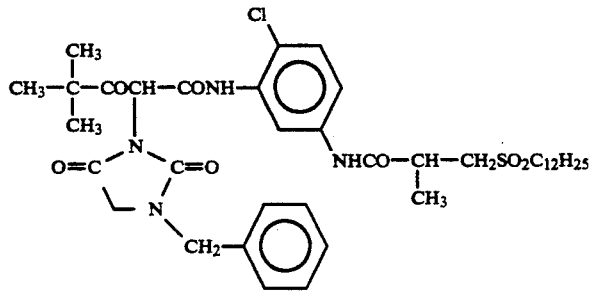

(Y-8)

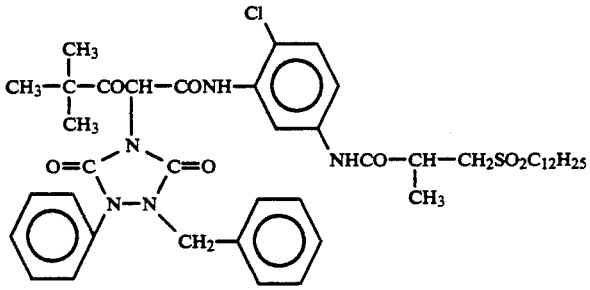

(Y-9)

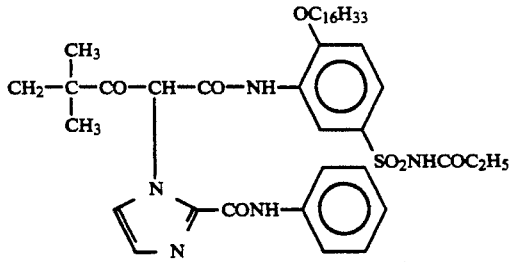

The magenta coupler and yellow coupler described above are incorporated into a silver halide emulsion layer which form a light-sensitive layer in an amount ranging generally from 0.1 to 1.0 mole, preferably from 0.1 to 0.5 mole per mole of silver halide, respectively.

In the present invention, the above-described couplers, may be added to light-sensitive silver halide emulsion layers through any of various known techniques. Usually, they can be added according to an oil-droplet-in-water dispersion method known as an oil protected process. For example, couplers are first dissolved in a solvent, and then emulsified and dispersed in a gelatin aqueous solution containing a surface active agent. Alternatively, water or a gelatin aqueous solution may be added to a coupler solution containing a surface active agent, followed by phase inversion to obtain an oil-droplet-in-water dispersion. Further, alkali-soluble couplers may also be dispersed according to a so-called Fischer's dispersion process. The coupler dispersion may be subjected to distillation, noodle washing, ultrafiltration, or the like to remove an organic solvent having a low boiling point and then mixed with a photographic emulsion.

As the dispersion medium of the couplers, it is preferred to employ an organic solvent having a high boiling point which has a dielectric constant of 2 to 20 (at 25° C.) and a refractive index of 1.5 to 1.7 (at 25° C.) and/or a water-insoluble polymer compound.

As the organic solvent having a high boiling point which can be employed, any compound which has a melting point of 100° C. or lower and a boiling point of 140° C. or higher and which is immiscible with water and a good solvent for the coupler may be utilized, in addition to the above described solvents represented by formulae (IIs), (IIIs), (IVs), (Vs), (VIs) and (VIIs).

The organic solvents having a high boiling point are described in detail in JP-A-62-215272, page 137, right lower column to page 144, right upper column.

Further, these couplers can be emulsified and dispersed in an aqueous solution of a hydrophilic colloid by loading them into a loadable latex polymer (such as those described in U.S. Pat. No. 4,203,716) in the presence of or in the absence of the above described organic solvent having a high boiling point.

The color photographic light-sensitive material according to the present invention may contain a color fog preventing agent, such as, for example, a hydroquinone derivative, an aminophenol derivative, a gallic acid derivative, and an ascorbic acid derivative.

In the color photographic light-sensitive material according to the present invention, various color fading preventing agents can be employed. More specifically, representative examples of organic color fading preventing agents for cyan, magenta and/or yellow images include hindered phenols (for example, hydroquinones, 6-hydroxychromans, 5-hydroxycoumarans, spirochromans, p-alkoxyphenols, or bisphenols), gallic acid derivatives, methylenedioxybenzenes, aminophenols, hindered amines, or ether or ester derivatives thereof derived from each of these compounds by sililation or alkylation of the phenolic hydroxy group thereof. Further, metal complexes representatively illustrated by (bissalicylaldoxymate) nickel complex and (bis-N,N-dialkyldithiocarbamate) nickel complexes may be employed.

Specific examples of the organic color fading preventing agents are described in the following documents.

Hydroquinones: U.S. Pat. Nos. 2,360,290, 2,418,613, 2,700,453, 2,701,197, 2,728,659, 2,732,300, 2,735,765, 3,982,944 and 4,430,425, British Patent 1,363,921, U.S. Pat. Nos. 2,710,801 and 2,816,028; 6-hydroxychromanes, 5-hydroxycoumaraus and spirochromanes: U.S. Pat. Nos. 3,432,300, 3,573,050, 3,574,627, 3,698,909 and 3,764,337, JP-A-52-152225; spiroindanes: U.S. Pat. No. 4,360,589; p-alkoxyphenols: U.S. Pat. No. 2,735,765, British Patent 2,066,975, JP-A-59-10539, JP-B-57-19765, etc.; hindered phenols: U.S. Pat. No. 3,700,455, JP-A-52-72224, U.S. Pat. No. 4,228,235, JP-B-52-6623; gallic acid derivatives, methylenedioxybenzenes and aminophenols: U.S. Pat. Nos. 3,457,079 and 4,332,886, JP-B-56-21144; hindered amines: U.S. Pat. Nos. 3,336,135 and 4,268,593, British Patents 1,326,889, 1,354,313 and 1,410,846, JP-B-51-1420, JP-A-58-114036, JP-A-59-53846, and JP-A-59-78344.

Further, specific examples of the metal complexes are described in U.S. Pat. Nos. 4,050,938 and 4,241,155, and British Patent 2,027,731(A), The color fading preventing agent is co-emulsified with the corresponding color coupler in an amount of from 5 to 100% by weight of the color coupler and incorporated into the light-sensitive layer to achieve the effects thereof.

In order to prevent the degradation of a cyan dye image due to heat and particularly due to light, an ultraviolet light absorbing agent can be introduced into a cyan color forming layer or both layers adjacent to the cyan color forming layer.

Suitable examples of the ultraviolet light absorbing agents used include aryl group-substituted benzotriazole compounds (for example, those as described in U.S. Pat. No. 3,533,794), 4-thiazolidone compounds (for example, those as described in U.S. Pat. Nos. 3,314,794 and 3,352,681), benzophenone compounds (for example, those as described in JP-A-46-2784), cinnamic acid ester compounds (for example, those as described in U.S. Pat. Nos. 3,705,805 and 3,707,395), butadiene compounds (for example, those as described in U.S. Pat. No. 4,045,229), and benzoxazole compounds (for example, these are described in U.S. Pat. Nos. 3,406,070, 3,677,672 and 4,271,307). Furthermore, ultraviolet light absorptive couplers (for example, α-naphtholic cyan dye forming couplers) or ultraviolet light absorptive polymers may be used as ultraviolet light absorbing agents. These ultraviolet light absorbing agents may be mordanted in a specific layer.

Among these ultraviolet light absorbing agents, the aryl group-substituted benzotriazole compounds described above are preferred.

In accordance with the present invention, it is preferred to employ the compounds as described below together with the above described couplers, particularly pyrazoloazole couplers. More specifically, to employ individually, or in combination, a compound (F) which is capable of forming a chemical bond with the aromatic amine developing agent remaining after color development to give a chemically inactive and substantially colorless compound and/or a compound (G) which is capable of forming a chemical bond with the oxidation product of the aromatic amine developing agent remaining after color development to give a chemically inactive and substantially colorless compound is preferred in order to prevent the occurrence of stain and other undesirable side-effects due to the formation of colored dye upon a reaction of the color developing agent or oxidation product thereof which remains in the photographic layer with the coupler during preservation of the photographic material after processing.

Among the compounds (F), those capable of reacting at a second order reaction rate constant $k_2$ (in trioctyl phosphate at 80° C.) with p-anisidine of from 1.0 liter/mol·sec. to $1\times10^{-5}$ liter/mol·sec. are preferred. The second order reaction rate constant can be measured by a method as described in JP-A-63-158545.

When the constant $k_2$ is larger than this range, the compounds are per se unstable and may decompose by reacting with gelatin or water. On the other hand, when the constant $k_2$ is smaller than the above described range, the reaction rate in the reaction with the remaining aromatic amine developing agent is low, and as a result, reduces the degree of prevention of the side-effect caused by the remaining aromatic amine developing agent.

Of the Compounds (F), preferred are those represented by formula (FI) or (FII):

$$R_1-(A)_n-X \quad \text{(FI)}$$

$$R_2-\underset{\underset{B}{|}}{C}\equiv Y \quad \text{(FII)}$$

wherein $R_1$ and $R_2$ each represents an aliphatic group, an aromatic group or a heterocyclic group; n represents 0 or 1; A represents a group capable of reacting with an aromatic amine developing agent to form a chemical bond; X represents a group capable of being released upon the reaction with an aromatic amine developing agent; B represents a hydrogen atom, an aliphatic group, an aromatic group, a heterocyclic group, an acyl group or a sulfonyl group; Y represents a group capable of accelerating the addition of an aromatic amine developing agent to the compound represented by formula (FII); or $R_1$ and X, or Y and $R_2$ or B may combine to form a cyclic structure.

Of the reactions for forming a chemical bond with the remaining aromatic amine developing agent, a substitution reaction and an addition reaction are typical reactions.

Specific preferred examples of the compounds represented by formulae (FI) or (FII) are described, for example, in JP-A-63-158545, JP-A-62-283338, European Patent (OPI) Nos. 298,321 and 277,589.

On the other hand, of the Compounds (G) capable of forming a chemical bond with the oxidation product of the aromatic amine developing agent remaining after color development processing to give a chemically inactive and substantially colorless compound, preferred are those represented by formula (GI):

$$R\text{-}Z \qquad \text{(GI)}$$

wherein R represents an aliphatic group, an aromatic group or a heterocyclic group; and Z represents a nucleophilic group or a group capable of being decomposed in the photographic material to release a nucleophilic group.

Of the compounds represented by formula (GI), those wherein Z is a group having a Pearson's nucleophilic $^{n}CH_3I$ value of at least 5 (R. G. Pearson et al., *J. Am. Chem. Soc.*, Vol. 90, page 319 (1968)) or a group derived therefrom, are preferred.

Specific preferred examples of the compounds represented by formula (GI) are described, for example, in European Patent (OPI) No. 255,722, JP-A-62-143048, JP-A-62-229145, JP-A-1-230039, JP-A-1-57259, European Patent (OPI) Nos. 298,321 and 277,589.

Further, combinations of Compound (G) and Compound (F) are described in detail in European Patent (OPI) No. 277,589.

The photographic light-sensitive material according to the present invention may contain water-soluble dyes or dyes which become water-soluble at the time of photographic processing as filter dyes or for irradiation or halation prevention or other various purposes in the hydrophilic colloid layers. Examples of such dyes include oxonol dyes, hemioxonol dyes, styryl dyes, merocyanine dyes, cyanine dyes, and azo dyes. Of these dyes, oxonol dyes, hemioxonol dyes, and merocyanine dyes are particularly useful.

As binders or protective colloids which can be used for the emulsion layers of the color photographic light-sensitive material according to the present invention, gelatin is advantageously used, but other hydrophilic colloids can be used alone or together with gelatin.

As gelatin, lime-treated gelatin or acid-treated gelatin can be used in the present invention. Details of the production of gelatin are described in Arther Weiss, *The Macromolecular Chemistry of Gelatin*, published by Academic Press, 1964.

The support which can be used in the present invention, include those conventionally employed in photographic light-sensitive materials, for example, transparent films such as cellulose nitrate films and polyethylene terephthalate films, or reflective supports. For the purpose of the present invention, reflective supports are preferably employed.

The term "reflective support" which can be employed in the present invention means a support having an increased reflection property for the purpose of rendering dye images formed in the silver halide emulsion layer clear. Examples of the reflective support include a support having coated thereon a hydrophobic resin containing a light reflective substance such as titanium oxide, zinc oxide, calcium carbonate, or calcium sulfate dispersed therein and a support composed of a hydrophobic resin containing a light reflective substance dispersed therein. More specifically, they include baryta coated paper; polyethylene coated paper; polypropylene type synthetic paper; transparent supports, for example, a glass plate, a polyester film such as a polyethylene terephthalate film, a cellulose triacetate film or a cellulose nitrate film, a polyamide film, a polycarbonate film, a polystyrene film, or a vinyl chloride resin, having a reflective layer or having incorporated therein a reflective substance.

Other examples of the reflective support which can be used are supports having a metal surface of mirror reflectivity or secondary diffuse reflectivity. The metal surface preferably has a spectral reflectance of 0.5 or more in the visible wavelength range. The metal surface are preferably produced by roughening or imparting diffusion reflectivity using metal powders. Suitable examples of metals include aluminum, tin, silver, magnesium or an alloy thereof. The metal surface includes a metal plate, a metal foil or a metal thin layer obtained by rolling, vacuum evaporation or plating. Among them, a metal surface obtained by vacuum evaporation of metal on other substrate is preferably employed.

On the metal surface it is preferred to provide a water-proof resin layer, particularly a thermoplastic resin layer. On the opposite side of the support to the metal surface according to the present invention, an antistatic layer is preferably provided. Details of these supports are described, for example, in JP-A-61-210346, JP-A-63-24247, JP-A-63-24251 and JP-A-63-24255.

A suitable support can be appropriately selected depending on the desired use.

As the light reflective substance, white pigments thoroughly kneaded in the presence of a surface active agent are employed, and pigments the surface of which was treated with a dihydric, trihydric or tetrahydric alcohol are preferably used.

The occupied area ratio (%) per a definite unit area of fine white pigment particles can be determined, for example, by the following typical manner. Specifically, the area observed is divided into the unit area of 6 $\mu m \times 6$ $\mu m$ adjacent to each other, and the occupied area ratio (Ri) (%) of the fine particle projected on the unit area is measured. The coefficient of variation of the occupied area ratio (%) can be obtained by a ratio of $S/\overline{R}$ wherein S is a standard deviation of Ri and $\overline{R}$ is an average value of Ri. A number (n) of the unit area subject is preferably 6 or more. Thus, the coefficient of variation ($S/\overline{R}$) is obtained by the following equation:

$$\sqrt{\frac{\sum_{i=1}^{n} (Ri - \overline{R})^2}{n-1}} \Big/ \frac{\sum_{i=1}^{n} Ri}{n}$$

In the present invention, the coefficient of variation of the occupied area ratio (%) of fine pigment particles is preferably not more than 0.15, particularly preferably not more than 0.12. When the value is not more than 0.08, the dispersibility of particles can be designated as substantially uniform.

The color photographic light-sensitive material according to the present invention is preferably subjected to color development, bleach-fixing and water washing processing or stabilizing processing. Bleaching and fixing can alternatively be performed individually as opposed to the above described mono-bath processing.

The color developing solution used in the present invention contains a known aromatic primary amine color developing agent. Preferred examples thereof are p-phenylenediamine derivatives. Typical examples of the p-phenylenediamine derivative used are set forth below, but the present invention should not be limited thereto.

D-1: N,N-Diethyl-p-phenylenediamine
D-2: 2-Amino-5-diethylaminotoluene
D-3: 2-Amino-5-(N-ethyl-N-laurylamino)toluene
D-4: 4-[N-Ethyl-N-(β-hydroxyethyl)amino]aniline
D-5: 2-Methyl-4-[N-ethyl-N-(β-hydroxyethyl-)amino]aniline
D-6: 4-Amino-3-methyl-N-ethyl-N-[β-(methanesulfonamido)ethyl]aniline
D-7: N-(2-Amino-5-diethylaminophenylethyl)methanesulfonamide
D-8: N,N-Dimethyl-p-phenylenediamine
D-9: 4-Amino-3-methyl-N-ethyl-N-methoxyethylaniline
D-10: 4-Amino-3-methyl-N-ethyl-N-β-ethoxyethylaniline
D-11: 4-Amino-3-methyl-N-ethyl-N-β-butoxyethylaniline Of these p-phenylenediamine derivatives, 4-amino-3-methyl-N-ethyl-N-[β-(methanesulfonamido)ethyl]aniline (D-6) is particularly preferred.

These p-phenylenediamine derivatives may be in the form of salts such as sulfates, hydrochlorides, sulfites, or p-toluenesulfonates.

The aromatic primary amine developing agent is used in an amount of from about 0.1 g to about 20 g and preferably from about 0.5 g to about 10 g per liter of the developing solution.

According to the present invention, it is preferred to use the color developing solution which does not substantially contain benzyl alcohol. The terminology "color developing solution which does not substantially contain benzyl alcohol" as used herein means that the color developing solution contains preferably not more than 2 ml, more preferably not more than 0.5 ml, and most preferably no benzyl alcohol, per liter of the solution.

The color developing solution used in the present invention more preferably does not contain any substantial amounts of sulfite ion. While the sulfite ion acts as a preservative for the color developing agent, it has a silver halide solubilizing function and also reacts with the oxidation product of color developing agent to decrease dye forming efficiency. These functions are considered as one of the reasons which cause the fluctuations of photographic performance due to a continuous processing. The terminology "color developing solution does not contain any substantial amounts of sulfite ion" as used herein means that the color developing solution has preferably a sulfite ion concentration of not more than $3.0\times10^{-3}$ mol per liter of the solution. It is most preferred that the color developing solution does not contain any sulfite ion, with the exception that in the present invention, a very small amount of sulfite ion which is used as an antioxidant in a processing agent kit containing the concentrated color developing agent for the preparation of processing solution to be used.

The color developing solution used in the present invention preferably does not contain substantial amounts of hydroxylamine. This is because hydroxylamine has both a function as a preservative for the developing solution and an activity of developing silver, and it is believed that the fluctuation of concentration of hydroxylamine greatly influences the photographic performance. The terminology "color developing solution does not contain substantial amounts of hydroxylamine" as used herein means that the color developing solution has preferably hydroxylamine concentration of not more than $5.0\times10^{-3}$ mol per liter of solution. It is most preferred that the color developing solution does not contain hydroxylamine at all.

The color developing solution used in the present invention preferably contains an organic preservative in place of the above described hydroxylamine and sulfite ion. The term "organic preservative" as used herein means any organic compound which can reduce a degradation rate of the aromatic primary amine color developing agent when it is added to a processing solution for the color photographic materials. More specifically, it includes organic compounds which have a function of preventing the oxidation of color developing agent by the air or the like. Among them, hydroxylamine derivatives (excepting hydroxylamine), hydroxamic acids, hydrazines, phenols, α-hydroxyketones, α-aminoketones, saccharides, monoamines, diamines, polyamines, quaternary ammonium salts, nitroxy radicals, alcohols, oximes, diamide compounds, and condensed ring amines are particularly effective organic preservatives. Specific examples thereof are described, for example, in JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, U.S. Pat. Nos. 3,651,503 and 2,494,903, JP-A-52-143020, and JP-B-48-30496.

Other preservatives such as various metals described in JP-A-57-44148 and JP-A-57-53749, salicylic acids described in JP-A-59-180588, alkanolamines described in JP-A-54-3532, polyethyleneimines described in JP-A-56-94349, or aromatic polyhydroxy compounds described in U.S. Pat. No. 3,746,544, may be incorporated into the color developing solution, if desired. Particularly, the addition of alkanol amines such as triethanolamine, dialkylhydroxylamines such as diethylhydroxylamine hydrazine derivatives or aromatic polyhydroxy compounds is preferred.

Of the above described organic preservatives, hydroxylamine derivatives and hydrazine derivatives (hydrazines and hydrazides) are particularly preferred and described in detail, for example, in JP-A-1-97953, JP-A-1-186939, JP-A-1-186940 and JP-A-1-187557.

Further, it is more preferred that the above described hydroxylamine derivative or hydrazine derivative is used in combination with an amine in view of improvement in stability of the color developing solution, and as a result, improvement in stability during continuous processing. The above described amines include cyclic amines as described in JP-A-63-239447, amines as described in JP-A-63-128340, and amines as described in JP-A-1-186939 and JP-A-1-187557.

In the present invention, the color developing solution preferably contains a chloride ion in a range of from $3.5\times10^{-2}$ to $1.5\times10^{-1}$ mol per liter, particularly from $4\times10^{-2}$ to $1\times10^{-1}$ mol per liter of the solution.

When the chloride ion concentration is more than $1.5\times10^{-1}$ mol per liter, development tends to be retarded, and thus it is not preferred to achieve the object of the present invention where the high maximum density is provided by a rapid processing. On the other hand, the chloride ion concentration of less than $3.5\times10^{-2}$ mol per liter is not preferred in view of prevention of fog formation.

Also, the color developing solution used in the present invention preferably contains a bromide ion in a range of from $3.0\times10^{-5}$ to $1.0\times10^{-3}$ mol per liter, more preferably from $5.0\times10^{-5}$ to $5\times10^{-4}$ mol per liter of the solution. When the bromide ion concentration is more than $1\times10^{-3}$ mol per liter, development tends to be retarded and the maximum density and sensitivity may decrease. On the other hand, when it is less than $3.0\times10^{-5}$ mol per liter, it is difficult to sufficiently prevent fog formation.

The chloride ions and bromide ions can be directly added to the color developing agent or may be released from the light-sensitive material during development processing.

In case of directly adding to the color developing solution, suitable examples of compounds which supply a chloride ion include sodium chloride, potassium chloride, ammonium chloride, lithium chloride, nickel chloride, magnesium chloride, manganese chloride, calcium chloride, and cadmium chloride. Among them, sodium chloride and potassium chloride are preferred. Also, it may be supplied from a fluorescent brightening agent added to the color developing solution.

Suitable examples of compounds which supply a bromide ion include sodium bromide, potassium bromide, ammonium bromide, lithium bromide, calcium bromide, magnesium bromide, manganese bromide, nickel bromide, cadmium bromide, cerium bromide, and thallium bromide. Among them, potassium bromide and sodium bromide are preferred.

When the chloride ion and bromide ion are supplied from the light-sensitive material during development processing, they may be supplied from silver halide emulsions or from other additives in the light-sensitive material.

The color developing solution used in the present invention has a pH which ranges preferably from 9 to 12 and more preferably from 9 to 11.0. The color developing solution may also contain any of the compounds that are known to be usable as components of developing solutions.

In order to maintain the pH in the above-described range, various kinds of buffers are preferably employed. Suitable examples of these buffers include carbonates, phosphates, borates, tetraborates, hydroxybenzoates, glycine salts, N,N,-dimethylglycine salts, leucine salts, norleucine salts, guanine salts, 3,4-dihydroxyphenylalanine salts, alanine salts, aminobutyrate, 2-amino-2-methyl-1,3-prepanediol salts, valine salts, proline salts, trishydroxyaminomethane salts, and lysine salts.

Particularly, carbonate, phosphates, tetraborates, and hydroxybenzoates are preferably employed since they are excellent in solubility and in buffering function at a high pH range greater than 9.0, and they do not have an adverse affect on photographic performance (for example, fog formation) when they are added to the color developing solution, and they are available at low cost.

Specific examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). The present invention, however, should not be limited to these compounds.

The amount of the buffer to be added to the color developing solution is preferably 0.1 mol or more and more preferably from 0.1 mol to 0.4 mol per liter thereof.

In addition, various chelating agents can be used in the color developing solution according to the present invention for the purpose of preventing calcium or magnesium precipitation or increasing the stability of the color developing solution.

Specific examples of the chelating agents used are set forth below, but the present invention should not be limited thereto.

Nitrilotriacetic acid
Diethylenetriaminopentaacetic acid
Ethylenediaminetetraacetic acid
N,N,N-Trimethylenephosphonic acid
Ethylenediamine-N,N,N',N'-tetramethylenephosphonic acid
Trans-cyclohexanediaminetetraacetic acid
1,2-Diaminopropanetetraacetic acid
Glycol ether diaminetetraacetic acid
Ethylenediamine-o-hydroxyphenylacetic acid
2-Phosphonobutane-1,2,4-tricarboxylic acid
1-Hydroxyethylidene-1,1-diphosphonic acid
N,N'-Bis(2-hydroxybenzyl)ethylenediamine-N,N'-diacetic acid Two or more kinds of such chelating agents may be employed together, if desired.

The chelating agent is added to the color developing solution in an amount sufficient to block metal ions present therein. For example, a range of from about 0.1 g to about 10 g per liter of the color developing solution is employed.

The color developing solution may contain appropriate development accelerators, if desired. Examples of suitable development accelerators include thioether type compounds described in JP-B-37-16088, JP-B-37-5987, JP-B-38-7826, JP-B-44-12380, JP-B-45-9019 and U.S. Pat. No. 3,813,247; p-phenylenediamine type compounds described in JP-A-52-49829 and JP-A-50-15554; quaternary ammonium salts described in JP-A-50-137726, JP-B-44-30074, JP-A-56-156826 and JP-A-52-43429; amine type compounds described in U.S. Pat. Nos. 2,494,903, 3,128,182, 4,230,796, 3,253,919, 2,482,546, 2,596,926, and 3,582,346 and JP-B-41-11431; polyalkylene oxides described in JP-B-37-16088, JP-B-42-25201, U.S. Pat. No. 3,128,183, JP-B-41-11431, JP-B-42-23883 and U.S. Pat. No. 3,532,501; 1-phenyl-3-pyrazolidones; and imidazoles.

The color developing solution used in the present invention may contain appropriate antifoggants, if desired. Alkali metal halides such as sodium chloride, potassium bromide, and potassium iodide as well as organic antifoggants may be employed as antifoggants. Representative examples of organic antifoggants include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine and adenine.

It is preferred that the color developing solution according to the present invention contains fluorescent brightening agents. As fluorescent brightening agents, 4,4'-diamino-2,2'-disulfostilbene type compounds are preferred. The amount of the fluorescent brightening agent added is from 0 to 5 g and preferably from 0.1 g to 4 g per liter of the color developing solution.

Furthermore, the color developing solution according to the present invention may contain various surface active agents such as alkylsulfonic acids, arylsulfonic acids, aliphatic carboxylic acids, and aromatic carboxylic acids, if desired.

The processing temperature of the color development step used in the present invention is usually from 20° C. to 50° C. and preferably from 30° C. to 40° C. The processing time is usually from 20 sec. to 5 min. and preferably from 30 sec. to 2 min. Further, the amount of a replenisher for the color developing solution is preferably as small as possible, and is usually from 20 ml to 600 ml, preferably from 50 ml to 300 ml, and more preferably from 60 ml to 200 ml, and most preferably from 60 ml to 150 ml per square meter of the color photographic light-sensitive material.

The desilver step used in the present invention can be conducted using any general step(s) including a bleaching step-fixing step, fixing step-bleach-fixing step, bleaching step-bleach-fixing step, and bleach-fixing step.

Bleaching agents used in the bleaching solutions or the bleach-fixing solutions include any conventional bleaching agents. Organic complex salts of iron (III), for example, complex salts of aminopolycarboxylic acids (e.g., ethylenediaminetetraacetic acid, or diethylenetriaminepentaacetic acid), aminopolyphosphonic acids, phosphonocarboxylic acids and organic phosphonic acids, or complex salts of organic acids (e.g., citric acid, tartaric acid, or malic acid), persulfates and hydrogen peroxide are preferably used. Of these compounds, organic acid complex salts of iron (III) are particularly preferred in view of a rapid processing and prevention of environmental pollution.

Specific examples of useful aminopolycarboxylic acids, aminopolyphosphonic acids and organic phosphonic acids suitable for forming organic complex salts of iron (III) are set forth below.

Ethylenediaminetetraacetic acid
Diethylenetriaminepentaacetic acid
1,3-Diaminopropanetetraacetic acid
Propylenediaminetetraacetic acid
Nitrilotriacetic acid
Cyclohexanediaminetetraacetic acid
Methyliminodiacetic acid
Iminodiacetic acid
Glycol ether diaminetetraacetic acid These compounds may be in the form of salt such as sodium, potassium, lithium or ammonium.

Of these compounds, iron (III) complex salt of ethylenediaminetetraacetic acid, diethylenetriaminepentaacetic acid, cyclohexanediaminetetraacetic acid, 1,3-diaminopropanetetraacetic acid or methyliminodiacetic acid are preferred because of their high bleaching ability.

The ferric ion complex salts may be used in the form of a complex salt per se or may be formed in situ by using a ferric salt (e.g., ferric sulfate, ferric chloride, ferric nitrate, ferric ammonium sulfate or ferric phosphate) and a chelating agent (e.g., an aminopolycarboxylic acid, an aminopolyphosphonic acid or a phosphonocarboxylic acid). Further, a chelating agent may be used in an excess amount of that being necessary for forming a ferric ion complex salt.

Of the ferric complex salts, aminopolycarboxylic acid ferric complex salts are preferred.

The amount of the ferric iron complex salt in the solution is from 0.01 mol to 1.0 mol, preferably from 0.05 mol to 0.50 mol per liter of the solution.

In the bleaching solution, bleach-fixing solution, and/or a prebath thereof, various kinds of compounds can be used as bleach accelerating agents. Specific examples of suitable bleach accelerating agents include compounds having a mercapto group or a disulfide bond as described, for example, in U.S. Pat. No. 3,893,858, West German Patent 1,290,812, JP-A-53-95630, *Research Disclosure,* No. 17129 (July, 1978); thiourea type compounds as described, for example, in JP-B-45-8506, JP-A-52-20832, JP-A-53-32735 and U.S. Pat. No. 3,706,561; and halides such as iodine ions, or bromine ions. These compounds are preferred in view of their large bleaching ability.

The bleaching solution or bleach-fixing solution used in the present invention can contain rehalogenating agents such as bromides (e.g., potassium bromide, sodium bromide, ammonium bromide), chlorides (e.g., potassium chloride, sodium chloride, or ammonium chloride) or iodides (e.g., ammonium iodide). Further, one or more kinds of inorganic acids, organic acids, alkali metal salts thereof or ammonium salts thereof which have a pH buffering ability (e.g., boric acid, sodium metaborate, acetic acid, sodium acetate, sodium carbonate, potassium carbonate, phosphorous acid, phosphoric acid, sodium phosphate, citric acid, sodium citrate, or tertaric acid), corrosion preventing agents (e.g., ammonium nitrate, or guanidine) may be added, if desired.

As fixing agents which can be employed in the bleaching solution or bleach-fixing solution, known fixing agents such as thiosulfates (e.g., sodium thiosulfate, or ammonium thiosulfate), thiocyanates (e.g., sodium thiocyanate, or ammonium thiocyanate), thioether compounds (e.g., ethylenebisthioglycolic acid, 3,6-dithia-1,8-octanediol), and water-soluble silver halide dissolving agents (e.g., thioureas) are exemplified. They are employed individually or in a combination of two or more thereof. In addition, a special bleach-fixing solution comprising a combination of fixing agent and a large amount of a halide compound such as potassium iodide described in JP-A-55-155354 can be used as well. A thiosulfate, particularly ammonium thiosulfate is preferably employed.

The amount of fixing agent to be used in the solution is preferably from 0.3 mol to 2 mol, and more preferably from 0.5 mol to 1.0 mol per liter of the solution.

The pH of the bleach-fixing solution or fixing solution used in the present invention is preferably from 3 to 10, and more preferably from 5 to 9.

Further, various kinds of fluorescent brightening agent, defoaming agents and surface active agents, polyvinyl pyrrolidone, or organic solvents (e.g., methanol) may be incorporated into the bleach-fixing solution.

The bleach-fixing solution or fixing solution used in the present invention can contain, as preservatives, compounds capable of releasing sulfite ions such as sulfites (e.g., sodium sulfite, potassium sulfite, or ammonium sulfite), bisulfites (e.g., ammonium bisulfite, sodium bisulfite, or potassium bisulfite), or metabisulfites (e.g., potassium metabisulfite, sodium metabisulfite, or ammonium metabisulfite). The amount of such a compound to be added is preferably from about 0.02 mol to about 0.50 mol, and more preferably from 0.04 mol to 0.40 mol per liter of the solution calculated in terms of a sulfite ion.

While sulfites can be added as preservatives, other compounds such as ascorbic acid, a carbonylbisulfite acid adduct, or a carbonyl compound may be added.

Further, buffers, fluorescent brightening agents, chelating agents, deforming agents, or antimold agents may be added, if desired.

After a desilvering processing such as fixing or bleach-fixing, the silver halide color photographic material according to the present invention is generally subjected to a water washing step and/or a stabilizing step.

An amount of water required for the water washing step may be set in a wide range depending on characteristics of photographic light-sensitive materials (due to components used therein, for example, couplers), uses thereof, temperature of washing water, the number of water washing tanks (stages), a replenishment system such as countercurrent or orderly current, or other various conditions. A relationship between a number of water washing tanks and an amount of water in a multistage countercurrent system can be determined based on the method as described in *Journal of the Society of Motion Picture and Television Engineers*, Vol. 64, pages 248 to 253 (May, 1955). Ordinarily, the number of stag :s used in the multistage countercurrent system is preferably from 2 to 6, particularly from 2 to 4.

Through the use of a multistage countercurrent system, the amount of water for washing can be significantly reduced. For example, it is possible to use 0.5 to 1 liter or less per m2 of the photographic light-sensitive material. However, an increase in staying time of water in a tank causes propagation of bacteria and some problems such as adhesion of floatage formed on the photographic materials occur. In the processing of the silver halide color photographic material according to the present invention, a method for reducing amounts of calcium and magnesium as described in JP-A-62-288838 can be effectively employed in order to solve such problems. Further, sterilizers, for example, isothiazolone compounds and thiabendazoles as described in JP-A-57-8542, chlorine type sterilizers such sodium chloroisocyanurate described in JP-A-61-120145, benzotriazoles described in JP-A-61-267761, copper ions, sterilizers described in Hiroshi Horiguchi, *Bokin-Bobai No Kagaku* Sankyo Shuppan (1986), *Biseibutsu No Mekkin-, Sakiin-, Bobai-Gijutsu*, edited by Eiseigijutsu Kai (1982), or *Bokin-Bobaizai Jiten*, edited by Nippon Bokin-Bobai Gakkai (1986) can be employed.

Moreover, surface active agents as agents for uniform drying, and chelating agents representatively illustrated by EDTA as water softeners may be employed in washing water.

Following the above described water washing step or without conducting the water washing step, the color photographic material can be treated with a stabilizing solution. Compounds having a function of stabilizing images can be added to the stabilizing solution. These compounds include, for example, aldehyde compounds representatively illustrated by formalin, buffers for adjusting pH of layer to a value suitable for stabilization of dyes formed, or ammonium compounds. Further, various sterilizers or antimolds as described above can be employed in the stabilizing solution in order to prevent the propagation of bacteria in the solution and impart antimold property to the photographic material after processing. Moreover, surface active agents, fluorescent whitening agents, or hardener may be added to the stabilizing solution.

The photographic light-sensitive material of the present invention can be directly subjected to stabilizing processing without conducting the water washing step. In such a case, any of known methods as described, for example, in JP-A-57-8543, JP-A-58-14834 and JP-A-60-220345 can be employed.

Further, a chelating agent such as 1-hydroxyethylidene-1,1-diphosphonic acid, or ethylenediaminetetramethylenephosphonic acid, a magnesium compound, or a bismuth compound may be preferably employed.

In the present invention, a so-called rinse solution may also be used as a water washing solution or stabilizing solution employed after the silver removing step.

The pH of washing water or stabilizing solution used in the processing of the photographic light-sensitive material according to the present invention is usually from 4 to 10 and preferably from 5 to 8. The temperature therefor can be set in a wide range depending on characteristics of photographic light-sensitive materials, or uses thereof. It is selected usually in a range from 15° C. to 45° C., preferably from 20° C. to 40° C. The processing time for the step can also be set appropriately, but it is desirable to set the time short in order to reduce the processing time. Thus, it is preferably from 15 sec. to 1 min. 45 sec., more preferably from 30 sec. to 1 min. 30 sec.

It is preferred that the amount of replenishment is small in view of the reduction of running cost, the reduction of amount of discharge and associated handling properties.

Specific amount of replenishment is preferably from 0.5 to 50 times, more preferably from 3 to 40 times the amount of processing solution carried over from the preceding bath per a unit area of the photographic light-sensitive material. Alternatively, it is not more than 1 liter, preferably not more than 500 ml per $m^2$ of the photographic light-sensitive material. Further, the replenishment can be conducted either continuously or intermittently.

The solutions used in the water washing step and/or stabilizing step can be utilized in preceding steps. For instance, overflow from the washing water in a multistage countercurrent system is introduced into a bleach-fixing bath which is a preceding bath and a concentrated solution is supplied to the bleach-fixing solution whereby an amount of discharge is reduced.

In accordance with the present invention, a silver halide color photographic material is provided which can be rapidly processed, and in which color restoration failure of cyan dye image is improved and destruction of color balance of images after processing is prevented.

The present invention is illustrated in greater detail with reference to the following examples, but the present invention should not be limited thereto.

EXAMPLE 1

On a paper support, both surfaces of which were laminated with polyethylene, were coated layers as shown below in order to prepare a multilayer color printing paper which was designated Sample 101. The coating solutions were prepared in the following manner.

Preparation of Coating Solution for First Layer 19.1 g of Yellow coupler (ExY), 4.4 g of Color image stabilizer (Cpd-1) and 0.7 g of Color image stabilizer (Cpd-7) were dissolved in a mixture of 27.2 ml of ethyl acetate and 8.2 ml of Solvent (Solv-1) and the resulting solution was emulsified and dispersed in 185 ml of a 10% aqueous solution of gelatin containing 8 ml of a 10% aqueous solution of sodium dodecylbenzenesulfonate. Separately, to a silver chlorobromide emulsion (cubic grains, mixture of two emulsions having average grain size of 0.88 μm and 0.70 μm in 3:7 by molar ratio of silver, coefficient of variation of grain size: 0.08 and 0.10, respectively, 0.2 mol % silver bromide based on the whole of grains being localized at the surface of grains, respectively) were added two blue-sensitive sensitizing dyes shown below in an amount of each $2.0\times10^{-4}$ mol per mol of silver in case of the larger grain size emulsion and in an amount of each $2.5\times10^{-4}$ mol per mol of silver in case of the smaller grain size emulsion, and the emulsion was then subjected to sulfur sensitization. The above described emulsified dispersion was mixed with the silver chlorobromide emulsion, with the concentration of the resulting mixture being controlled to form the composition shown below, whereby the coating solution for the first layer was prepared.

Coating solutions for the second layer to the seventh layer were prepared in a similar manner as described for the coating solution for the first layer.

1-Oxy-3,5-dichloro-s-triazine sodium salt was used as a gelatin hardener in each layer.

The following spectral sensitizing dyes were employed in the emulsion layers, respectively.

Blue-Sensitive Emulsion Layer

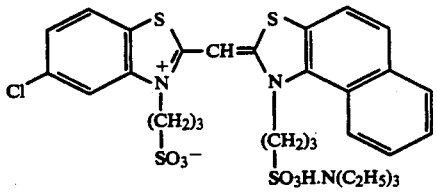

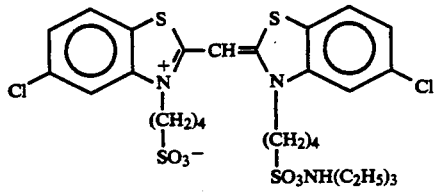

(Amount added of each compound: $2.0\times10^{-4}$ mol per mol of silver halide in the larger grain size emulsion and $2.5\times10^{-4}$ mol per mol of silver halide in the smaller grain size emulsion)

GREEN-SENSITIVE EMULSION LAYER

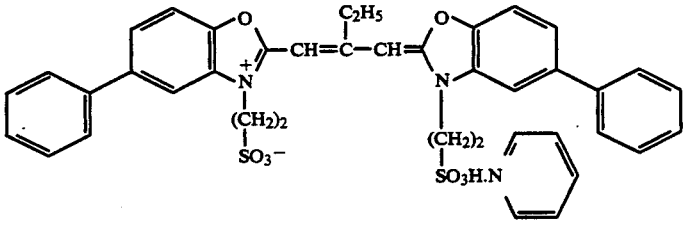

(Amount added: $4.0\times10^{-4}$ mol per mol of silver halide in the larger grain size emulsion and $5.6\times10^{-4}$ mol per mol of silver halide in the smaller grain size emulsion) and

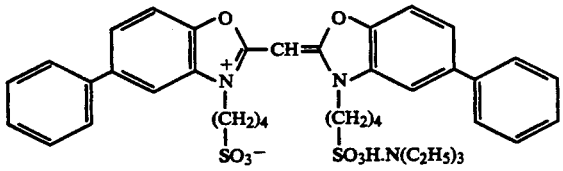

(Amount added: $7.0\times10^{-5}$ mol per mol of silver halide in the larger grain size emulsion and $1.0\times10^{-5}$ mol per mol of silver halide in the smaller grain size emulsion)

RED SENSITIVE EMULSION LAYER

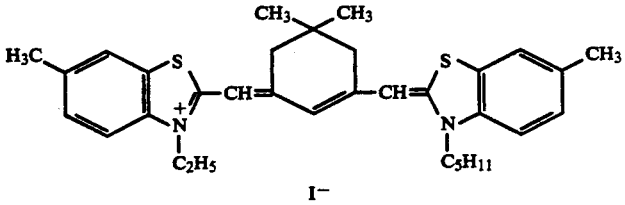

(Amount added: $0.9\times10^{-4}$ mol per mol of silver halide in the larger grain size emulsion and $1.1\times10^{-4}$ mol per mol of silver halide in the smaller grain size emulsion)

To the red-sensitive emulsion layer, was added the compound shown below in an amount of $2.6\times10^{-3}$ mol per mol of silver halide.

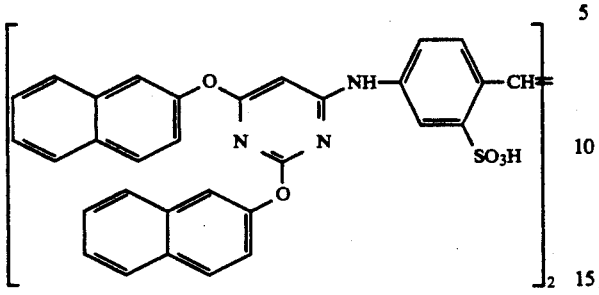

To the blue-sensitive emulsion layer, green-sensitive emulsion layer and red-sensitive emulsion layer, was added 1-(5-methylureidophenyl)-5-mercaptotetrazole in amounts of $8.5\times10^{-5}$ mol, $7.7\times10^{-4}$ mol and $2.5\times10^{-4}$ mol per mol of silver halide, respectively.

Further, to the blue-sensitive emulsion layer and green-sensitive emulsion layer, was added 4-hydroxy-6-methyl-1,3,3a,7-tetraazaindene in amounts of $1\times10^{-4}$ mol and $2\times10^{-4}$ mol per mol of silver halide, respectively.

Moreover, in order to prevent irradiation, the following dyes were added to the emulsion layers.

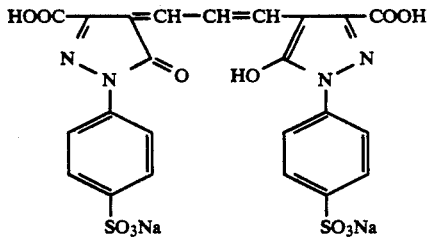

and

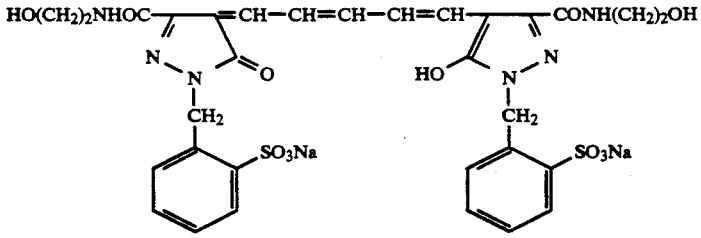

LAYER CONSTRUCTION

The composition of each layer is shown below. The numerical values denote the coating amounts of components in the unit of g/m². The coating amount of silver halide emulsion is indicated in terms of silver coating amount.

| | | |
|---|---|---|
| Support | Polyethylene laminated paper (the polyethylene coating containing a white pigment ($TiO_2$) and a bluish dye (ultramarine) on the first layer side) | |
| First Layer (Blue-sensitive layer) | Silver chlorobromide emulsion described above | 0.30 |
| | Gelatin | 1.86 |
| | Yellow coupler (ExY) | 0.82 |
| | Color image stabilizer (Cpd-1) | 0.19 |

-continued

| | | |
|---|---|---|
| | Solvent (Solv-1) | 0.35 |
| | Color image stabilizer (Cpd-7) | 0.06 |
| Second Layer (Color mixing preventing layer) | Gelatin | 0.99 |
| | Color mixing preventing agent (Cpd-5) | 0.08 |
| | Solvent (Solv-1) | 0.16 |
| | Solvent (Solv-4) | 0.08 |
| Third Layer (Green-Sensitive layer) | Silver chlorobromide emulsion (cubic grains, mixture of two emulsions having average grain size of 0.55 μm and 0.39 μm in 1:3 by molar ratio of silver, coefficient of variation of grain size: 0.10 and 0.08, respectively, 0.8 mol % silver bromide based on the whole of grains being localized at the surface of grains) | 0.12 |
| | Gelatin | 1.24 |
| | Magenta coupler (ExM) | 0.20 |
| | Color image stabilizer (Cpd-2) | 0.03 |
| | Color image stabilizer (Cpd-3) | 0.15 |
| | Color image stabilizer (Cpd-4) | 0.02 |
| | Color image stabilizer (Cpd-10) | 0.02 |
| | Solvent (Solv-2) | 0.40 |
| Fourth Layer (Ultraviolet light absorbing layer) | Gelatin | 1.58 |
| | Ultraviolet light absorbing agent (UV-1) | 0.47 |
| | Color mixing preventing agent (Cpd-5) | 0.05 |
| | Solvent (Solv-5) | 0.24 |
| Fifth Layer (Red-sensitive layer) | Silver chlorobromide emulsion (cubic grains, mixture of two emulsions having average grain size of 0.58 μm and 0.45 μm in 1:4 by molar ratio of silver, coefficient of variation of grain size: 0.09 and 0.11, respectively, 0.6 mol % silver bromide based on the whole of grains being localized at a part of the surface of grains) | 0.23 |
| | Gelatin | 1.34 |
| | Cyan Coupler (ExC) | 0.32 |
| | Color image stabilizer (Cpd-6) | 0.17 |
| | Color image stabilizer (Cpd-7) | 0.40 |
| | Additive (Cpd-8) | 0.01 |
| | Color image stabilizer (Cpd-9) | 0.05 |
| | Solvent (Solv-6) | 0.14 |
| Sixth Layer (Ultraviolet light absorbing layer) | Gelatin | 0.53 |
| | Ultraviolet light absorbing agent (UV-1) | 0.16 |
| | Color mixing preventing agent | 0.02 |

-continued

| | | |
|---|---|---|
| | (CPd-5) | |
| | Solvent (Solv-5) | 0.08 |
| Seventh Layer (Protective layer) | Gelatin | 1.33 |
| | Acryl-modified polyvinyl alcohol copolymer (Degree of modification: 17%) | 0.17 |
| | Liquid paraffin | 0.03 |

The compounds used in the above-described layers have the chemical structures shown below respectively.

Yellow coupler (ExY)

A mixture of

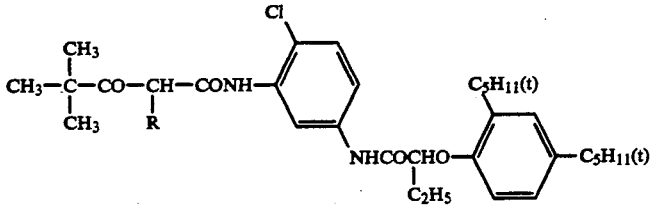

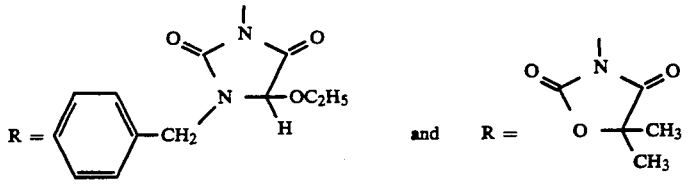

in a molar ratio of 1:1.

Magenta coupler (ExM)

A mixture of

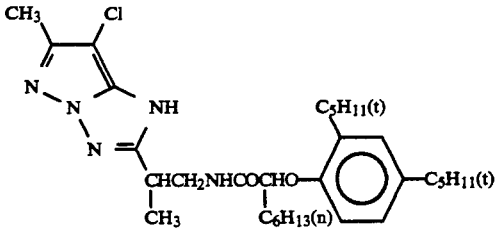

and

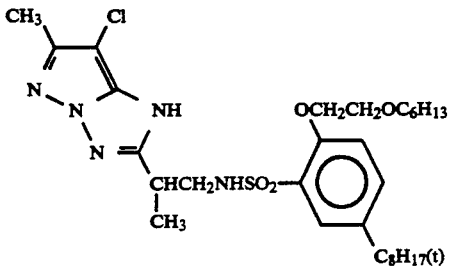

in a molar ratio of 1:1.

Cyan coupler (ExC)

A mixture of

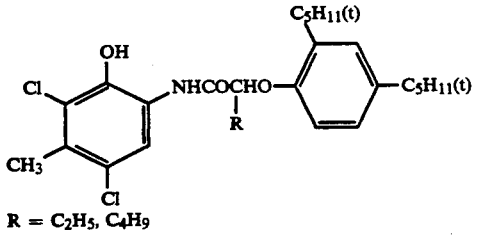

and

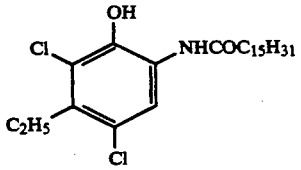

in a weight ratio of 2:4:4.

Color image stabilizer (Cpd-1)

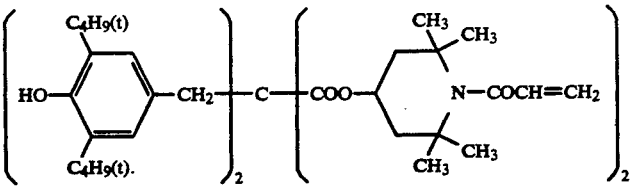

Color Image Stabilizer (Cpd-2)

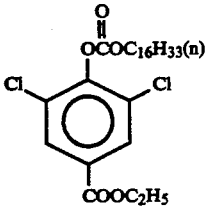

Color image stabilizer (Cpd-3)

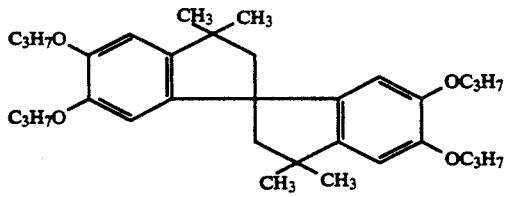

Color image stabilizer (Cpd-4)

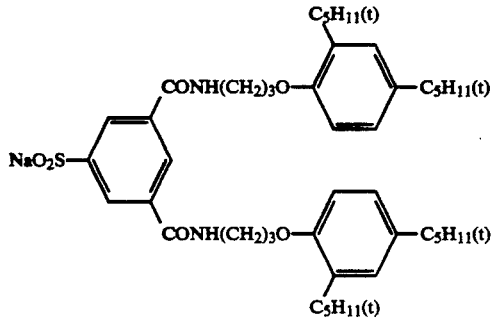

Color mixing preventing agent (Cpd-5)

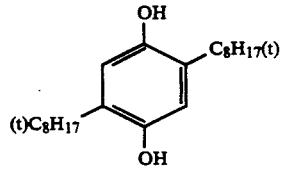

Color Image Stabilizer (Cpd-6)
A mixture of

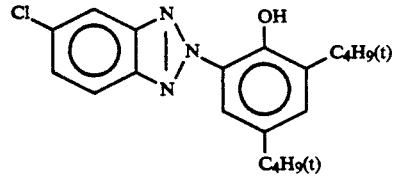

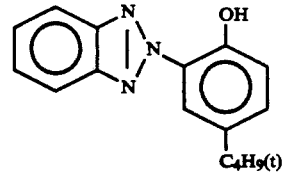

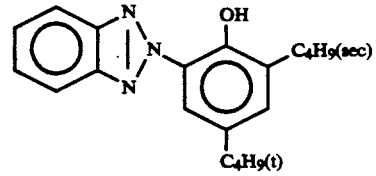

in a weight ratio of 2:4:4
Color Image Stabilizer (Cpd-7), i.e., Compound P17

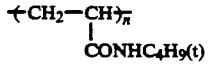

(Average Molecular Weight 60,000)
Additive (Cpd-8), i.e., Compound IV-1

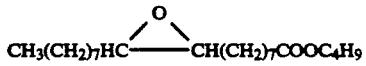

Color image stabilizer (Cpd-9), i.e., Compound III-3

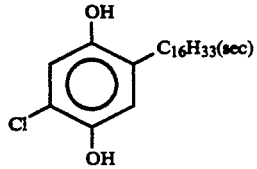

Color image stabilizer (Cpd-10)

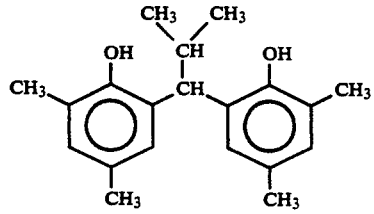

Ultraviolet light absorbing agent (UV-1)
A mixture of

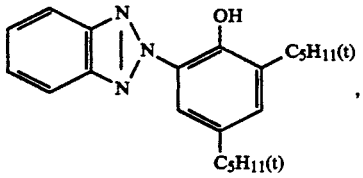

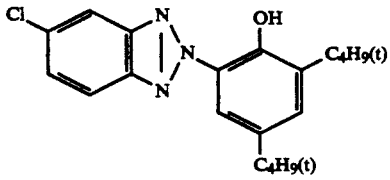

and

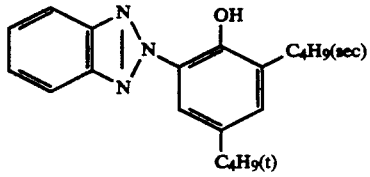

in a weight ratio of 4:2:4.
Solvent (Solv-1)

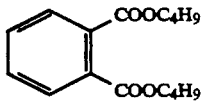

Solvent (Solv-2)
A mixture of

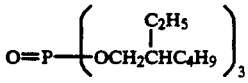

and

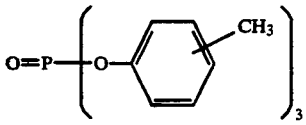

in a volume ratio of 2:1
Solvent (Solv-4)

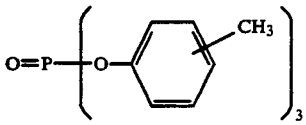

Solvent (Solv-5)

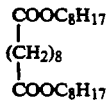

Solvent (Solv-6), e.g., Compound S-5

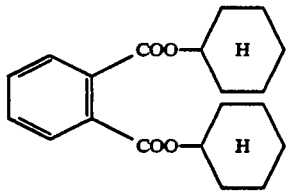

Samples 102 to 124 were prepared in the same manner as described for Sample 101 above except for changing the compounds used in the red-sensitive layer to those shown in Table 1 below, respectively.

Each sample thus-prepared was subjected to wedge exposure through a three-color separating filter for sensitometry using a sensitometer (FWH type, produced by Fuji Photo Film Co., Ltd.) equipped with a light source having a color temperature of 3,200° K. The amount of exposure was 250 CMS and the exposure time was 0.1 second.

The exposed sample was subjected to a continuous processing (running test) by a paper processor according to the processing steps described below until the amount of replenishment for color development reached to twice volume of the tank capacity of color development.

| Processing Step | Temperature (°C.) | Time | Amount of* Replenishment (ml) | Tank Capacity (l) |
|---|---|---|---|---|
| Color Development | 35 | 45 sec. | 102 | 17 |
| Bleach-Fixing | 30–35 | 45 sec. | 215 | 17 |
| Rinse (1) | 30–35 | 20 sec. | — | 10 |
| Rinse (2) | 30–35 | 20 sec. | — | 10 |
| Rinse (3) | 30–35 | 20 sec. | 350 | 10 |
| Drying | 70–80 | 60 sec. | | |

*The amount of replenishment per $m^2$ of photographic light-sensitive material

The rinse steps were conducted using a three-tank countercurrent system from Rinse (3) to Rinse (1).

The composition of each processing solution used is illustrated below.

| | Tank Solution | Replenisher |
|---|---|---|
| Color Developing Solution: | | |
| Water | 800 ml | 800 ml |
| Ethylenediamine-N,N,N',N'-tetramethylenephosphonic acid | 1.5 g | 3.0 g |
| Potassium bromide | 0.015 g | — |
| Triethanolamine | 8.0 g | 14.5 g |
| Sodium chloride | 1.4 g | — |
| Potassium carbonate | 25 g | 25 g |
| N-Ethyl-N-(β-methanesulfonamidoethyl)-3-methyl-4-aminoaniline sulfate | 5.0 g | 9.5 g |
| N,N-Bis(carboxymethyl)hydrazine | 5.5 g | 7.0 g |
| Fluorescent brightening agent (WHITEX 4B manufactured by Sumitomo Chemical Co., Ltd.) | 1.0 g | 2.5 g |
| Water to make | 1000 ml | 1000 ml |
| pH (at 25° C.) | 10.05 | 10.60 |
| Bleach-Fixing Solution: | | |
| Water | 400 ml | 150 ml |
| Ammonium thiosulfate (700 g/l) | 110 ml | 250 ml |
| Sodium sulfite | 17 g | 34 g |
| Ammonium Iron (III) ethylenediaminetetraacetate | 55 g | 110 g |
| Disodium ethylenediaminetetraacetate | 5 g | 8.5 g |
| Ammonium bromide | 40 g | 75.0 g |
| Water to make | 1000 ml | 1000 ml |
| pH (at 25° C.) | 5.8 | 5.6 |
| Rinse Solution: (both tank solution and replenisher) | | |
| Ion-exchanged water (calcium and magnesium contents: not more than 3 ppm respectively) | | |

With the samples thus-obtained, Evaluations 1 and 2 shown below were conducted.

EVALUATION 1

A cyan density of the color image thus-obtained in each sample was measured by a Fuji-Densitometer (Mod-8509 type). Then, the samples were subjected to the oxidation treatment described below.

| Oxidation Treatment: | | |
|---|---|---|
| Processing Step | Temperature (°C.) | Time |
| Oxidation Bath | 38 | 5 min. |
| Washing with water | 15 to 23 | 10 min. |
| Drying | 70 to 80 | 50 sec. |

| Oxidation Bath: | |
|---|---|
| Potassium ferricyanide | 5 g |
| Water to make | 1,000 ml |

After the oxidation treatment, cyan density of each sample was again measured. A cyan density before the oxidation treatment at the point which provided the maximum density after the oxidation treatment was measured and a degree of color restoration failure was determined by the comparison of the cyan density before the oxidation treatment with the cyan density after the oxidation treatment.

EVALUATION 2

Each sample processed with the oxidation treatment was subjected to a color fading test using a light-fading tester with a xenon lamp (about 250,000 lux) for 24 hours. A cyan density after the fading test at the point which had a cyan density of 2.00 after the oxidation treatment was measured and the difference between these cyan densities was determined.

The results of Evaluation 1 and 2 together with the compounds used in the red-sensitive layer are shown in Table 1 below.

-continued

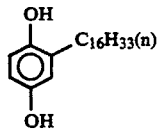

(Compound described in JP-A-63-316857)

Comparative Compound (C):

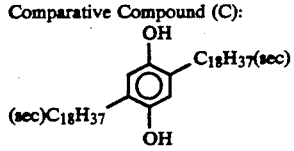

(Compound described in JP-A-63-316857)

Comparative Compound (D):

TABLE 1

| Sample No. | Compound of Formula (II) or (III) | Compound of Formula (IV) | High Boling Solvent | Organic Polymer Compound | Cyan Dmax after Running Processing | Degree of Color Restoration Failure | Degree of Light Fading | Remark |
|---|---|---|---|---|---|---|---|---|
| 101 | III-3 | IV-1 | S-5 | P-17 | 2.62 | 0.05 | 0.08 | Present Invention |
| 102 | III-3 | IV-1 | S-1 | P-17 | 2.62 | 0.04 | 0.08 | Present Invention |
| 103 | III-3 | IV-1 | (A) | P-17 | 2.59 | 0.08 | 0.11 | Present Invention |
| 104 | III-3 | IV-1 | (B) | P-17 | 2.58 | 0.09 | 0.12 | Present Invention |
| 105 | III-3 | IV-1 | (A) | — | 2.60 | 0.08 | 0.14 | Present Invention |
| 106 | III-3 | IV-1 | (B) | — | 2.59 | 0.09 | 0.14 | Present Invention |
| 107 | III-3 | — | (A) | — | 2.50 | 0.09 | 0.14 | Comparison |
| 108 | III-3 | — | S-5 | — | 2.46 | 0.08 | 0.13 | " |
| 109 | — | IV-1 | (A) | — | 2.40 | 0.22 | 0.08 | " |
| 110 | (A) | IV-1 | (A) | — | 2.40 | 0.20 | 0.32 | " |
| 111 | (B) | IV-1 | (A) | — | 2.58 | 0.06 | 0.20 | " |
| 112 | (C) | IV-1 | (A) | — | 2.40 | 0.10 | 0.30 | " |
| 113 | (D) | IV-1 | (B) | — | 2.42 | 0.22 | 0.32 | " |
| 114 | (E) | IV-1 | (B) | — | 2.40 | 0.21 | 0.21 | " |
| 115 | (F) | IV-1 | (B) | — | 2.40 | 0.10 | 0.29 | Comparison |
| 116 | II-3/III-3*1 | IV-9 | S-16 | P-53 | 2.60 | 0.06 | 0.08 | Present Invention |
| 117 | III-2 | IV-1 | S-1 | P-1 | 2.61 | 0.05 | 0.09 | Present Invention |
| 118 | III-2 | IV-12 | S-19 | P-57 | 2.60 | 0.06 | 0.08 | Present Invention |
| 119 | III-3 | IV-1 | S-41 | P-17 | 2.60 | 0.06 | 0.08 | Present Invention |
| 120 | III-6 | IV-5 | S-5 | P-1 | 2.60 | 0.06 | 0.09 | Present Invention |
| 121 | III-15 | IV-1 | S-19 | P-1 | 2.61 | 0.05 | 0.09 | Present Invention |
| 122 | III-2/III-3*2 | IV-9 | S-5 | P-53 | 2.61 | 0.05 | 0.08 | Present Invention |
| 123 | III-2/III-3*2 | IV-1 | S-5 | P-17 | 2.62 | 0.05 | 0.08 | Present Invention |
| 124 | III-2/III-3*2 | IV-12 | S-19 | P-53 | 2.60 | 0.05 | 0.08 | Present Invention |

*1mixture of 1:99 by weight
*2mixture of 1:1 by weight

Comparative Compound (A):

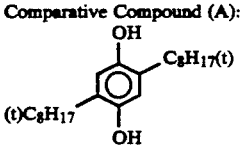

Comparative Compound (B):

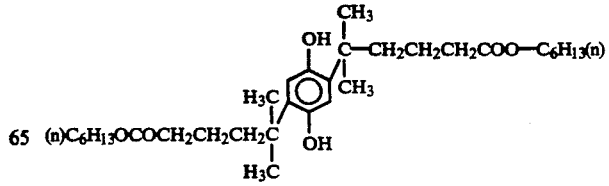

Comparative Compound (E):

-continued

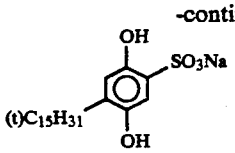

Comparative Compound (F):

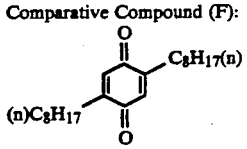

(Compound described in JP-A-63-316857)

High Boiling Solvent (A):

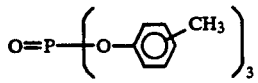

High Boiling Solvent (B):

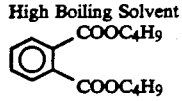

From the results shown in Table 1, it can be seen that with the sample which does not contain the compound represented by formula (II) and/or (III), the Dmax after the running processing is low and the degree of color restoration failure is large (comparison of Sample 109 with the samples of the present invention). In those samples using the compound described in JP-A-63-316857, i.e., Comparative Compounds (B), (C) and (F), although the color restoration failure can be reduced, there is a problem in that the light fading remarkably increases when compared with samples containing no such compound. Further, hydroquinone compounds other than those according to the present invention exhibit only a slight effect for preventing the color restoration failure and large light fading. On the contrary, when the compound represented by formula (II) or (III) according to the present invention is employed, a sufficient effect for preventing the color restoration failure can be obtained and light fading does not substantially increase. However, with the samples in which the compound represented by formula (IV) is not coexistent (Samples 107 and 108), there is a problem in that the Dmax after the running processing is insufficient.

As is apparent from the above results, those samples which employ the compound represented by formula (II) and/or (III) together with the compound represented by formula (IV) improve the color restoration failure and restrain the light fading simultaneously while maintaining the sufficiently high color density. Also, it is clear that the color restoration failure is further improved and the light fading is further restrained, when the high boiling solvent and/or the organic polymer compound is included.

EXAMPLE 2

Samples 201 to 206 were prepared in the same manner as described for Sample 123 in Example 1 but changing the cyan coupler to the equimolar amount of those shown in Table 2 below, respectively.

As a result of conducting the same evaluations as described in Example 1, it can be seen that in accordance with the present invention the sufficiently high color density as well as good results in that the degree of color restoration failure is not more than 0.06 and in that the degree of the light fading is not more than 0.09 are obtained irrespective of the cyan coupler.

TABLE 2

| Sample No. | Cyan Coupler |
|---|---|
| 201 | I-2/I-5 (3:2 in molar ratio) |
| 202 | I-2/I-4 (1:1 in molar ratio) |
| 203 | I-2/I-10 (1:2 in molar ratio) |
| 204 | I-5 |
| 205 | I-2/I-11 (1:1 in molar ratio) |
| 206 | I-18 |

EXAMPLE 3

The color papers prepared in Example 2 were imagewise exposed and subjected to a continuous processing (running test) by a paper processor according to the processing steps described below until the amount of replenishment for color development reached to twice volume of the tank capacity of color development. Then, the same color papers exposed in the same manner as described in Example 1 were processed in the same manner.

| Processing Step | Temperature (°C.) | Time | Amount of* Replenishment (ml) | Tank Capacity (l) |
|---|---|---|---|---|
| Color Development | 35 | 45 sec. | 161 | 17 |
| Bleach-Fixing | 30–36 | 45 sec. | 215 | 17 |
| Stabilizing (1) | 30–37 | 20 sec. | — | 10 |
| Stabilizing (2) | 30–37 | 20 sec. | — | 10 |
| Stabilizing (3) | 30–37 | 20 sec. | — | 10 |
| Stabilizing (4) | 30–37 | 30 sec. | 248 | 10 |
| Drying | 70–85 | 60 sec. | | |

*The amount of replenishment per $m^2$ of photographic light-sensitive material

The stabilizing steps were conducted using a four-tank countercurrent system from Stabilizing (4) to Stabilizing (1).

The composition of each processing solution used was as follows:

| Color Developing Solution: | Tank Solution | Replenisher |
|---|---|---|
| Water | 800 ml | 800 ml |
| Ethylenediaminetetraacetic acid | 2.0 g | 2.0 g |
| 5,6-Dihydroxybenzene-1,2,4-trisulfonic acid | 0.3 g | 0.3 g |
| Triethanolamine | 8.0 g | 8.0 g |
| Sodium chloride | 1.4 g | — |
| Potassium carbonate | 25 g | 25 g |
| N-Ethyl-N-(β-methanesulfonamidoethyl)-3-methyl-4-aminoaniline sulfate | 5.0 g | 7.0 g |
| Diethylhydroxylamine | 4.2 g | 6.0 g |
| Fluorescent brightening agent (4,4'-diaminostilbene type) | 2.0 g | 2.5 g |
| Water to make | 1000 ml | 1000 ml |
| pH (at 25° C.) | 10.0.5 | 10.45 |

Bleach-Fixing Solution: (both tank solution and replenisher)

| | |
|---|---|
| Water | 400 ml |
| Ammonium thiosulfate (700 g/l) | 100 ml |
| Sodium sulfite | 17 g |
| Ammonium Iron (III) ethylenediaminetetraacetate | 55 g |
| Disodium ethylenediaminetetraacetate | 5 g |
| Glacial acetic acid | 9 g |
| Water to make | 1000 ml |

-continued

| | |
|---|---|
| pH (at 25° C.) | 5.40 |

| Stabilizing Solution: (both tank solution and replenisher) | |
|---|---|
| Formaldehyde (37%) | 0.1 g |
| Formaldehyde-sulfite adduct | 0.7 g |
| 5-Chloro-2-methyl-4-isothiazolin-3-one | 0.02 g |
| 2-Methyl-4-isothiazolin-3-one | 0.01 g |
| Cupric sulfate | 0.005 g |
| Water to make | 1000 ml |
| pH (at 25° C.) | 4.0 |

The samples thus processed were subjected to the same evaluations as described in Example 1. The similar results were obtained.

While the invention has been described in detail and with reference to specific embodiments thereof, it will be apparent to one skilled in the art that various changes and modifications can be made therein without departing from the spirit and scope thereof.

What is claimed is:

1. A multilayer silver halide color photographic material comprising a support having thereon a yellow color forming silver halide emulsion layer, a magenta color forming silver halide emulsion layer and a cyan color forming silver halide emulsion layer, wherein the cyan color forming silver halide emulsion layer contains at least one oil-soluble cyan coupler which is capable of coupling with an oxidation product of an aromatic primary amine developing agent to form a substantially diffusion-resistant dye, and which is represented by formula (I), at least one member selected from the compounds represented by formulae (II) and (III), and at least one compound represented by formula (IV):

(I)

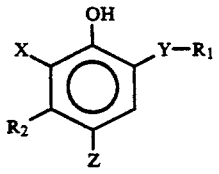

(II)

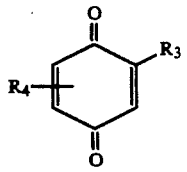

(III)

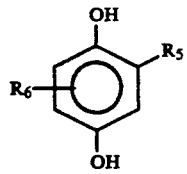

(IV)

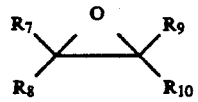

wherein:

Y represents —NHCO— or —CONH—;

$R_1$ represents an alkyl group, an aryl group, a heterocyclic group or an amino group;

X represents a hydrogen atom, a halogen atom, an alkoxy group or an acylamino group;

$R_2$ represents an alkyl group or an acylamino group or, when bonded to X, a non-metallic atom which forms a 5-membered to 7-membered ring;

Z represents a hydrogen atom or a group capable of being released upon coupling with an oxidation product of a developing agent;

$R_3$ and $R_5$ each represents a halogen atom;

$R_4$ and $R_6$ each represents an alkyl group, an aryl group, an alkoxy group, an aryloxy group, an alkylthio group, an arylthio group, an amido group, an acyl group, a sulfonyl group, an alkoxycarbonyl group, an aryloxycarbonyl group, a carbamoyl group, a sulfamoyl group or a sulfoxide group, with the proviso that each of these groups has 6 or more carbon atoms; and $R_7$, $R_8$, $R_9$ and $R_{10}$ each represents a hydrogen atom, an aliphatic group, an aromatic group, an aliphatic oxycarbonyl group, an aromatic oxycarbonyl group or a carbamoyl group, or $R_7$ and $R_8$ or $R_9$ and $R_{10}$ may combine with each other to form a 5-membered to 7-membered ring, with the provisos that $R_7$, $R_8$, $R_9$ and $R_{10}$ do not simultaneously represent hydrogen atoms, and the total number of carbon atoms included therein is from 8 to 60.

2. A multilayer silver halide color photographic material as claimed in claim 1, wherein the group represented by $R_1$ has one or more substituents selected from an alkyl group, an aryl group, an alkyl- or aryloxy group, a carboxy group, an alkyl- or arylcarbonyl group, an alkyl- or aryloxycarbonyl group, an acyloxy group, a sulfamoyl group, a carbamoyl group, a sulfonamido group, an acylamino group, an imido group, a sulfonyl group, a hydroxy group, a cyano group, a nitro group and a halogen atom.

3. A multilayer silver halide color photographic material as claimed in claim 1, wherein $R_2$ and X are combined to form a 5-membered, 6-membered or 7-membered ring.

4. A multilayer silver halide color photographic material as claimed in claim 1, wherein the group capable of being released is a halogen atom, an alkoxy group, an aryloxy group, an acyloxy group, a sulfonyloxy group, an amido group, an alkoxycarbonyloxy group, an aryloxycarbonyloxy group, an aliphatic or aromatic thio group, an imido group, an N-heterocyclic group, or an aromatic azo group.

5. A multilayer silver halide color photographic material as claimed in claim 1, wherein Y represents —NHCO— and $R_1$ represents an alkyl group or an aryl group.

6. A multilayer silver halide color photographic material as claimed in claim 1, wherein $R_2$ represents an alkyl group having from 1 to 15 carbon atoms.

7. A multilayer silver halide color photographic material as claimed in claim 1, wherein Z represents a hydrogen atom or a halogen atom.

8. A multilayer silver halide color photographic material as claimed in claim 1, wherein X represents a halogen atom.

9. A multilayer silver halide color photographic material as claimed in claim 3, wherein the ring is a heterocyclic ring.

10. A multilayer silver halide color photographic material as claimed in claim 1, wherein $R_4$ and $R_6$ each represents an alkyl group, an alkylthio group or an amido group.

11. A multilayer silver halide color photographic material as claimed in claim 1, wherein $R_3$ and $R_4$ or $R_5$ and $R_6$ are present at the 2- and 5-positions.

12. A multilayer silver halide color photographic material as claimed in claim 1, wherein the at least one compound represented by formula (II) or (III) is present in an amount of from 0.1 to 100 mol % relative to the cyan coupler.

13. A multilayer silver halide color photographic material as claimed in claim 1, wherein the at least one compound represented by formula (II) or (III) and the cyan coupler are present in the same oil droplets.

14. A multilayer silver halide color photographic material as claimed in claim 1, wherein the aliphatic or aromatic group included in the group represented by $R_7$, $R_8$, $R_9$ or $R_{10}$ in formula (IV) has one or more substituents selected from an alkyl group, an aryl group, a heterocyclic group, an alkoxy group, an aryloxy group, an alkenyloxy group, an acyl group, an ester group, an amido group, a sulfamido group, an imido group, a ureido group, an aliphatic or aromatic sulfenyl group, an aliphatic or aromatic thio group, a hydroxy group, a cyano group, a carboxy group, a nitro group, a sulfo group, and a halogen atom.

15. A multilayer silver halide color photographic material as claimed in claim 1, wherein the compound represented by formula (IV) and the cyan coupler are present in the same oil droplets.

16. A multilayer silver halide color photographic material as claimed in claim 1, wherein the compound represented by formula (IV) is present in a range from 0.1 to 100% by weight to the cyan coupler.

17. A multilayer silver halide color photographic material as claimed in claim 1, wherein the cyan color forming silver halide emulsion layer further contains a high boiling organic solvent having a viscosity of not less than 200 cp (at 25° C.).

18. A multilayer silver halide color photographic material as claimed in claim 17, wherein the high boiling organic solvent is a compound represented by formula (IIs), (IIIs), (IVs), (Vs), (VIs) or (VIIs):

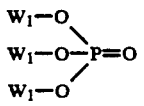
(IIs)

$W_1—COOW_2$ (IIIs)

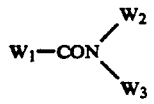
(IVs)

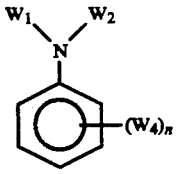
(Vs)

$W_1—O—W_2$ (VIs)

$W_5—X$ (VIIs)

wherein $W_1$, $W_2$ and $W_3$ each represents a substituted or unsubstituted alkyl, cycloalkyl, alkenyl, aryl or heterocyclic group; $W_4$ represents $—W_1$, $—O—W_1$ or $—S—W_1$; n represents an integer of from 1 to 5, when n represents 2 or more, two or more $W_4$'s may be the same or different; $W_1$ and $W_2$ in formula (VIs) may be connected to form a condensed ring; $W_5$ represents a substituted or unsubstituted alkyl, cycloalkyl or aryl group and the total carbon atoms included in $W_5$ is not less than 12; and X represents a halogen atom.

19. A multilayer silver halide color photographic material as claimed in claim 18, wherein the high boiling organic solvent is a compound represented by formula (IIs) or (IIIs).

20. A multilayer silver halide color photographic material as claimed in claim 19, wherein the high boiling organic solvent is a compound represented by formula (IIIs-1) or (IIIs-2):

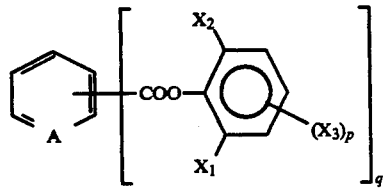
(IIIs-1)

wherein A represents =CH— or =N—; $X_1$, $X_2$ and $X_3$ each represents —H, halogen, $—R_{12}$, $—CH=NOR_{12}$, $—COR_{12}$, $—SO_2R_{12}$, $—Y_1=R_{12}$, $—Y_1—COR_{12}$, $—CO—Y_1—R_{12}$, $—Y_1—SO_2R_{12}$ or $—SO_2—Y_1—R_{12}$, or two of $X_1$, $X_2$ and $X_3$ combine with each other and represents an atomic group necessary to form a carbon ring or hetero ring; $Y_1$ represents —O—, —S— or

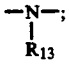

$R_{13}$ represents —H or $—R_{12}$; $R_{12}$ represents a substituted or unsubstituted alkyl group containing from 1 to 12 carbon atoms, a substituted or unsubstituted aryl group containing from 6 to 20 carbon atoms, a substituted unsubstituted aryl group containing from 6 to 20 carbon atoms or a substituted or unsubstituted heterocyclic group containing from 2 to 20 carbon atoms; q represents 2, 3 or 4; and p represents 1, 2 or 3, provided that at least one of $X_1$ and $X_2$ substituted on the same benzene ring must contain at least two non-hydrogen atoms

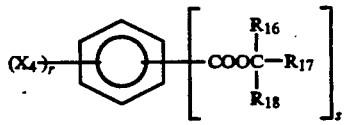
(IIIs-2)

wherein $X_4$ represents a halogen atom, an alkyl group containing from 1 to 20 carbon atoms, an alkoxy group containing from 1 to 20 carbon atoms or an alkoxycarbonyl group containing from 2 to 21 carbon atoms; r represents an integer of from 0 to 5; $R_{16}$, $R_{17}$ and $R_{18}$ each represents a straight chain or branched chain alkyl group containing from 1 to 12 carbon atoms, a cycloalkyl group containing from 3 to 12 carbon atoms, an aralkyl group containing from 7 to 20 carbon atoms, an aryl group containing from 6 to 20 carbon atoms or a heterocyclic group containing from 3 to 12 carbon atoms, $R_{16}$ further represents a hydrogen atom, or $R_{17}$ and $R_{18}$ may combine to form a ring; and s represents an integer of from 1 to 4, when r represents 2 or more, two or more $X_4$'s may be the same or different, when s represents 2 or more, two or more

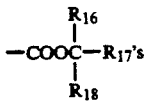

may be the same or different, provided that the sum of r and s is not more than 6.

21. A multilayer silver halide color photographic material as claimed in claim 20, wherein the high boiling organic solvent is a compound represented by formula (IIIs-3) or (IIIs-4):

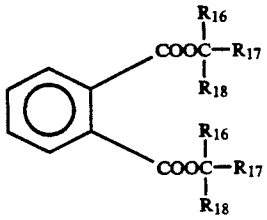

(IIIs-3)

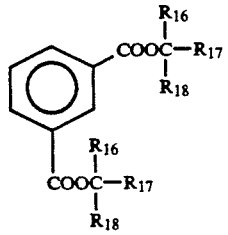

(IIIs-4)

wherein $R_{16}$, $R_{17}$ and $R_{18}$ each is defined as in formula (IIIS-2).

22. A multilayer silver halide color photographic material as claimed in claim 1, wherein the cyan color forming silver halide emulsion layer further contains a water-insoluble organic polymer compound.

23. A multilayer silver halide color photographic material as claimed in claim 22, wherein the water-insoluble organic polymer compound has a relative fluorescence efficiency of not less than 0.10.

24. A multilayer silver halide color photographic material as claimed in claim 22, wherein the water-insoluble organic polymer compound is a vinyl polymer.

25. A multilayer silver halide color photographic material as claimed in claim 24, wherein the vinyl polymer composed of a monomer selected from among a methacrylic acid ester, an acrylamide and a methacrylamide.

26. A multilayer silver halide color photographic material as claimed in claim 1, wherein the silver halide emulsion comprises silver chlorobromide or silver chloride, each containing substantially no silver iodide.

27. A multilayer silver halide color photographic material as claimed in claim 1, wherein the yellow color forming silver halide emulsion layer contains at least one magenta coupler and the magenta color forming silver halide emulsion layer contains at least one yellow coupler.

28. A multilayer silver halide color photographic material as claimed in claim 27, wherein the magenta coupler is a compound represented by formula (M-I):

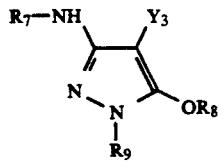

(M-I)

wherein $R_7$ and $R_9$ each represents an aryl group; $R_8$ represents a hydrogen atom, an aliphatic or aromatic acyl group or an aliphatic or aromatic sulfonyl group; and $Y_3$ represents a hydrogen atom or a releasing group.

29. A multilayer silver halide color photographic material as claimed in claim 27, wherein the magenta coupler is a compound represented by formula (M-II):

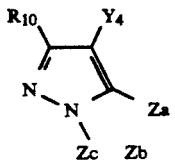

(M-II)

wherein $R_{10}$ represents a hydrogen atom or a substituent; $Y_4$ represents a hydrogen atom or a releasing group; Za, Zb and Zc each represents a methine group, a substituted methine group, =N— or —NH—, one of the Za-Zb bond and the Zb-Zc bond being a double bond and the other being a single bond; when the Zb-Zc bond is a carbon-carbon double bond, the Zb-Zc bond may be a part of a condensed aromatic ring; $R_{10}$ or $Y_4$ may also form a polymer including a dimer or more; and when Za, Zb or Zc is a substituted methine group, the substituted methine group may form a polymer including a dimer or more.

30. A multilayer silver halide color photographic material as claimed in claim 27, wherein the yellow coupler is a compound represented by formula (Y):

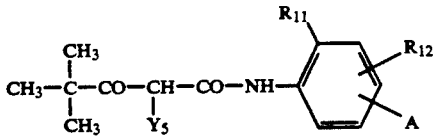

(Y)

wherein $R_{11}$ represents a halogen atom, an alkoxy group, a trifluoromethyl group or an aryl group; $R_{12}$ represents a hydrogen atom, a halogen atom or an alkoxy group; A represents $—NHCOR_{13}$, $—NHSO_2R_{13}$, $—SO_2NHR_{13}$, $—COOR_{13}$ or

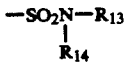

wherein $R_{13}$ and $R_{14}$ each represents an alkyl group, an aryl group or an acyl group; and $Y_5$ represents a releasing group.

31. A multilayer silver halide color photographic material as claimed in claim 1, wherein the cyan color forming silver halide emulsion layer further contains an ultraviolet light absorbing agent.

32. A multilayer silver halide color photographic material as claimed in claim 31, wherein the ultraviolet light absorbing agent is an aryl group-substituted benzotriazole compound.

33. A multilayer silver halide color photographic material as claimed in claim 27, wherein the magenta color forming silver halide emulsion layer further contains a compound selected from Compound (F) which is capable of forming a chemical bond with the aromatic amine developing agent remaining after color development to give a chemically inactive and substantially colorless compound, and Compound (G) which is capable of forming a chemical bond with the oxidation product of the aromatic amine developing agent remaining after color development to give a chemically inactive and substantially colorless compound.

34. A multilayer silver halide color photographic material as claimed in claim 33, wherein Compound (F) is a compound represented by formula (FI) or (FII):

$$R_1-(A)_n-X \quad \text{(FI)}$$

$$R_2-\underset{\underset{B}{|}}{C}=Y \quad \text{(FII)}$$

wherein $R_1$ and $R_2$ each represents an aliphatic group, an aromatic group or a heterocyclic group; n represents 0 or 1; A represents a group capable of reacting with an aromatic amine developing agent to form a chemical bond; X represents a group capable of being released upon the reaction with an aromatic amine developing agent; B represents a hydrogen atom, an aliphatic group, an aromatic group, a heterocyclic group, an acyl group or a sulfonyl group; Y represents a group capable of accelerating the addition of an aromatic amine developing agent to the compound represented by formula (FII); or $R_1$ and X, or Y and $R_2$ or B may combine to form a cyclic structure.

35. A multilayer silver halide color photographic material as claimed in claim 33, wherein Compound (G) is a compound represented by formula (GI):

$$R\text{-}Z \quad \text{(GI)}$$

wherein R represents an aliphatic group, an aromatic group or a heterocyclic group; and Z represents a nucleophilic group or a group capable of being decomposed in the photographic material to release a nucleophilic group.

36. A multilayer silver halide color photographic material as claimed in claim 1, wherein the support is a reflective support.

37. A multilayer silver halide color photographic material according to claim 1 wherein the at least one compound represented by formula (II) or (III), the compound represented by formula (IV) and a cyan coupler are present in the same oil droplets.

* * * * *